US008439734B2

(12) United States Patent
Kasai

(10) Patent No.: US 8,439,734 B2
(45) Date of Patent: May 14, 2013

(54) ELECTRONIC GAME MACHINE AND ITS PROGRAM

(75) Inventor: Kazuhiko Kasai, Yamanashi (JP)

(73) Assignee: Kazuhiko Kasai, Yamanashi (JP)

( * ) Notice: Subject to any disclaimer, the term of this patent is extended or adjusted under 35 U.S.C. 154(b) by 0 days.

(21) Appl. No.: 13/434,353

(22) Filed: Mar. 29, 2012

(65) Prior Publication Data

US 2013/0084928 A1 Apr. 4, 2013

(30) Foreign Application Priority Data

May 31, 2011 (JP) ..... 2011-121855

(51) Int. Cl.
*A63F 9/24* (2006.01)

(52) U.S. Cl.
USPC ..... 463/9; 463/1; 463/11; 463/25

(58) Field of Classification Search ..... 463/1, 9, 463/11; 273/288
See application file for complete search history.

(56) References Cited

U.S. PATENT DOCUMENTS

| | | | | |
|---|---|---|---|---|
| 2,896,950 | A * | 7/1959 | Rosti et al. | 273/258 |
| 3,561,774 | A * | 2/1971 | Brinser | 273/241 |
| 4,643,432 | A * | 2/1987 | Berry et al. | 273/260 |
| 5,657,990 | A * | 8/1997 | Patel | 273/263 |
| 6,394,455 | B1 * | 5/2002 | Denoual | 273/290 |
| 2010/0048276 | A1 * | 2/2010 | Wang | 463/14 |

FOREIGN PATENT DOCUMENTS

| | | |
|---|---|---|
| JP | 08196687 | 8/1996 |
| JP | 2006192209 | 7/2006 |

* cited by examiner

*Primary Examiner* — Tramar Harper
(74) *Attorney, Agent, or Firm* — The Law Office of Michael E. Kondoudis

(57) ABSTRACT

An electronic game machine including a central processing unit, a storing device, a display, and an inputting device. The central processing unit serves as a game board displaying unit to display a game board on a display, a game piece deploy controlling unit to initially deploy game pieces, and a game piece movement permitting unit to permit the movement of the game pieces.

10 Claims, 52 Drawing Sheets

| Kind of game piece | | State | Kind of graphics | First game piece | Second game piece | Third game piece | Fourth game piece | Fifth game piece | Sixth game piece | Seventh game piece |
|---|---|---|---|---|---|---|---|---|---|---|
| White game piece 5 | Solid game piece 7 | Front side | Hollow graphics | | | | | | | |
| | | Rear side | Solid graphics | | | | | | | |
| | Hollow game piece 11 | Front side | Solid graphics | | | | | | | |
| | | Rear side | Hollow graphics | | | | | | | |
| Black game piece 6 | Solid game piece 8 | Front side | Hollow graphics | | | | | | | |
| | | Rear side | Solid graphics | | | | | | | |
| | Hollow game piece 12 | Front side | Solid graphics | | | | | | | |
| | | Rear side | Hollow graphics | | | | | | | |

Fig. 4

| Kind of integrated game piece | | Name of united game piece | Example of uniting | Obtained score |
|---|---|---|---|---|
| White game piece 5 | Solid game piece described in solid graphics (regular solid game piece) + hollow game piece described in solid graphics (semi-hollow game piece) | Solid united game piece | | Number of intersecting lines at the intersection point where united game pieces exist. |
| | Solid game piece described in hollow graphics (semi-solid game piece) + hollow game piece described in hollow graphics (regular hollow game piece) | Hollow integrated game piece | | Number of intersecting lines at the intersection point where united game pieces exist + two points |
| | Solid game piece described in hollow graphics (semi-solid game piece) + hollow game piece described in solid graphics (semi-hollow game piece) | Semi doubly united game piece | | Number of intersected lines at the intersection point where united game pieces exist x 2 |
| | Solid game piece described in solid graphics (regular solid game piece) + hollow game piece described in hollow graphics (regular hollow game piece) | Regular doubly united game piece | | Number of intersecting lines at the intersection point where united game pieces exist x 2 + five points |
| Black game piece 6 | Solid game piece described in solid graphics (regular solid game piece) + hollow game piece described in solid graphics (semi-hollow game piece) | Solid united game piece | | Number of intersecting lines at the intersection point where united game pieces exist. |
| | Solid game piece described in hollow graphics (semi-solid game piece) + hollow game piece described in hollow graphics (regular hollow game piece) | Hollow integrated game piece | | Number of intersecting lines at the intersection point where united game pieces exist + two points |
| | Solid game piece described in hollow graphics (semi-solid game piece) + hollow game piece described in solid graphics (semi-hollow game piece) | Semi doubly united game piece | | Number of intersected lines at the intersection point where united game pieces exist x 2 |
| | Solid game piece described in solid graphics (regular-solid game piece) + hollow game piece described in hollow graphics (regular hollow game piece) | Regular doubly united game piece | | Number of intersecting lines at the intersection point where united game pieces exist x 2 + five points |

Fig. 7

ELECTRONIC GAME MACHINE AND ITS PROGRAM

BACKGROUND OF THE INVENTION

1. Field of the Invention

The present invention relates to an electronic game machine and its program by which a game player fights while putting a game piece having a different color on an intersection point of a game board on which vertical and horizontal ruled lines and left-slanted and right-slanted ruled lines intersect and while moving the game piece.

2. Description of the Related Art

Conventionally, play equipment is known in which a game player puts forward a game piece to play a game on a game board according to a specified rule and due to recent years' development of IT technology, a game of this kind is played, in many cases, by using an electronic game machine.

The conventional electronic game machine includes one disclosed in Japanese Patent Application Laid-No Hei 8-196687 (Patent Reference 1) in which a plurality of kinds of games having forwarding rules (forwarding direction and number of measures able to be forwarded as one move) of a game piece determined depending on kinds of game pieces is deployed on a game board partitioned into a plurality of measures to start a game and, when a given game piece moves to other measure and when two game pieces occupy one same measure, irrespective of whether a friend or foe has a right of ownership and the two game pieces changes, due to merging of forwarding rules, to one game piece having new forwarding rules, a block puzzle game to be executed by a computer disclosed in Japanese Patent Application Laid-open No. 2006-192209 (Patent Reference 2) in which a plurality of one-side frame blocks constructed by, at least, dividing a frame body and at least one character to take an action to push the one-side frame blocks is allowed to appear on a game field displayed on a display section and the character can control on the one-side frame blocks from its inside.

However, the game machine disclosed in the above Patent Reference 1, with the main purpose of changing rules of Shogi and a chess game, a plurality of kinds of game pieces having forwarding rules (forwarding direction and number of measures able to be forwarded as one move) of a game piece determined depending on kinds of game pieces is, merely, placed regularly within measures on the game board divided into a plurality of measures. That is, the game machine disclosed in the Patent Reference 1) is not devised for a game player to obtain a different score depending on a large or small number of intersected lines by forming so that the number of intersected lines is made different at each intersection point or to be able to jump over all game pieces collectively by successively arranging game pieces on a line. Moreover, the game piece disclosed in the Patent Reference 1) is made up a transparent acrylic resin having the same shape as the measure on the game board and, therefore, visual recognition of a game piece itself is difficult and is so formed that game pieces can be united by imposing game pieces up and down on each other and therefore the visual recognition of a lower game piece when game pieces are united with one another and, in any case, there is a problem being an obstacle in playing games. This problem remains as a problem when a game of play equipment is displayed on a display by computer software being still an obstacle for playing a game.

Further, the game machine disclosed in the Patent Reference 2) intends to form a block united body by moving the one-side frame block on the game field and, therefore, has the similar problems appeared in the Patent Reference 1.

Accordingly, the inventions disclosed both in the Patent References 1 and 2 cannot provide very noble and progressive game and, therefore, it is difficult for the conventional game to improve elegance and tastefulness of a game and difficult to be spread widely to increase opportunities of communications of people and to improve cultural level.

SUMMARY OF THE INVENTION

In view of the foregoing, it is an object of the present invention to provide an electronic game machine and its program which, by providing a game very new and progressive game, enables the improvement of elegance and tastefulness of a game and, by spreading the game widely, enables the increase of communication and the improvement of the cultural level.

According to a first aspect of the present invention, there is provided an electronic game machine comprising a CPU (Central Processing Unit), a storing device, a display, and an inputting device, wherein the CPU functions as: a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score, a game piece deploy controlling unit to initially deploy game pieces each having a color being different for every game player wherein game pieces each having any one of two colors, are devised so that different combinations of graphics are able to be written on a plurality of and same number of both front and rear sides of each of game pieces at an intersection point on the game board displayed on the display by the game board displaying unit based on data stored in the storing device according to operations of the inputting device, wherein the game piece comprises a combination of a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different hollow graphics is written in writing space on the front side, a solid graphics having a contour being different from the hollow graphics on the front side, out of the solid graphics having a contour with a same shape with each of the hollow graphics is written in writing space on the rear side of each solid game piece having a color and wherein, on a hollow game piece each having one of two colors, a different solid graphic is written in writing space on the front side of the hollow game piece and a hollow graphic having a contour different from a solid graphics on the front side out of hollow graphics each having a same shape as each of the solid graphics on the rear side of the hollow game pieces and wherein a hollow graphics being able to be united with the solid graphic written on the solid game piece is written on the hollow game pieces and a solid graphic being able to be united with a solid graphics written on the solid game pieces and a solid graphics being able to be united with a hollow graphics written on the solid game piece is written on the hollow game pieces and wherein doubly uniting is made possible which includes uniting between game pieces, one being a game piece on which the solid graphics or the hollow graphics is written and the other being a game piece on which a hollow graphics or a solid graphics having a contour with a same color and same shape with the other game piece is written and the uniting between graphics, one being the solid graphics written on the solid game piece or hollow game piece and the other hollow graphics written on the hollow game piece or the solid game piece, a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united having the solid graphics written on the solid game piece or hollow game piece to be moved or the hollow graphics or solid graphics having a contour being the same in color and shape as the hollow graphics is written, to permit movement of a solid game piece or a hollow game piece to an intersection point being nearest to a position where successively arranged all game pieces in the moving direction are jumped over or another intersection point on which another game piece being able to be united with existing in the successively arranged game pieces and to judges propriety of moving the solid game piece or the hollow game piece to an intersection point of the game board, a game piece reversal permitting unit to permit the reversal of the solid game piece or hollow game piece to which a movement permission is given according to operations of the inputting device in the case when the movement is permitted by the game piece movement permitting unit, a game piece uniting judging unit to judge, when the movement is permitted by the game piece movement permitting unit, whether the solid game piece or hollow game piece to which movement is permitted according to the inputting device has moved and united with other game piece, an intersected line number calculating unit, to calculate, when the solid game piece or the hollow game piece is judged to have been united with other game piece by the game piece uniting judging unit, the number of intersected lines at an intersected point on which a united game piece is put on, a double uniting judging unit to judge existence or non-existence of double uniting occurring at the same time of uniting between graphics including uniting of the solid graphics written on the solid game piece and hollow game piece with the hollow graphics, a score summing-up unit to calculate obtained scores of each game piece to sum up a total score of game pieces having each color based on the number of intersected lines calculated by the intersected line number calculating unit in a manner in which the obtained score is made higher compared with the case where double uniting is judged as no existence by the double uniting judging unit and based on the existence or non-existence of double uniting judged by the double uniting judging unit in the case where double uniting is judged to exist by the double uniting judging unit, and a fighting result judging unit to certify, as a winner, a game player selected a game piece having a color wherein a total score of the game piece summed up by the obtained score summing-up unit first reaches a predetermined minimum obtained score.

According to a second aspect of the present invention, there is provided an electronic game machine comprising a CPU, a storing device, a display, and an inputting device, wherein the CPU functions as: a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score, a game piece deploy controlling unit to initially deploy game pieces each having a color being different for every game player wherein the game pieces each having a color out of two colors which is so devised that different combinations of graphics can be written on a plurality of and a same number of both front and rear surfaces on the intersection point displayed on the display by the game board displaying unit according to operations of the inputting device based on data stored in the storing device and wherein the game piece comprises a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different solid graphics is written in writing space on the front side, a solid graphics having a contour being different from the hollow graphics on the front side, out of the hollow graphics having a contour with a same shape with each of the solid graphics is written in writing space on the rear side of each solid game piece having a color and wherein, on hollow game pieces each having one of two colors, a different hollow graphic is written in writing space on the front side of the hollow game piece and a solid graphic having a contour different from a hollow graphics on the rear side out of solid graphics each having a same shape as each of the hollow graphics on the rear side of the hollow game pieces and wherein a hollow graphics being able to be united with the solid graphic written on the solid game piece is written on the hollow game pieces and a solid graphic being able to be united with a hollow graphics written on the solid game pieces and a solid graphics being able to be united with a hollow graphics written on the solid game piece is written on the hollow game pieces and wherein doubly uniting is made possible which includes uniting between game pieces, one being a game piece on which the hollow graphics or the solid graphics is written and the other being a game piece on which a solid graphics or a hollow graphics having a contour with a same color and same shape with the other game piece is written and the uniting between graphics, one being the solid graphics written on the solid game piece or hollow game piece and the other being a hollow graphics written on the hollow game piece or the solid game piece, a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united having the solid graphics written on the solid game piece or hollow game piece to be moved or the hollow graphics or solid graphics having a contour being the same in color and shape as the hollow graphics is written, to permit movement of a solid game piece or a hollow game piece to an intersection point being nearest to a position where successively arranged all game pieces in the moving direction are jumped over or another intersection point on which another game piece being able to be united with existing in the successively arranged game pieces and to judges propriety of moving the solid game piece or the hollow game piece to an intersection point of the game board, a game piece reversal permitting unit to permit the reversal of the solid game piece or hollow game piece to which a movement permission is given according to operations of the inputting device in the case when the movement is permitted by the game piece movement permitting unit, a game piece uniting judging unit to judge, when the movement is permitted by the game piece movement permitting unit, whether the solid game piece or hollow game piece to which movement is permitted according to the inputting device has moved and united with other game piece, an intersected line number calculating unit to calculate, when the solid game piece or the hollow game piece is judged to have been united with other game piece by the game piece uniting judging unit, the number of intersected lines at an intersected point on which a united game piece is put on, a double uniting judging unit to judge existence or non-existence of double uniting occurring at the same time of uniting between graphics including uniting of the solid graphics written on the solid game piece and hollow game piece with the hollow graphics, a score summing-up unit to calculate obtained scores of each game piece to sum up a total score of game pieces having each color based on the number of intersected lines calculated by the intersected line number calculating unit in a manner in which the obtained score is made higher compared with the case where double uniting is judged as no existence by the double uniting judging unit and based on the existence or non-existence of double uniting judged by the double uniting judging unit in the case where double uniting is judged to exist by the double uniting judging unit, and a fighting result judging unit to certify, as a winner, a game player selected a game piece having a color wherein a total score of the game piece summed up by the obtained score summing-up unit first reaches a predetermined minimum obtained score.

According to a third aspect of the present invention, there is provided the electronic game machine wherein the double uniting judging unit, when judging that the double uniting has occurred, further judges whether or not, double uniting in the solid game piece and the hollow game piece has occurred in a state where the solid game piece and hollow game pieces have reversed to their rear sides, and the score summing-up unit calculates obtained scores so that the obtained score is made higher compared with the case where double uniting in the solid game piece and hollow game piece has occurred in a state where the solid and hollow game pieces have not reversed to their rear sides and then sums up a total score of each game piece with each color.

According to a fourth aspect of the present invention, there is provided the electronic game machine wherein, instead of the certification of a winner of a game performed by the fighting result judging unit stated above, when a score of a game piece having a color selected by a first mover first reaches the minimum obtained score compared with the case where a score of a game piece having a color selected by a second mover reaches, at the time when a game piece having the color selected by the second mover is moved once, the game comes to an end and the game player having bigger scores is certified as a winner and when a score of a game piece having the color selected by a second mover first reaches the minimum obtained score compared with the case where a score of a game piece having a color selected by a first mover reaches, the game comes to an end and the second mover is certified as a winner.

According to a fifth aspect of the present invention, there is provided the electronic game machine wherein the game board displaying unit displays the game board on which, by intersection between 5 ruled lines formed vertically and horizontally and 7 ruled lines formed in left-slanted and right-slanted directions, a total of 14 pieces of intersected points is formed which includes 4 pieces of intersected points at which 4 ruled lines intersect, 16 pieces of intersection points at which 4 ruled line intersect, 12 pieces of intersection points at which 5 ruled lines intersect, and 9 pieces of ruled lines at which 8 ruled lines intersect, on a display, and wherein the game piece deploy controlling unit deploys 7 pieces for each of solid game pieces and hollow game pieces each having each color being 28 game pieces in total and initially deploys game pieces on first to third columns on one game player side and on seventh to ninth columns on the other game player side.

According to a sixth aspect of the present invention, there is provided a program for an electronic game machine having a CPU, a storing device, a display, and an inputting device to make the CPU function as: a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score, a game piece deploy controlling unit to initially deploy game pieces each having a color being different for every game player wherein game pieces each having any one of two colors, are devised so that different combinations of graphics are able to be written on a plurality of and same number of both front and rear sides of each of game pieces at an intersection point on the game board displayed on the display by the game board displaying unit based on data stored in the storing device according to operations of the inputting device, wherein the game piece comprises a combination of a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different hollow graphics is written in writing space on the front side, a solid graphics having a contour being different from the hollow graphics on the front side, out of the solid graphics having a contour with a same shape with each of the hollow graphics is written in writing space on the rear side of each solid game piece having a color and wherein, on hollow game pieces each having one of two colors, a different solid graphic is written in writing space on the front side of the hollow game piece and a hollow graphic having a contour different from a solid graphics on the front side out of hollow graphics each having a same shape as each of the solid graphics on the rear side of the hollow game pieces and wherein a hollow graphics being able to be united with the solid graphic written on the solid game piece is written on the hollow game pieces and a solid graphic being able to be united with a solid graphics written on the solid game pieces and a solid graphics being able to be united with a hollow graphics written on the solid game piece is written on the hollow game pieces and wherein doubly uniting is made possible which includes uniting between game pieces, one being a game piece on which the solid graphics or the hollow graphics is written and the other being a game piece on which a hollow graphics or a solid graphics having a contour with a same color and same shape with the other game piece is written and the uniting between graphics, one being the solid graphics written on the solid game piece or hollow game piece and the other hollow graphics written on the hollow game piece or the solid game piece, a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united having the solid graphics written on the solid game piece or hollow game piece to be moved or the hollow graphics or solid graphics having a contour being the same in color and shape as the hollow graphics is written, to permit the movement of a solid game piece or a hollow game piece to an intersection point being nearest to a position where successively arranged all game pieces in the moving direction are jumped over or another intersection point on which another game piece being able to be united with existing in the successively arranged game pieces and to judges propriety of moving the solid game piece or the hollow game piece to an intersection point of the game board, a game piece reversal permitting unit to permit the reversal of the solid game piece or hollow game piece to which a movement permission is given according to operations of the inputting device in the case when the movement is permitted by the game piece movement permitting unit, a game piece uniting judging unit to judge, when the movement is permitted by the game piece movement permitting unit, whether the solid game piece or hollow game piece to which movement is permitted according to the inputting device has moved and united with other game piece, an intersected line number calculating unit, to calculate, when the solid game piece or the hollow game piece is judged to have been united with other game piece by the game piece uniting judging unit, the number of intersected lines at an intersected point on which a united game piece is put on, a double uniting judging unit to judge existence or non-existence of double uniting occurring at the same time of uniting between graphics including uniting of the solid graphics written on the solid game piece and hollow game piece with the hollow graphics, a score summing-up unit to calculate obtained scores of each game piece to sum up a total score of game pieces having each color based on the number of intersected lines calculated by the intersected line number calculating unit in a manner in which the obtained score is made higher compared with the case where double uniting is judged as no existence by the double uniting judging unit and based on the existence or non-existence of double uniting judged by the double uniting judging unit in the case where double uniting is judged to exist by the double uniting judging unit, and a fighting result judging unit to certify, as a winner, a game player selected a game piece having a color wherein a total score of the game piece summed up by the obtained score summing-up unit first reaches a predetermined minimum obtained score.

According to a seventh aspect of the present invention, there is provided a program for an electronic game machine having a CPU, a storing device, a display, and an inputting device to make the CPU function as: a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score, a game piece deploy controlling unit to initially deploy game pieces each having a color being different for every game player wherein the game pieces each having a color out of two colors which is so devised that different combinations of graphics can be written on a plurality of and a same number of both front and rear surfaces on the intersection point displayed on the display by the game board displaying unit according to operations of the inputting device based on data stored in the storing device and wherein the game piece comprises a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different solid graphics is written in writing space on the front side, a solid graphics having a contour being different from the hollow graphics on the front side, out of the hollow graphics having a contour with a same shape with each of the solid graphics is written in writing space on the rear side of each solid game piece having a color and wherein, on hollow game pieces each having one of two colors, a different hollow graphic is written in writing space on the front side of the hollow game piece and a solid graphic having a contour different from a hollow graphics on the rear side out of solid graphics each having a same shape as each of the hollow graphics on the rear side of the hollow game pieces and wherein a hollow graphics being able to be united with the solid graphic written on the solid game piece is written on the hollow game pieces and a solid graphic being able to be united with a hollow graphics written on the solid game pieces and a solid graphics being able to be united with a hollow graphics written on the solid game piece is written on the hollow game pieces and wherein doubly uniting is made possible which includes uniting between game pieces, one being a game piece on which the hollow graphics or the solid graphics is written and the other being a game piece on which a solid graphics or a hollow graphics having a contour with a same color and same shape with the other game piece is written and the uniting between graphics, one being the solid graphics written on the solid game piece or hollow game piece and the other being a hollow graphics written on the hollow game piece or the solid game piece, a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united having the solid graphics written on the solid game piece or hollow game piece to be moved or the hollow graphics or solid graphics having a contour being the same in color and shape as the hollow graphics is written, to permit movement of a solid game piece or a hollow game piece to an intersection point being nearest to a position where successively arranged all game pieces in the moving direction are jumped over or another intersection point on which another game piece being able to be united with existing in the successively arranged game pieces and to judges propriety of moving the solid game piece or the hollow game piece to an intersection point of the game board, a game piece reversal permitting unit to permit the reversal of the solid game piece or hollow game piece to which a movement permission is given according to operations of the inputting device in the case when the movement is permitted by the game piece movement permitting unit, a game piece uniting judging unit to judge, when the movement is permitted by the game piece movement permitting unit, whether the solid game piece or hollow game piece to which movement is permitted according to the inputting device has moved and united with other game piece, an intersected line number calculating unit to calculate, when the solid game piece or the hollow game piece is judged to have been united with other game piece by the game piece uniting judging unit, the number of intersected lines at an intersected point on which a united game piece is put on, a double uniting judging unit to judge existence or non-existence of double uniting occurring at the same time of uniting between graphics including uniting of the solid graphics written on the solid game piece and hollow game piece with the hollow graphics, a score summing-up unit to calculate obtained scores of each game piece to sum up a total score of game pieces having each color based on the number of intersected lines calculated by the intersected line number calculating unit in a manner in which the obtained score is made higher compared with the case where double uniting is judged as no existence by the double uniting judging unit and based on the existence or non-existence of double uniting judged by the double uniting judging unit in the case where double uniting is judged to exist by the double uniting judging unit, and a fighting result judging unit to certify, as a winner, a game player selected a game piece having a color wherein a total score of the game piece summed up by the obtained score summing-up unit first reaches a predetermined minimum obtained score.

By configuring as above, various effects can be obtained including an effect of providing a very noble and progressive new-type game which improves elegance and tastefulness of a game and spreading the game widely to increase opportunities of communication of people and to improve cultural levels.

BRIEF DESCRIPTION OF THE DRAWINGS

FIG. 4 is a table of all the solid game pieces and hollow game pieces to be used in the electronic game of the embodiment of the present invention.

FIG. 7 is a diagram showing a method of calculating combinations of united game pieces of the solid game pieces and hollow game pieces of the game equipment and obtained scores of the united game pieces of the embodiment of the present invention.

DESCRIPTION OF THE PREFERRED EMBODIMENTS

Figure 1:
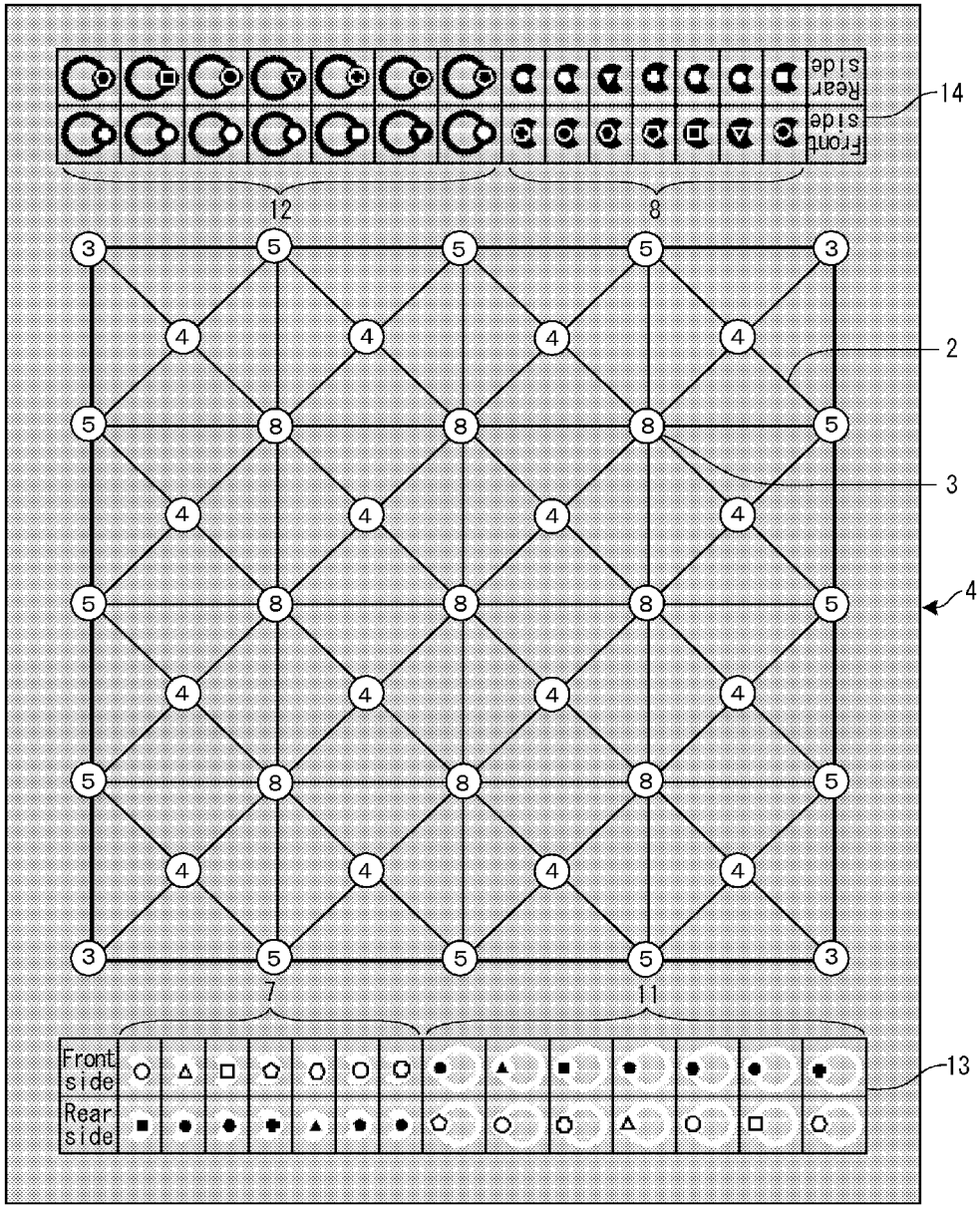
FIG. 1 is a plan view showing a game board of the play equipment to be used in an electronic game of the embodiment of the present invention.
Figure 2:
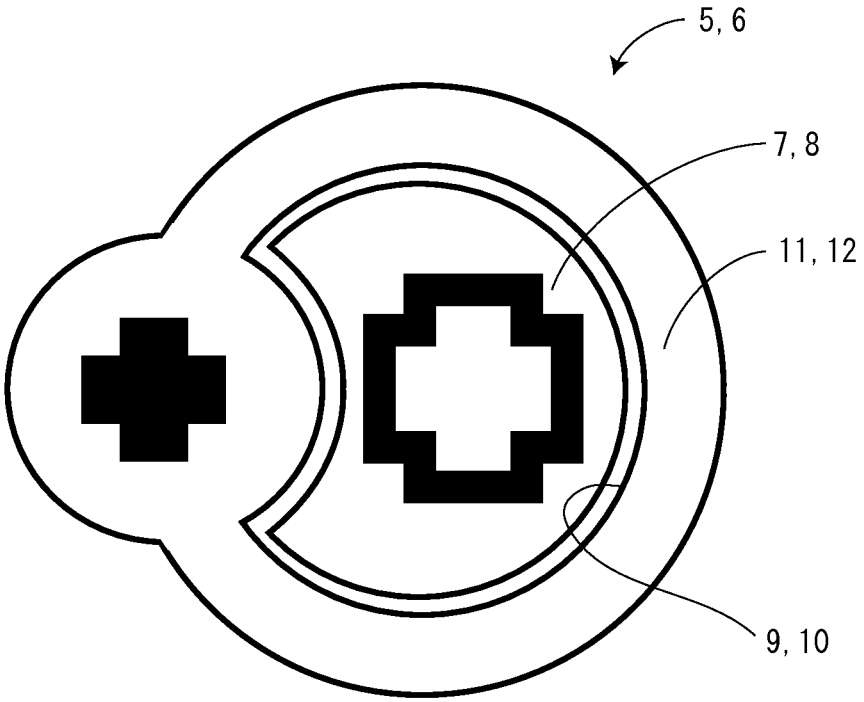
FIG. 2 is a game piece of the play equipment to be used in the electronic game of the embodiment of the present invention.
Figure 3A:
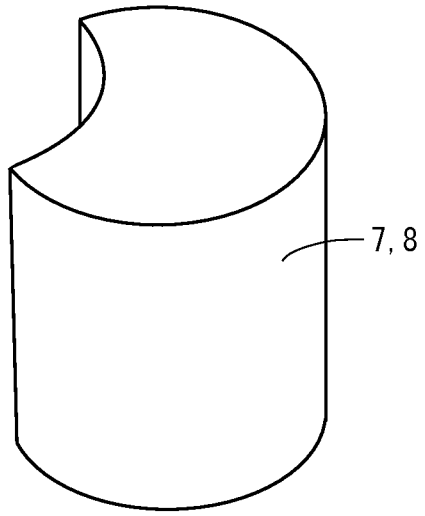
FIG. 3A is a perspective view of a solid game piece of the play equipment to be used in the electronic game of the embodiment of the present invention and FIG. 3B is a perspective view of a hollow game piece of the play equipment to be used in the electronic game of the embodiment of the present invention.
Figure 3B:
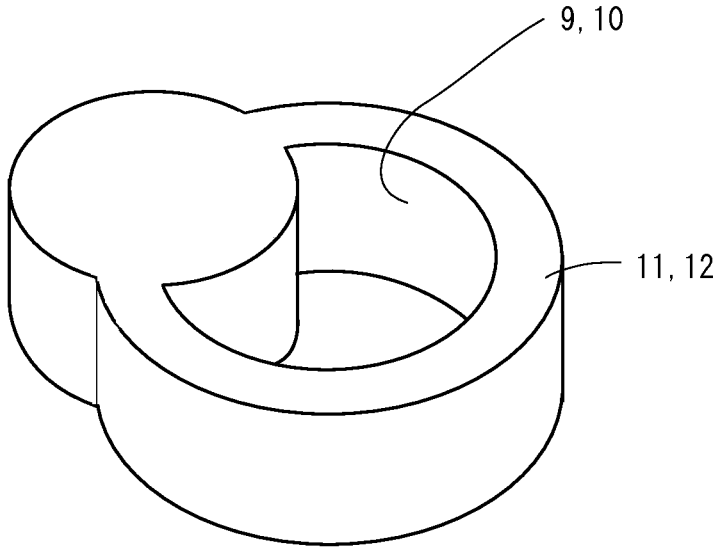
Figure 5:
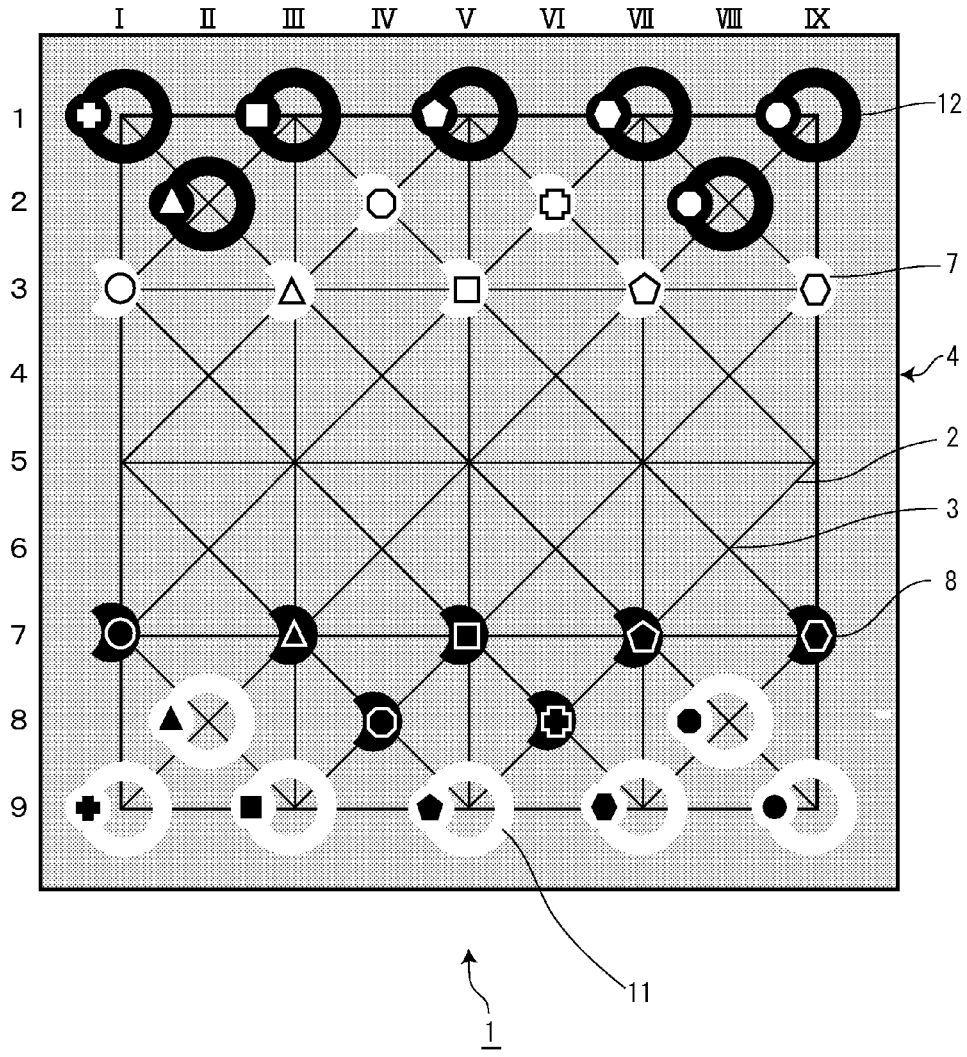
FIG. 5 is a diagram showing a state where each game piece is initially deployed on the game board of the play equipment to be used in the electronic game of the embodiment of the present invention.
Figure 6:
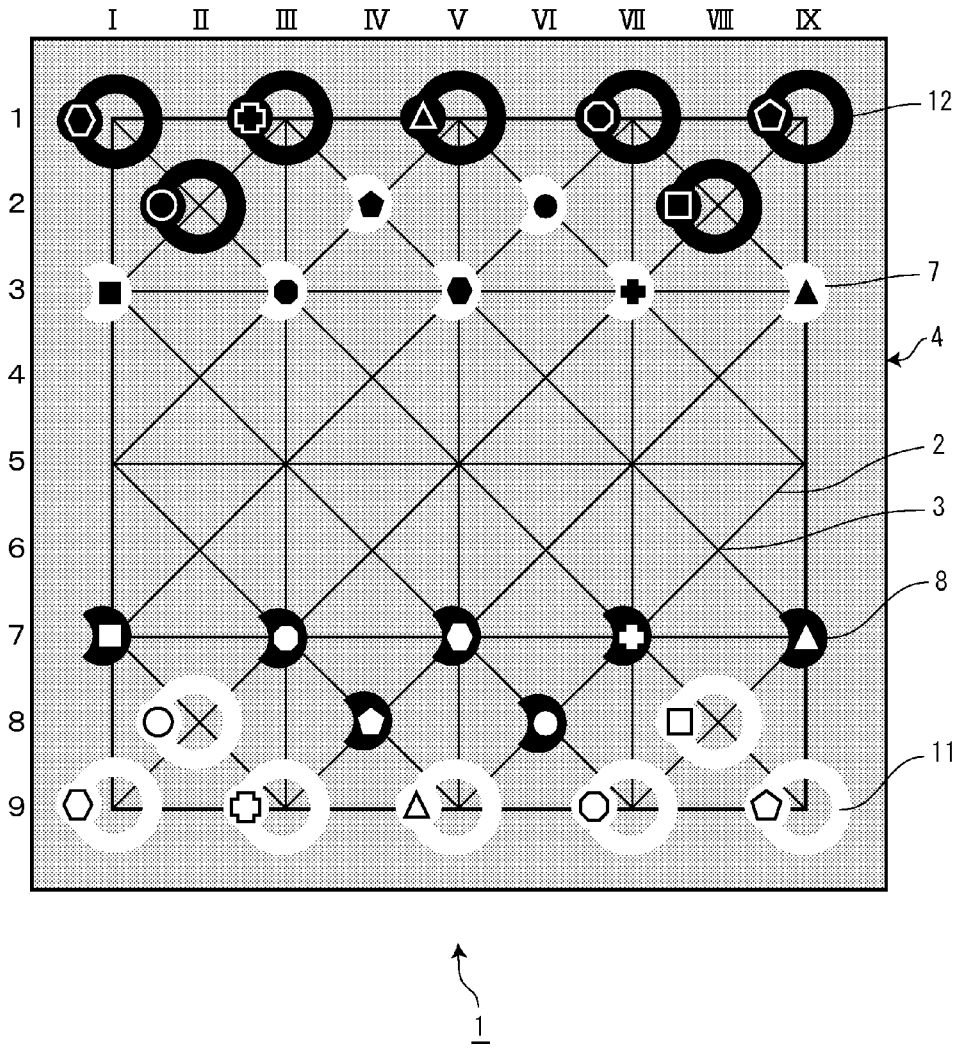
FIG. 6 is a diagram showing a state where each game piece is initially deployed, in a manner to be reversed thereto, on the game board of the play equipment to be used in the electronic game of the embodiment of the present invention.

Hereinafter, by referring to drawings, play equipment to be used in an electronic game and rules to be applied to the game of the embodiment of the present invention are described. FIG. 1 is a plan view showing a game board of the play equipment to be used in the electronic game of the embodiment of the present invention. FIG. 2 is a plan view showing a game piece of the play equipment to be used in the electronic game of the embodiment of the present invention. FIG. 3A is a perspective view of a solid game piece of the play equipment to be used in the electronic game of the embodiment of the present invention and FIG. 3B is a perspective view of a hollow game piece of the play equipment to be used in the electronic game of the embodiment of the present invention. FIG. 4 is a table of all the solid game pieces and hollow game pieces to be used in the electronic game of the embodiment of the present invention. FIG. 5 is a diagram showing a state where each game piece is initially deployed on the game board of the play equipment to be used in the electronic game of the embodiment of the present invention. FIG. 6 is a diagram showing a state where each game piece is initially deployed, in a manner to be reversed, on the game board of the play equipment to be used in the electronic game of the embodiment of the present invention. FIG. 7 is a diagram showing a method of calculating combinations of united game pieces of the solid game pieces and hollow game pieces of the game equipment and obtained scores of the united game pieces of the embodiment of the present invention. Moreover, in the succeeding descriptions, the description is made centering on all the plan views and no special descriptions about contents in FIGS. 3A and 3B is made, however, in the electronic game of the embodiments of the present invention, the game played in 3D (three dimension) technique and in a characterized form is under development and, as reference information, the perspective view of the solid game piece is shown in FIG. 3A and that of the hollow piece is shown also in FIG. 3B.

The play game 1 to be used in the electronic game machine of the embodiment of the present invention comprises a game board 4 on which a plurality of intersection points 3 are formed at which vertical and horizontal rules lines 2 and right-slanted and left-slanted ruled lines 2 intersect and a plurality of game pieces of two colors each having a same number and a different color including white game pieces 5 and black game pieces 6.

As shown in FIG. 1, the game board 4 is of a rectangular shape and, at a central portion of the game board 4, five ruled lines 2 are formed in each of a vertical direction and of a horizontal direction and seven ruled lines 2 are formed in each of a right-slanted direction and a left-slanted direction, four intersection points 3 are formed at which three ruled lines 2 intersect, sixteen intersection points 3 are formed at which three ruled lines 2 intersect, twelve intersection points 3 are formed at which five ruled lines 2 intersect, and nine intersection points 3 are formed at which eight ruled lines intersect and, on each intersection point 3, a basic score representing the number of the ruled lines 2 which intersect thereon is written.

As shown in FIG. 2, each of the game pieces 5 and 6 having each color is a two color game piece devised so that a combination of a plurality of graphics having a same number can be written on both the front and rear sides and the combination is made up of seven solid game pieces 7 and 8 each having a same shape whose circle is partially missing and 8 and seven hollow game pieces 11 and 12 each having a same shape which has a hole into which each of the hollow game piece 7 and 8 with a same color can be fitted and each of the solid game pieces 7 and 8 and each of the hollow game pieces 11 and 12 are able to be reversed from a front side to a rear side and vice versa and to be united under specified conditions.

As shown well in FIG. 4, on a front side of each of the solid game pieces 7 and 8 having each color, hollow graphics different from one another are written and on a rear side of each of the solid game pieces 7 and 8, solid graphics having a contour being different from the hollow graphics written on the front side out of solid graphics having the same shape as each of the hollow graphics are written. More specifically, for example, on a front side of a white first solid game piece 7, a circular hollow graphics is written and, on a rear side of the first solid game piece 7, a quadrangular solid graphics having a contour being different from the hollow graphics written on the front side is written.

In the hollow game pieces 11 and 12 having each color, as in the case of the above-mentioned solid game pieces 7 and 8 having each color, on a front side of one side of the holes 9 and 11, solid graphics each being different from one another is written and, on its rear side, a hollow graphics having a contour different from the solid graphics written on the front side out of the hollow graphics having the contour with the same shape as each of the solid graphics is written. More specifically, on a front side of a white first hollow game piece 11, a circular solid graphic is written and, on a rear side of the first hollow game piece 11, a pentagonal hollow graphics having a contour different from the solid graphics written on the front side is written.

By configuring as above, in the game pieces 5 and 6 having each color, double uniting is made possible in which one game piece on which the solid graphics or hollow graphics is written and another game piece on which hollow graphics or solid graphics having a contour with a same color and a same shape as the one game piece is written can be united therewith and both the solid graphics and hollow graphics can be united therewith.

As shown in FIG. 7, in the case of a game piece (hereinafter, referred to as "solid united game piece" for convenience) obtained by uniting the solid game pieces 7 and 8 on which the solid graphics is written with its rear side being in a reversed state with the hollow game pieces 11 and 12 on a front side of which the solid graphics are written having a contour with the same color and shape as the solid game pieces 7 and 8, an obtained score of the united game piece by game piece type is calculated as the number of intersected lines at the intersection point 3 where the united game piece exist and, further, in the case of a game piece (hereinafter, referred to as "hollow united game piece" for convenience) obtained by uniting the solid game pieces 7 and 8 on a surface side of which a hollow graphics is written with the hollow game pieces 11 and 12 on which a hollow graphics is written having a contour with the same color and shape as the solid game pieces 7 and 8, an obtained score of the united game piece by game piece type is calculated as the number of intersected lines at the intersection point 3 where the united game piece exist and +2 score points and, moreover, in the case of a game piece (hereinafter referred to as a "semi doubly united game piece" for convenience) obtained by doubly uniting the solid game pieces 7 and 8 on a front side of which the hollow graphics are written with the hollow game pieces 11 and 12 on a front side of which a solid graphic having a contour with the same color and same shape as the solid game pieces 7 and 8 are written, an obtained score of the united game piece is calculated as the number of intersected lines at the intersection point 3 where the united game piece exist and ×2 score points and still further in the case of a game piece (hereinafter referred to as a "regular doubly united game piece" for convenience) obtained by uniting the solid game pieces 7 and 8 where the rear side having the solid graphic is reversed with the hollow game piece 11 and 12 where the rear side having a hollow graphic with the same color and shape as the solid game pieces 7 and 8 is reversed, an obtained score of the united game piece is calculated as the number of intersected lines at the intersection point 3 where the united game piece exist and ×2+5 score points.

For example, when a game player having selected a white game piece 5 as a first mover first obtains a score exceeding the minimum obtained score, another game player having selected a black game piece 6 as a second mover is allowed to move his/her game piece only once more, and the game player having selected a game piece having a color which has obtained a total score becomes a winner of the game. Moreover, when the game player having selected a white game piece 6 first obtains a score exceeding the minimum obtained score, the game comes to an end and the second mover having selected the black game piece 6 becomes a winner of the game.

As a result of having moved a game piece in accordance with such a rule as described above, when either of the game players obtains a score exceeding a minimum obtained score (for example, being set to 100 scores), the game comes to an end, and an obtained score of each game piece is calculated according to the method of calculation of obtained scores by kinds of the united game piece shown in FIG. 7 and a game player having selected a game piece with a color having obtained a total score exceeding the obtained minimum obtained scores is certified as a winner of the game. Moreover, a correspondence table 13 representing a combination of a hollow graphics or solid graphics written on a surface side of the white solid game piece 7 and hollow game piece 11 and a combination of a solid graphics or hollow graphics written on a rear side of the white solid game piece 7 and hollow game piece 11 and a correspondence table 14 representing a combination of a hollow graphics or solid graphics written on a surface side of the black solid game piece 8 and hollow game piece 12 and a solid graphics or hollow graphics written on a rear side of the black solid game piece 8 and 12 are provided so as to be displayed in a position to face each other with portions describing the ruled line 2 interposed therebetween in a manner to enable easy visual identification by each game player.

Further, the number of ruled lines 2 on the game board 4 and the number of intersection points 3 are not limited to the number described above and may be changed in various ways and the game board 4 may be formed so as to be foldable and to be rounded, which further improves the portability which enables easy carrying to a journey destination. The number, shape, color of game pieces 5 and 6 each having any one of two colors and the combination of the hollow graphics or solid graphics written on a surface side and the combination of the solid graphics or hollow graphics written on a rear side are not limited to that described above. So long as the solid game pieces 7 and 8 are configured to be combined with the hollow game pieces 11 and 12 wherein the solid game pieces 7 and 8 each having any one of two colors are configured so that, on its surface side, solid graphics each being different from one another are described and, on its rear side, hollow graphics having a contour different from the solid graphics written on the surface side, out of the hollow graphics having a contour with the same shape as each of the solid graphics are written and the hollow game pieces 11 and 12 each having any one of two colors are configured so that, on its surface side, hollow graphics different from one another are written and, on its rear side, the solid graphics having a contour different from the hollow graphics written on the surface side are written and, on its rear side, the solid graphics having a contour different from the hollow graphics written on the surface side out of the solid graphics having a contour with the same shape as each of the hollow graphics are written and thus doubly uniting is made possible wherein one game piece on which the hollow graphics or the solid graphics is written can be united with another game piece on which the solid graphics or hollow graphics having a contour with the same color and same shape as the one game piece and the solid graphics is united with the hollow graphics.

Figure 8:
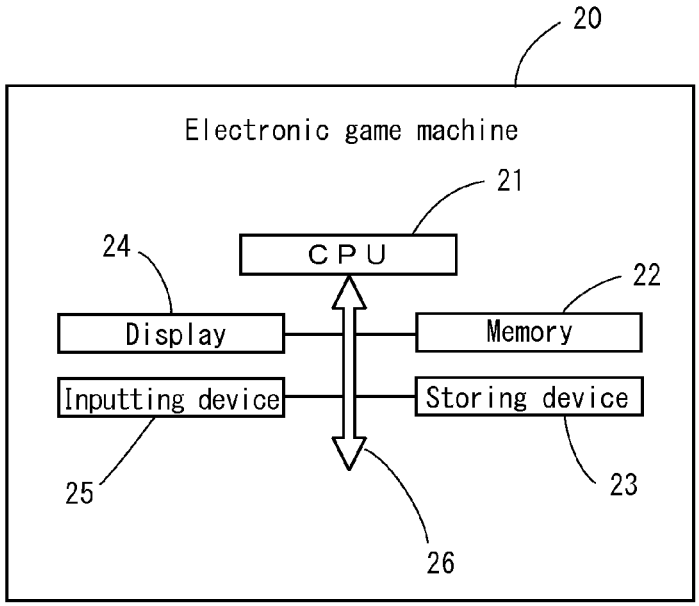
FIG. 8 is a block diagram showing configurations of hardware for the electronic game machine of the embodiment of the present invention.
Figure 9:
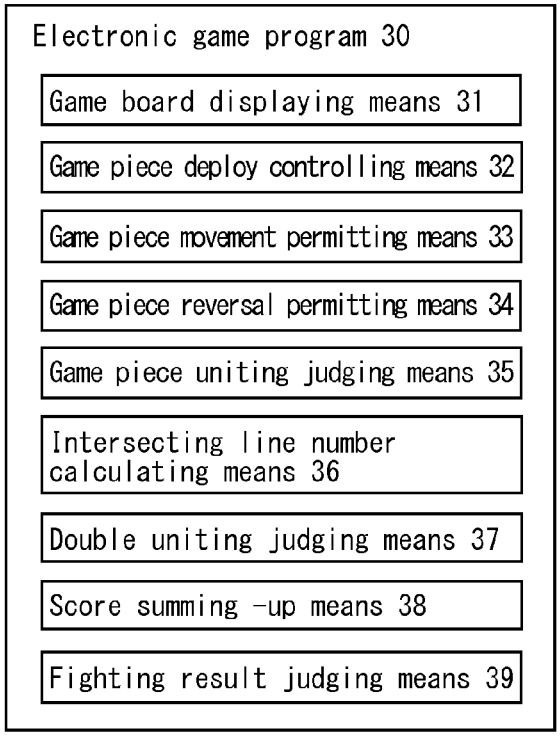
FIG. 9 is a functional block diagram showing configurations of hardware for the electronic game machine of the embodiment of the present invention.

Next, with reference to FIGS. 8 and 9, in addition to FIG. 1 to FIG. 7, configurations to realize a game using the play equipment by the electronic game machine are described below. FIG. 8 is a block diagram showing configurations of hardware for the electronic game machine of the embodiment of the present invention. FIG. 9 is a functional block diagram showing configurations of hardware for the electronic game machine of the embodiment of the present invention.

The electronic game machine 20 of the embodiment of the present invention comprises, as shown in FIG. 8, a CPU (Central Processing Unit) 21 to control each component making up the electronic game machine 20, a memory 22 to temporarily save programs performed by the CPU 21 and various data, a storing device 23 such as a hard disk and the like to store programs performed by the CPU 21 and various data, a display 24 such as a liquid crystal display and the like, and an inputting device 25 such as a joystick, cross-key, and the like, all of which are connected to one another through a bus 26. The electronic game machine 20 can be connected to a game dedicated machine, a computer such as a personal computer, or mobile terminals such as a mobile phone and game players can fight with one another as opponents by letting the CPU 21 perform electronic game programs installed in the storing device 23 such as hard disks or the like and play equipment 1 displayed on the display 24.

The electronic program 30 includes, as shown in FIG. 9, a game board displaying means 31 to display the game board on the display 24, a game piece deploy controlling means 32 to initially deploy the solid game pieces 7 and 8 and the hollow game pieces 11 and 12 each having any of two colors on the intersection point 3 of the game board 4 displayed on the display 24 by the game board displaying means 31, a game piece movement permitting means 33 to judge whether the solid game pieces 7 and 8 and hollow game pieces 11 and 12 are allowed to move to the intersection point 3 of the game board 4, a game piece reversal permitting means 34 to permit the solid game pieces 7 and 8 or hollow game pieces 11 and 12 to be reversed when the movement is allowed by the game piece movement permitting means 33, a game piece uniting judging means 35 to judge as to whether the solid game pieces 7 and 8 or the hollow game pieces 11 and 12 have moved and united with another game piece, an intersecting line number calculating means 36 to calculate the number of intersecting lines at the intersection point 3 on which the united game piece is judged to have occurred, by the game piece uniting judging means 35, when the solid game pieces 7 and 8 or the hollow game pieces 11 and 12 have united with other game pieces by the game piece uniting judging means 35, a double uniting judging means 37 to judge as to whether a double uniting wherein uniting between the solid graphics and hollow graphics described on the solid game pieces 7 and 8 and hollow game pieces 11 and 12 has occurred when it is judged that the solid game pieces 7 and 8 or hollow game pieces 11 and 12 have been united with other game pieces, a score summing-up means 38 to calculate obtained scores of each game piece and to sum up a total score of each game piece having each color based on the number of intersecting lines calculated by the intersecting line number calculating means 36 so that, when it is judged by the double uniting judging means 37 that the double uniting has occurred, the obtained scores are increased more compared with the case where the double uniting has not occurred by the double uniting judging means 37 and based on existence or non-existence of the double uniting judged by the double uniting judging means 37, and a fighting result judging means 39 to certify a game player as a winner who has selected the game piece having a color wherein a score of the game piece having the color has reached the minimum obtained score in which a total score summed up by the score summing-up means 38 is preset.

Then, the game piece deploy controlling means 32 operates so as to initially deploy the solid game pieces 7 and 8 and the hollow game pieces 11 and 12 on the first to third column on one game player side of the game board 4 and on the seventh to nine-th column on another game player side of the game board 4.

Moreover, the game piece movement permitting means 33 operates so as to permit, if no game piece is put on a next intersection point 3 in the direction in which the game player is going to make the game piece move, the solid game pieces 7 and 8 or hollow game pieces 11 and 12 to move to the next intersection point 3 and, when the solid game pieces 7 and 8 or hollow game pieces 11 and 12 are put in the direction in which the game player is going to make the game piece move, only when the intersection point 3 on which no game piece is put in the above direction exists or another game piece being able to be united exists on which the solid graphics written on the solid game pieces 7 and 8 or hollow game pieces 11 and 12 or the hollow graphics having a contour with the same color and same shape as the hollow game piece or the solid graphics are written, allows the solid game pieces 7 and 8 or hollow game pieces 11 and 12 to jump over the solid game pieces 7 and 8 or hollow game pieces 11 and 12 being put on the above intersection point 3 to move or unite.

The double uniting judging means 37, when it is judged that double uniting exists, further judge as whether each of the solid game pieces 7 and 8 and hollow game pieces 11 and 12 has been doubly united in a state in which each game piece is reversed on the rear side and the score summing-up means 38, when the double uniting judging means 37 judges that the solid game pieces 7 and 8 and hollow game pieces 11 and 12 are doubly united in a state in which it is judged that each game piece is reversed on the rear side, calculates obtained scores of each game piece so that the obtained score becomes larger compared with the case in which it is judged that the solid game pieces 7 and 8 and hollow game pieces 11 and 12 are doubly united in a state in which each game piece is not reversed on the rear side and sums up a total score of each piece having each color.

The fighting result judging means 39, when a score of the game piece having the color selected by a first mover game player reaches the minimum obtained score earlier than a game piece having a color selected by a second mover game player, at the time when the game piece of the color selected by the second mover game player is moved once, operates so as to finish the game and certify the game player having obtained bigger total scores as a winner and, if a score of a game piece having a color selected by the second mover game player reaches the minimum obtained score earlier than a game piece having the color selected by the first mover game player, operates to finish the game at that time and to certify the second mover game player as a winner.

Further, though not shown in drawings, the electronic game program 30, in addition to the above means, may have a fighting level setting means to set a training level of an imaginary game player introduced in the electronic game program 30, a handicap setting means to provide conditions advantageous to any one of the game players, and an operating time controlling means to limit operating time of game pieces 5 and 6 to be operated by a game player per one time.

Various ways to play the electronic game of the present invention include a way in which one display 24 is shared between two game player to play a game, a way in which one human game player and an imaginary game player (hereinafter, an imaginary game player introduced in the program is included in a "game player") produced in the program 30 play a game using one display 24, a way in which two neighboring players play a game using two displays 24, a way in which game players existing in remote places play a game using two displays connected through a communication network and, thus, by an operation from an inputting device, a game player can select any of the ways to play a game.

Next, by referring to drawings, the way of playing a game using the electronic game machine 20 of the embodiment of the present invention is described according to one simulation game. In drawings, in order to show vertical and horizontal positions at the intersection points 3, on the game board 4, Arabic numerals are shown, for convenience, in a vertical direction and Roman numerals are shown in a horizontal direction, however, it not always necessary that these numerals are written on the game board.

First, when a game player performs predetermined operations through the inputting device 25 to designate a first mover game player to select a white game piece 5 and a second mover game player to select a black game piece 6, as shown in FIG. 1, the game board 4 is displayed by the game board displaying means 31 and solid game pieces 7 and 8 and hollow game pieces 11 and 12 each having any one of two colors are initially deployed on each intersection point 3 on the game board 4 for setting a state of starting the game.

Thus, in ordinary cases, each game piece with its surface side being faced upward (semi-solid game piece and semi-hollow game piece) is initially upward to play a game which enables a high level strategy and/or high level game evolution to be enjoyed, however, when game players being kids, aged, or those being not accustomed to playing game fight with one another, as shown in FIG. 6, each game piece with its rear side being upward (regular solid game piece and regular hollow game piece) is initially upward to play a game which enables contents of games to be simplified.

At this point of time, on the game board 4, five ruled lines 2 formed in vertical and horizontal directions and seven ruled lines 2 formed in right-slanted and left-slanted directions intersect and, therefore, four intersection points 3 at which three rules lines 2 intersect, sixteen intersection points 3 at which four ruled lines 2 intersect, twelve intersection points 3 at which five ruled lines 2 intersect, nine intersection points 3 at which eight ruled lines 2 intersect, that is, forty-one intersection points 3 are formed on nine columns in a vertical direction and on nine columns in a horizontal direction and fourteen intersection points 3 are formed in each of the first to third columns and in each of the seventh to nine-th columns, that is, twenty-eight intersection points 3 in total are formed and further seven solid game pieces 5 and 6 each having any one of two colors and seven hollow game pieces 11 and 12 having any one of two colors are formed, that is, twenty-eight game pieces in total are formed. Therefore, the game piece controlling means 32 can initially deploy the solid game pieces 7 and 8 each having any color out of two colors and hollow game pieces 11 and 12 each having any color out of two colors on the intersection points 3 in the first to third columns on one game player side on the game board 4 and on the intersection points 3 in the seventh to nine-th columns on another game player side in a manner being neither too much nor too little.

In the state of the initial deployment, two game players select a game piece having either of white and black colors, for example, a first mover game player selects a white game piece 5 and a second mover game player selects a black game piece 6 and the first and second movers alternately move, one by one per one time, the solid game pieces 7 and 8 or hollow game pieces 11 and 12 having the color selected by each of the first mover or the second mover along the vertical or horizontal ruled line 2 or along the left-slanted or right-slanted ruled line 2 on each of the intersection points 3.

In this situation, if game pieces are arranged successively in the direction of movements of the solid game pieces 7 and 8 or hollow game pieces 11 and 12 that are intended to be moved, in principle, all the game pieces must be jumped over irrespective of the solid game pieces 7 and 8 and hollow game pieces 11 and 12 and any one of united game pieces, however, exceptionally, if there is a game piece that can be united (game piece in which a graphics having a contour with the same color and same shape is written)in the direction of the game pieces being arranged, uniting of these game pieces is not allowed and, in the case of such game pieces, the solid game pieces can be united with the hollow game pieces 11 and 12 or the hollow game pieces 11 and 12 can be united with the solid game pieces 7 and 8. However, even in this situation, if the game player does not desire the uniting of the game pieces, game pieces that can be united is not allowed to be jumped over.

Even after the uniting of the solid game pieces 7 and 8 and hollow game pieces 11 and 12, each of the solid game pieces 7 and 8 and each of the hollow game pieces 11 and 12 can be moved as the individual game piece, however, the united game pieces cannot be moved in a united state. Moreover, the intersection 3 to which the game pieces move, except the case where any game piece that can be united exists, must be empty and if the intersection 3 is not empty, the movement of the game piece toward the direction is not allowed.

Further, only when a game piece is moved, the game piece can be reversed. When the game piece is reversed, the kind of a graphics is changed and the game piece that can be united changes and a path through which a game piece is moved also changes.

As shown in FIGS. 10 to 15, at the opening in a game, the first mover game player plays a game according to a basic strategy of first occupying the intersection that can provide a high score (8 score points) while the second mover game player, by moving each black game piece to the intersection on the nine-th column, hinders the first mover game player from moving a white hollow game piece to the horizontal direction.

Figure 10:
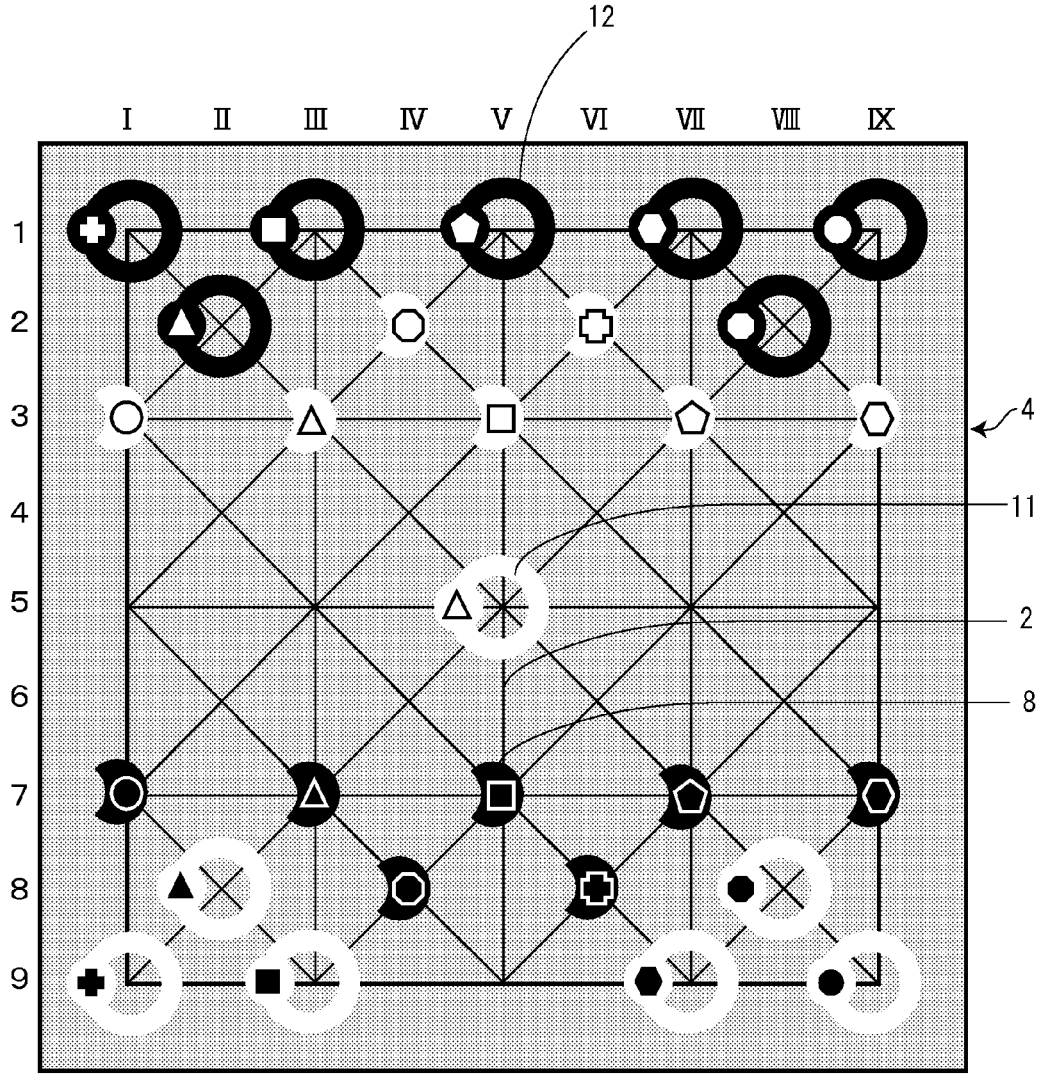
FIG. 10 is a plan view showing a state in which, in one simulation game by the electronic game machine of the embodiment of the present invention, a first mover game player has reversed a hollow game piece having a white pentagonal solid graphics and has moved the game piece as a hollow game piece having a white triangular hollow graphics to an intersection point V5.

More specifically, as shown in FIG. 10, when the first mover game player, in order to first occupy the intersection point 3 providing 8 score points in the center of the game board 4, moves, by using the inputting device 25, the hollow game piece 11 (see FIG. 5) having a white pentagonal solid graphics to the intersection point V5 along the vertical ruled line 2 after jumping over the solid game piece 8 having a black quadrangular hollow graphics and, at the same time, performs a reversing operation, the game piece movement permitting means 33 judges the propriety of movement of the white hollow game piece 11 to the intersection point V5 and the game piece reversal permitting means 34 judges the propriety of reversal of the hollow game piece 11. In this situation , since no game piece having any color is put on the intersection point V5, the game piece movement permitting means 33 permits the movement of the white hollow game piece 11 to the intersection point V5 and further the game piece reversal permitting means 34 allows the reversal of the white hollow game piece 11, thus causing the white hollow game piece 11 to be put as the hollow game piece 11 having the white triangular hollow graphics at the intersection point V5.

Figure 11:
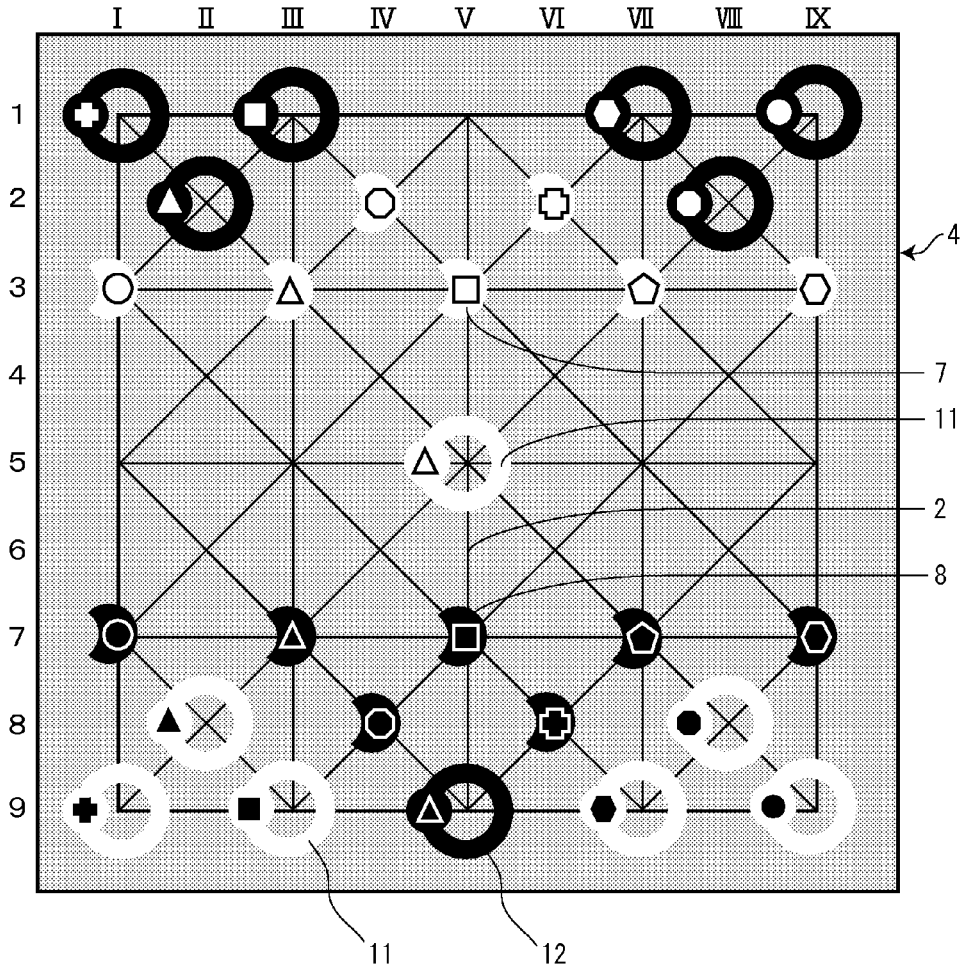
FIG. 11 is a plan view showing a state in which, in one simulation game by the electronic game machine of the embodiment of the present invention, a second mover game player has reversed a hollow game piece having a black pentagonal solid graphics and has moved the game piece as a hollow game piece having a black triangular hollow graphics to an intersection point V9.

Next, as shown in FIG. 11, when the second mover game player, in order to hinder the first mover game player from moving the hollow game piece 11 having the white solid graphics in the horizontal direction and in order to allow the hollow game piece 12 having the black solid graphics to move in the horizontal direction, moves, by using the inputting device 25, the hollow game piece 12 (see FIG. 10) having a black pentagonal solid graphics along the vertical ruled line 2 to the intersection point V9 by letting the successive white solid game pieces 7, white hollow game piece 11, and black solid game piece 8 be jumped over and performs a reversing operation, the game piece movement permitting means 33 judges the propriety of movement of the black hollow game piece 12 to the intersection point V9 and the game piece reversal permitting means 34 judges the propriety of reversal of the black hollow game piece 12. In this situation , since no game piece having any color is put on the intersection point V9, the game piece movement permitting means 33 permits the movement of the black hollow game piece 12 to the intersection point V9 and, further, the game piece reversal permitting means 34 allows the reversal of the black hollow game piece 12 thus causing the black hollow game piece 12 to be put as the hollow game piece 12 having a black triangular hollow graphics at the intersection point V9.

Figure 12:
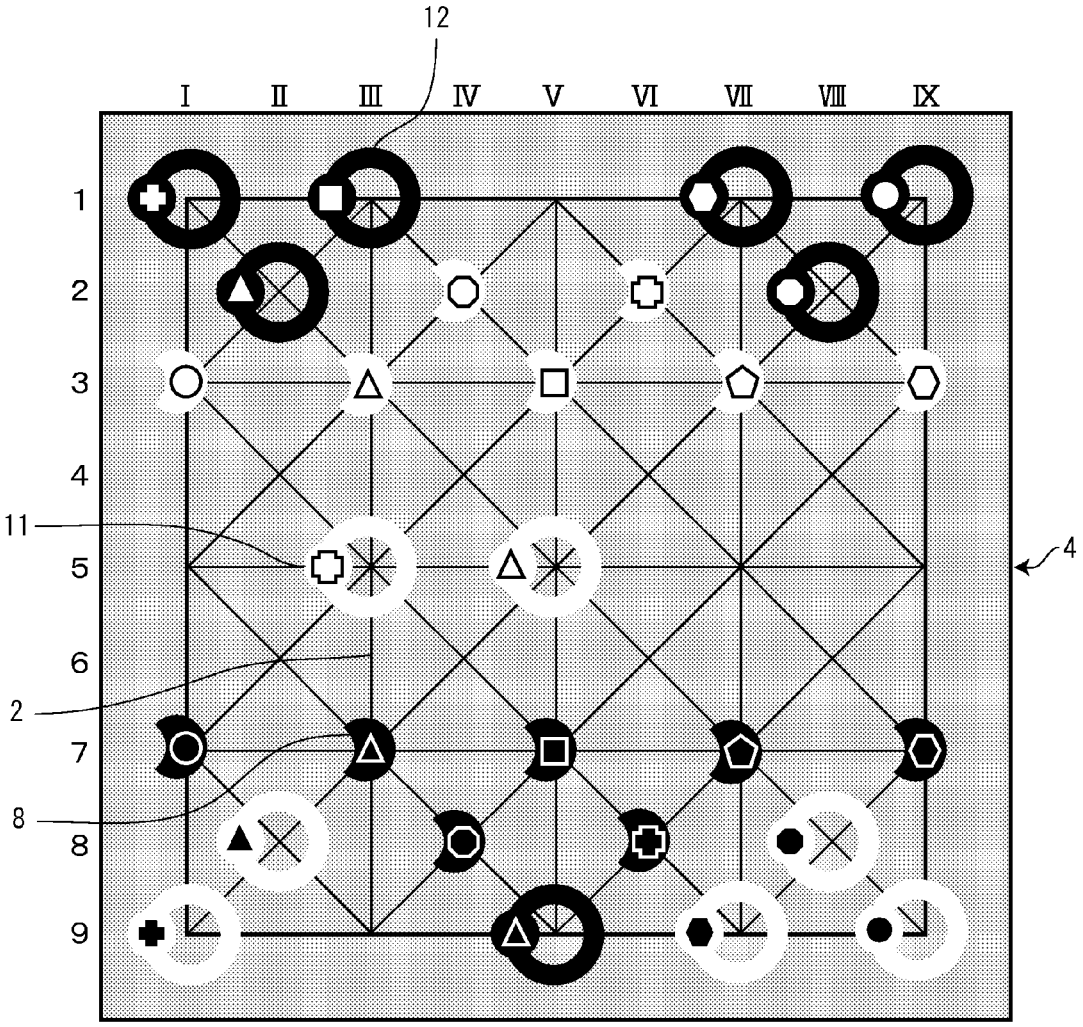
FIG. 12 is a plan view showing a state in which, in one simulation game by the electronic game machine of the embodiment of the present invention, a first mover game player has reversed a hollow game piece having a white quadrangular solid graphics and has moved the game piece as a hollow game piece having a white cross-shaped hollow graphics to an intersection point III5.

Next, as shown in FIG. 12, when the first mover game player, in order to first occupy the intersection points 3 providing 8 score points, moves, by using the inputting device 25, the hollow game piece 11 (see FIG. 11) having a white pentagonal solid graphics to the intersection point III5 along the vertical ruled line 2 after letting the black solid game piece 8 be jumped over and, at the same time, performs a reversing operation, the game piece movement permitting means 33 judges the propriety of movement of the white hollow game piece 11 to the intersection point III5 and the game piece reversal permitting means 34 judges the propriety of reversal of the white hollow game piece 11. In this situation , since no game piece having any color is put on the intersection point III5, the game piece movement permitting means 33 permits the movement of the white hollow game piece 11 to the intersection point III5 and, further, the game piece reversal permitting means 34 allows the reversal of the white hollow game piece 11 thus causing the white hollow game piece 11 to be put as the hollow game piece 11 having a white cross-shaped hollow graphics at the intersection point III5.

Figure 13:
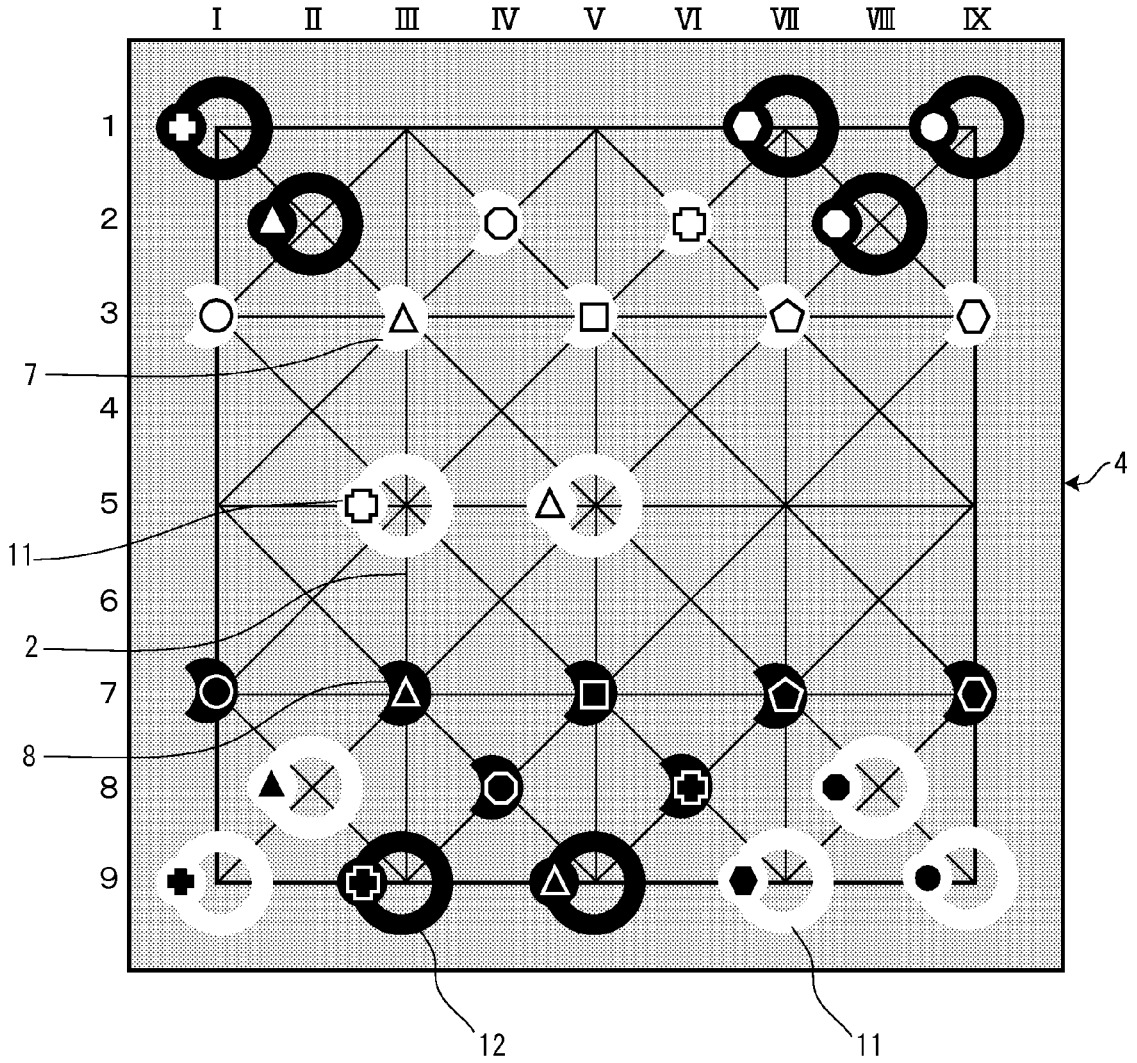
FIG. 13 is a plan view showing a state in which, in one simulation game by the electronic game machine of the embodiment of the present invention, a second mover game player has reversed a hollow game piece having a black quadrangular solid graphics and has moved the game piece as a hollow game piece having a black quadrangular solid graphics to an intersection point III9.

Then, as shown in FIG. 13, when the second mover game player, in order to hinder the first mover game player from moving the hollow game piece 11 in the horizontal direction and, moves, by using the inputting device 25, the hollow game piece 12 (see FIG. 12) having the black quadrangular solid graphics along the vertical ruled line 2 to the intersection point III9 by letting the white hollow game pieces 7, white hollow game piece 11, and black solid game piece 8 be jumped over and also performs a reversing operation, the game piece movement permitting means 33 judges the propriety of movement of the black hollow game piece 12 to the intersection point III9 and the game piece reversal permitting means 34 judges the propriety of reversal of the black hollow game piece 12. In this situation, since no game piece having any color is put on the intersection point III9, the game piece movement permitting means 33 permits the movement of the black hollow game piece 12 to the intersection point III9 and, further, the game piece reversal permitting means 34 allows the reversal of the black hollow game piece 12 thus causing the black hollow game piece 12 to be put as the hollow game piece 12 having a black cross-shaped hollow graphics at the intersection point III9.

Figure 14:
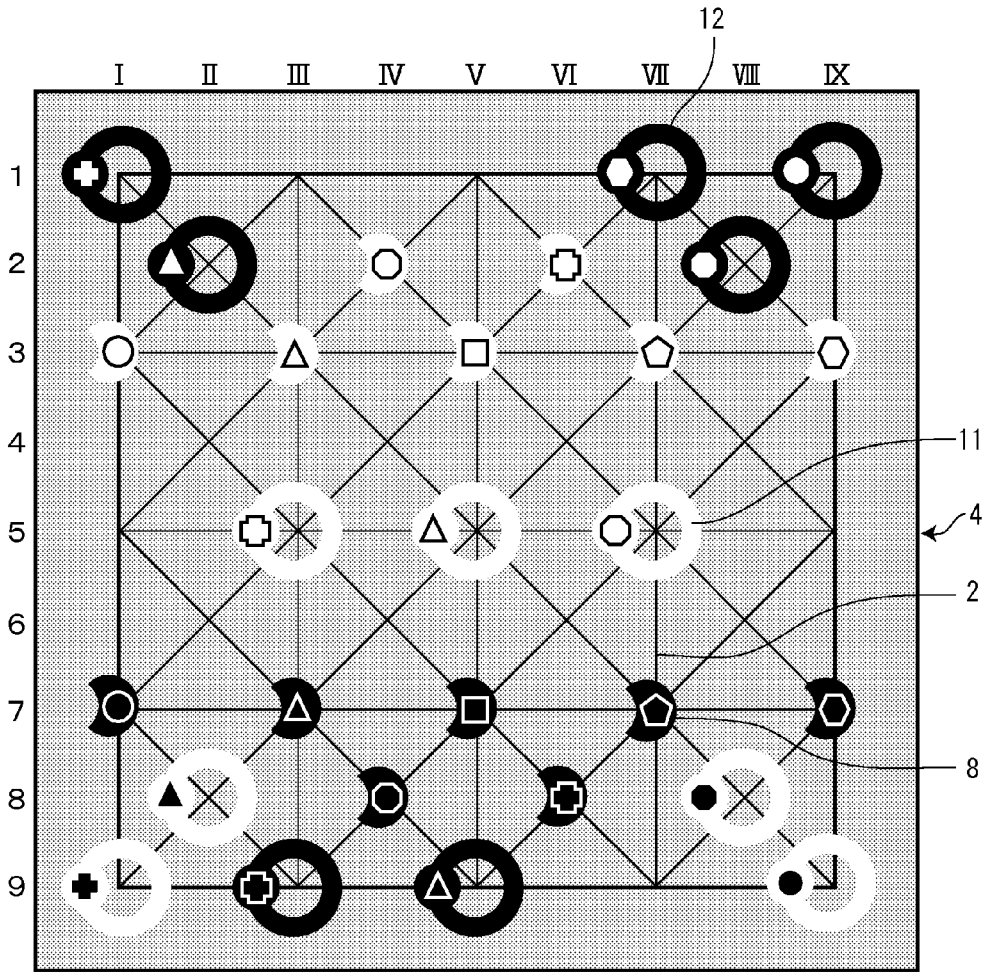
FIG. 14 is a plan view showing a state in which, in one simulation game by the electronic game machine of the embodiment of the present invention, a first mover game player has reversed a hollow game piece having a white hexagonal solid graphics and has moved the game piece as a hollow game piece having a white octagonal hollow graphics to an intersection point VII5.

Next, as shown in FIG. 14, when the first mover game player, in order to first occupy the intersection points 3 providing 8 scores, moves, by using the inputting device 25, the hollow game piece 11 (see FIG. 13) having a white hexagonal solid graphics to the intersection point VII5 along the vertical ruled line 2 after letting the black solid game piece be jumped over and, at the same time, performs a reversing operation, the game piece movement permitting means 33 judges the propriety of movement of the white hollow game piece 11 to the intersection point VII5 and the game piece reversal permitting means 34 judges the propriety of reversal of the white hollow game piece 11. In this situation , since no game piece having any color is put on the intersection point VII5, the game piece movement permitting means 33 permits the movement of the white hollow game piece 11 to the intersection point VII5 and further the game piece reversal permitting means 34 allows the reversal of the white hollow game piece 11 thus causing the white hollow game piece 11 to be put as the hollow game piece 11 having a white octagonal hollow graphics at the intersection point VII5.

Figure 15:
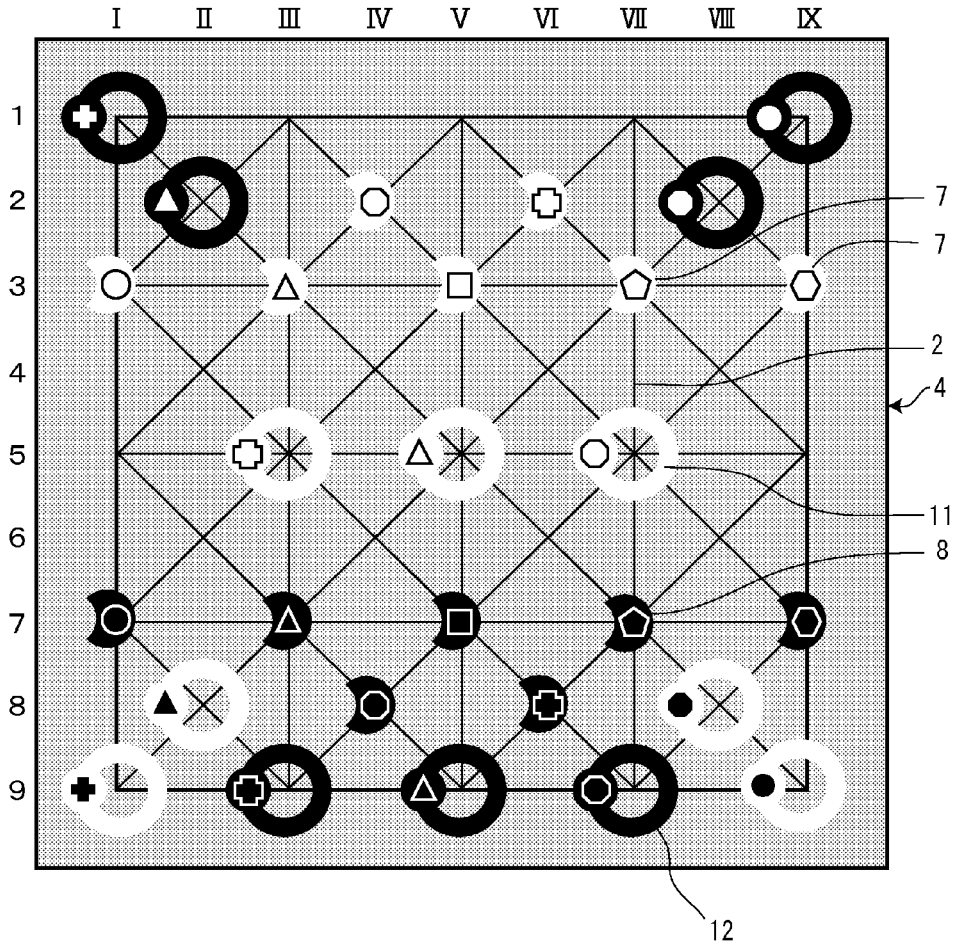
FIG. 15 is a plan view showing a state in which, in one simulation game by the electronic game machine of the embodiment of the present invention, a second mover game player has reversed a hollow game piece having a black hexagonal solid graphics and has moved the game piece as a hollow game piece having a black octagonal hollow graphics to an intersection point VII9.

Then, as shown in FIG. 15, when the second mover game player, in order to hinder the first mover game player from moving the hollow game piece 11 having the white solid graphics in the horizontal direction and, moves, by using the inputting device 25, the hollow game piece 12 (see FIG. 14) having the black hexagonal solid graphics along the vertical ruled line 2 to the intersection point VII9 by letting the white hollow game pieces 7, white hollow game piece 11, and black solid game piece 8 be jumped over and also performs a reversing operation, the game piece movement permitting means 33 judges the propriety of movement of the black hollow game piece 12 to the intersection point VII9 and the game piece reversal permitting means 34 judges the propriety of reversal of the black hollow game piece 12. In this situation, since no game piece having any color is put on the intersection point VII9, the game piece movement permitting means 33 permits the movement of the black hollow game piece 12 to the intersection point VII9 and, further, the game piece reversal permitting means 34 allows the reversal of the black hollow game piece 12 thus causing the black hollow game piece 12 to be put as the hollow game piece 12 having the black cross-shaped hollow graphics at the intersection point VII9.

As shown in FIGS. 16 to 49, at the opening in a game and thereafter, both the first and second game players play a game according to a basic strategy of uniting a game piece having a color selected by themselves as soon as possible and of hindering the game piece selected by an opponent from being united. Therefore, the game piece having a color selected by themselves is moved by letting game pieces successively arranged be jumped over or the game piece having a color selected by an opponent is hindered from jumping over the game pieces successively arranged. Moreover, by moving the game piece having the color selected by themselves to the intersection point at which the game piece having the color selected by the opponent is expected to move.

Figure 16:
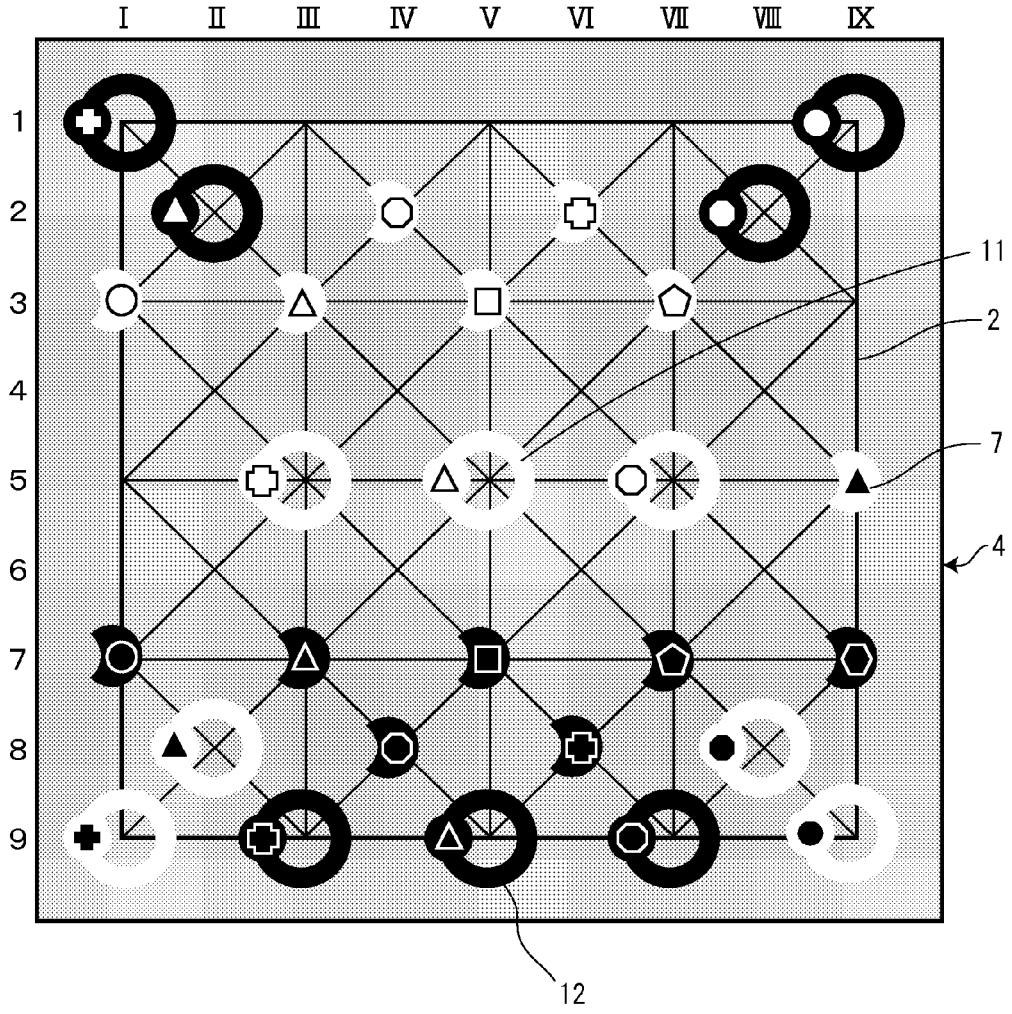
FIG. 16 is a plan view showing a state in which, in one simulation game by the electronic game machine of the embodiment of the present invention, a first mover game player has reversed a solid game piece having a white hexagonal hollow graphics and has moved the game piece as a solid game piece having a white triangular solid graphics to an intersection point IX5.

More specifically, as shown in FIG. 16, the first mover, in order to make preparation for uniting the hollow game piece 11 having a white triangular hollow graphics with the solid game piece 7 having a white hexagonal hollow graphics (see FIG. 15) to form a regular doubly united game piece, moves the solid game piece 7 having the white hexagonal hollow graphics, along the vertical ruled line 2 to the intersection point IX5 and performs a reversal operation, the game piece movement permitting means 34 judges the propriety of movement of the white solid game piece 7 to the intersection point IX5 and the game piece reversal permitting means 34 judges the propriety of reversal of the white solid game piece 7. Since no game piece having any color is put on the intersection point IX5, the game piece movement permitting means 33 permits the movement of the black hollow game piece 12 to the intersection point IX5 and, further, the game piece reversal permitting means 34 allows the reversal of the white solid game piece 7 thus causing the white solid game piece 7 to be put as the solid game piece 7 having the white triangular solid graphics at the intersection point IX5.

Figure 17:
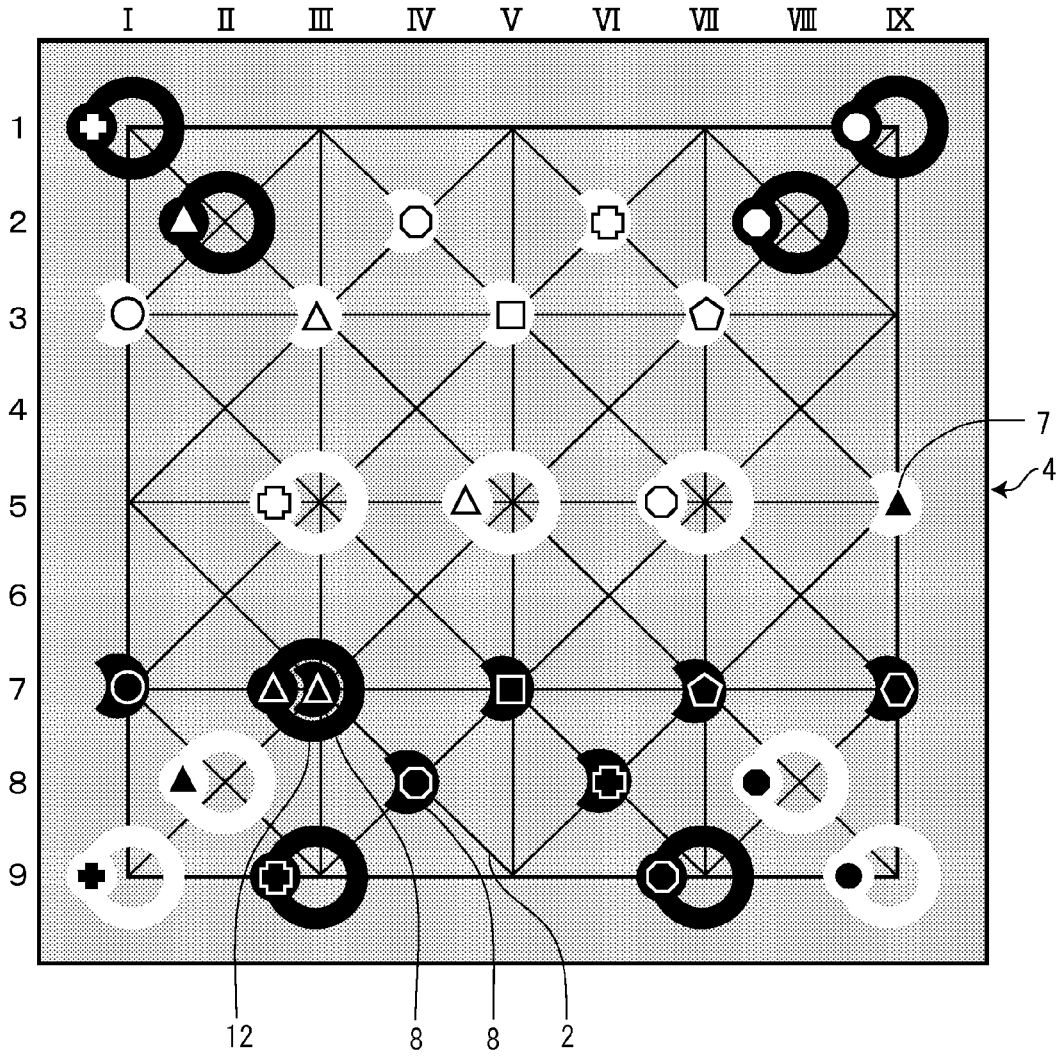
FIG. 17 is a plan view showing a state in which, in one simulation game by the electronic game machine of the embodiment of the present invention, a second mover game player has reversed a hollow game piece having a black triangular hollow graphics and has moved the game piece to an intersection point III7.

Next, as shown in FIG. 17, when the second mover, in order to change the solid game piece 8 having a black triangular hollow graphics into a solid game piece 8 having a black octagonal solid graphics by moving the solid game piece 8, performs an operation of moving the hollow game piece 12 (see FIG. 16) having a black triangular hollow graphics, without surrendering the intersection point III7 to an opponent and of reversing the same, by using the inputting device 25, along the slanted ruled line 2 to the intersection point III7, by letting the black solid game piece be jumped over, the game piece movement permitting means 33 judges the propriety of movement of the black hollow 12 to the intersection point III7. In this situation, since the solid game piece 8 with a black triangular hollow graphics having a contour with the same color and same shape as the black hollow game piece 12 is put on the intersection point III7, the game piece movement permitting means 33 permits the movement of the black hollow game piece 12 to the intersection point III7 thus causing the solid game piece 8 and the solid game piece 12 to be put on the intersection point III7 in a state where the solid game piece 8 and hollow game piece 12 are united with each other, and the game piece uniting judging section 35 judges that the black solid game piece 8 is united with the black hollow game piece 12. Moreover, if the double uniting judging means 37 judges that the united game piece is a hollow united game piece, without uniting (doubly uniting) among graphics and the intersecting line number calculating means 36 calculates the number of intersected lines at an intersection point at which an united game piece is put. Then, according to the formula to be applied in the case of the hollow united game piece shown in FIG. 7 (number of intersected lines at an intersection point at which a united game piece exists +2 score points), 10 points are given as the obtained score and a total score obtained of the black game pieces is summed up by the score summing-up means 38 and stored in the storing device 23.

With this movement, the second mover leaves the hollow game piece 12 having a black triangular hollow graphics on the intersection point III7 providing 8 score points and moves the solid game piece 8 having a black triangular hollow graphics to the intersection point V9 for reversal to try to change the solid game piece 8 into the solid game piece 8 having the black octagonal solid graphics.

Figure 18:
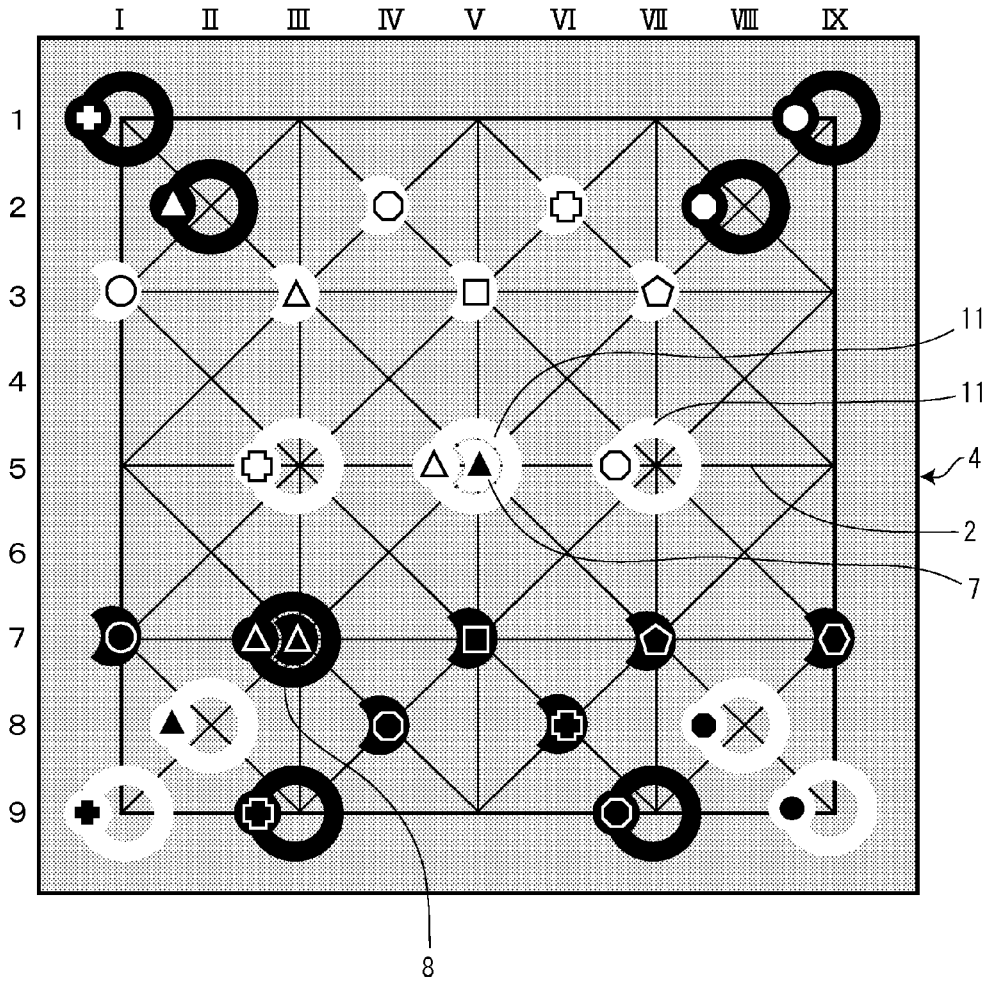
FIG. 18 is a plan view showing a state in which, in one simulation game by the electronic game machine of the embodiment of the present invention, a first mover game player has reversed a solid game piece having a white triangular solid graphics and has moved the game piece to an intersection point V5.

Next, as shown in FIG. 18, when the first mover performs an operation, by using the inputting device 25, of moving the solid game piece (see FIG. 17) having a white triangular solid graphics along the horizontal ruled lines 2 to the intersection point V5 by letting the white hollow game piece 11 be jumped over, the game piece movement permitting means 33 judges the propriety of movement of the white solid game piece 7 to the intersection point V5. In this situation, since the hollow game piece 11 with a white triangular hollow graphics having a contour with the same color and same shape as the white solid game piece 7 is put on the intersection point V5, the game piece movement permitting means 33 permits the movement of the white solid game piece 7 to the intersection point V5 and, as a result, the solid game piece 7 and the hollow game piece 11 are put on the intersection point V5 in a state where the solid game piece 7 and hollow game piece 11 are united with each other, and the game piece uniting judging section 35 judges that the white solid game piece 7 is united with the white hollow game piece 11. Moreover, the double uniting judging means 37 judges that uniting (doubly uniting) among graphics occurs and that the united game piece is judged as a regular doubly united game piece and the intersecting line number calculating means 36 calculates the number of intersected lines at an intersection point at which an united game piece is put. Then, according to the formula to be applied in the case of the hollow united game piece shown in FIG. 7 (number of intersected lines at an intersection point at which a united game piece exists ×2+ score points), 21 points are given as the obtained score and a total score obtained of the black game pieces is summed up by the score summing-up means 38 and stored in the storing device 23.

Figure 19:
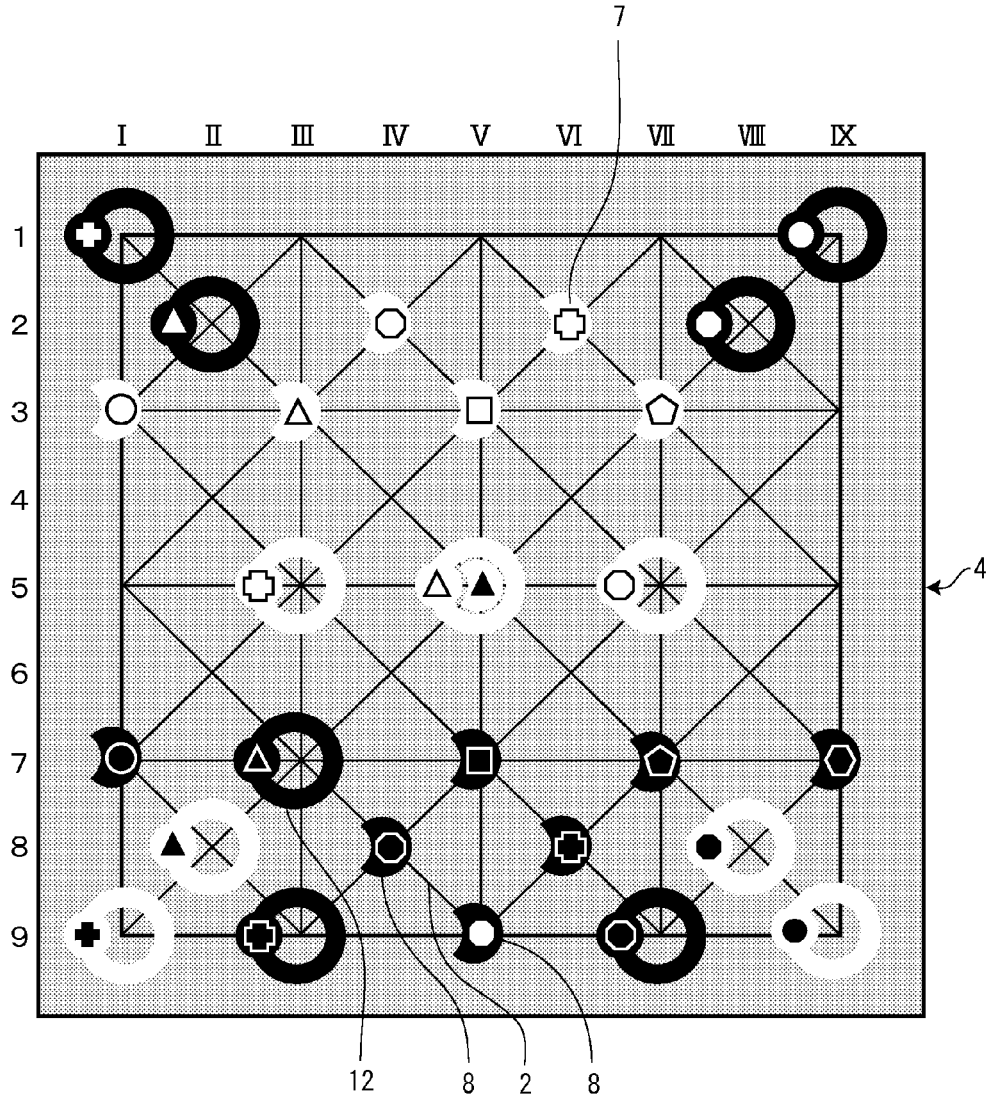
FIG. 19 is a plan view showing a state in which, in one simulation game by the electronic game machine of the embodiment of the present invention, a second mover game player has reversed a solid game piece having a black triangular hollow graphics and has moved the game piece as a hollow game piece having a black octagonal solid graphics to an intersection point V9.

Next, as shown in FIG. 19, when the second mover, as is scheduled, performs an operation, by using the inputting device 25, of leaving the hollow game piece 12 (regular hollow game piece) having a black triangular hollow graphics at the intersection point III7 providing 8 score points and of moving the solid game pieces 8 (semi-solid game piece, see FIG. 18) having the black triangular hollow graphics along the slanted ruled line 2 with the black solid game piece 8 being jumped over to the intersection point V9 and of reversing the same, the game piece movement permitting means 33 judges the propriety of the movement of the black solid game piece 8 to the intersection point 9 and the game piece reversal permitting means 34 judges the propriety of the reversal of the black solid game piece 8. In this situation, since no game piece having any color is put on the intersection point V9, the game piece movement permitting means 33 permits the movement of the black solid game piece 8 to the intersection point V9 and, further, the game piece reversal permitting means 34 allows the reversal of the black solid game piece 8 thus causing the black solid game piece 7 to be put as the solid game piece 8 (regular solid game piece) having a black octagonal solid graphics at the intersection point V9. Then, by the movement of the solid game piece 8, the hollow united game piece having been put on the intersection point III7 is judged to be separated by the game piece uniting judging means 35 and then, according to the formula to be applied in the case of the hollow united game piece shown in FIG. 7 (number of intersected lines at an intersection point at which a united game piece exists +2 points), −10 score points are given as the obtained score of the black game piece and a total score obtained of the black game pieces is summed up by the score summing-up means 38 and stored in the storing device 23.

Figure 20:
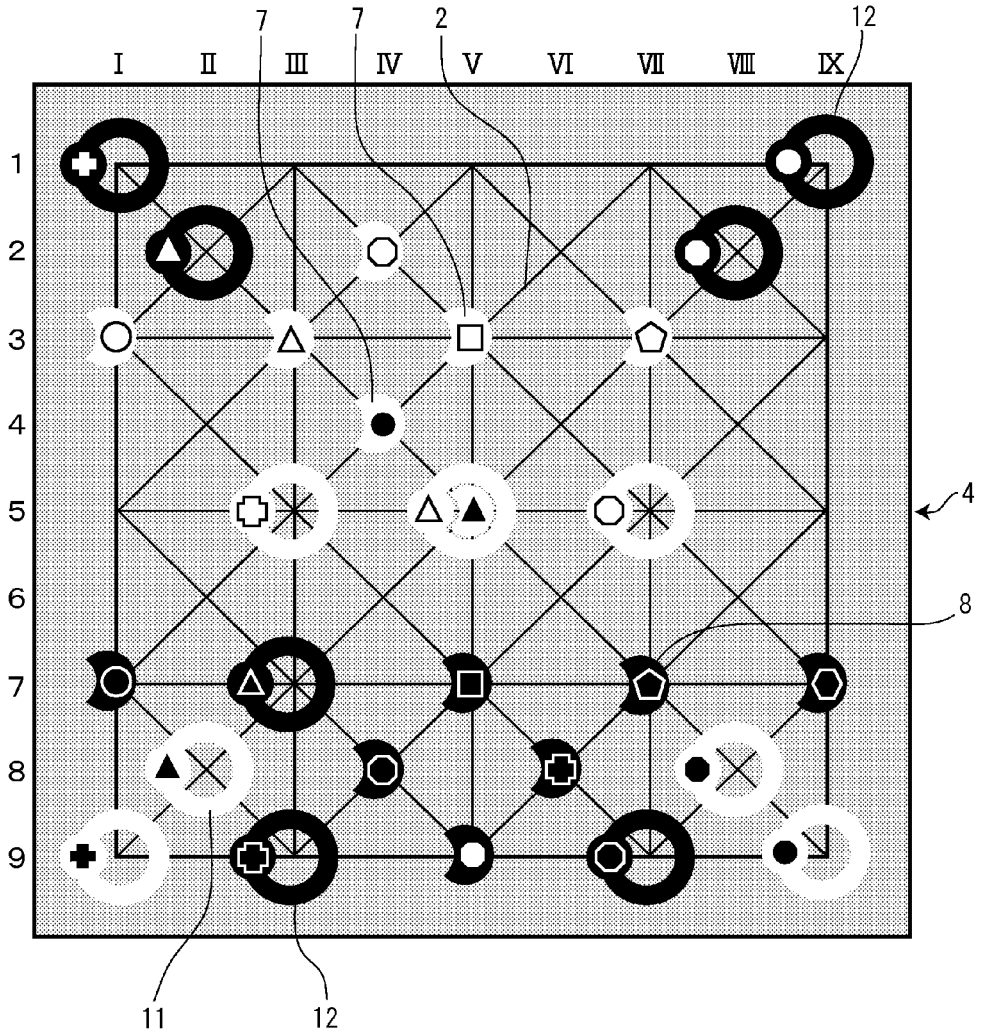
FIG. 20 is a plan view showing a state in which, in one simulation game by the electronic game machine of the embodiment of the present invention, a first mover game player has reversed a solid game piece having a white cross-shaped solid graphics and has moved the game piece as a solid game piece having a white circular solid graphics to an intersection point IV4.

Then, as shown in FIG. 20, when the first mover, in order to make preparation for uniting the hollow game piece 11 having a circular hollow graphics obtained by reversing the hollow game piece 11 having a white triangular solid game piece with the white solid game piece on the intersection point I7, or to hinder the solid game piece 8 having the cross-shaped solid graphics obtained by reversing the hollow game piece having a black pentagonal hollow graphics put on the intersection point VII7 from being united with the solid game piece 12 having a black cross-shaped hollow graphics put on the intersection point III9 at the intersection point VI6 to form a regular doubly united game piece, performs an operation of moving, by using the inputting device 25, the solid game piece 7 (see FIG. 19) having a white cross-shaped hollow graphic along the slant ruled line 2 with the white solid game piece 7 being jumped over to the intersection point IV4 and of reversing the same, the game piece movement permitting means 33 judges the propriety of the movement of the white solid game piece 7 to the intersection point IV4 and the game piece reversal permitting means 34 judges the propriety of the reversal of the white solid game piece 7. In this situation , since no game piece having any color is put on the intersection point IV4, the game piece movement permitting means 33 permits the movement of the white solid game piece 7 to the intersection point IV4 and, further, the game piece reversal permitting means 34 allows the reversal of the white solid game piece 7 thus causing the white solid game piece 7 to be put as the solid game piece 7 having the white circular octagonal solid graphics at the intersection point IV4.

Figure 21:
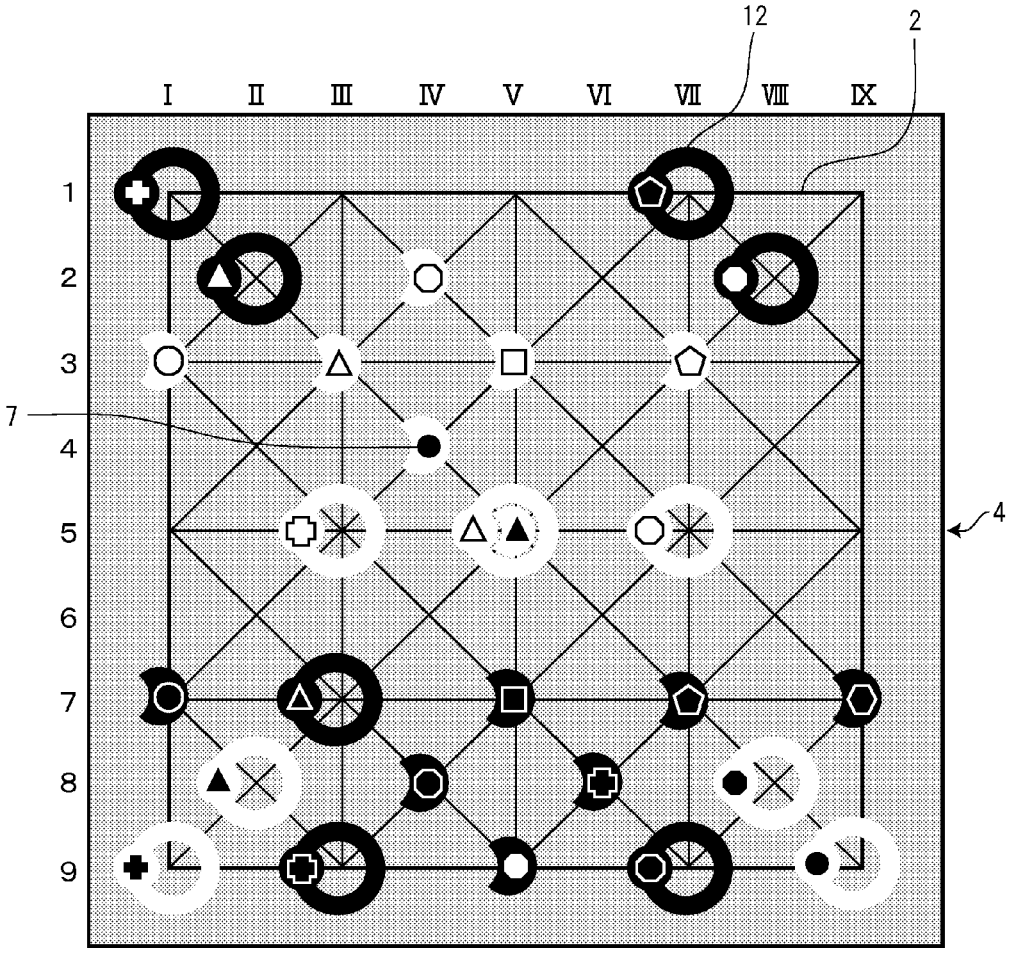
FIG. 21 is a plan view showing a state in which, in one simulation game by the electronic game machine of the embodiment of the present invention, a second mover game player has reversed a hollow game piece having a black circular solid graphics and has moved the game piece as a hollow game piece having a black pentagonal hollow graphics to an intersection point VIII.

Next, as shown in FIG. 21, when the second mover performs an operation of, by using the inputting device 25, moving the hollow game piece (see FIG. 20) having a black circular solid graphics along the horizontal ruled line 2 to the intersection point VIII and of reversing the same, the game piece movement permitting means 33 judges the propriety of the movement of the black hollow game piece 12 and the game piece reversal permitting means 34 judges the propriety of the reversal of the black hollow game piece 12. Since no game piece having any color is put on the intersection point VIII, the game piece movement permitting means 33 permits the movement of the black hollow game piece to the intersection point VIII and the game piece reversal permitting means 34 allows the reversal of the black hollow game piece 12 and, as a result, the black solid game piece 12 is put as the solid game piece 12 having the black pentagonal hollow graphics at the intersection point VIII.

At this point of time, the second mover, without surrendering the intersection point VII7 providing 8 score points, moves and reverses the solid game piece 8 (semi-solid game piece) having a black pentagonal hollow graphics to change the solid game piece 8 into the solid game piece (regular solid game piece) having a black cross-shaped solid graphics and to temporarily unite the solid game piece 8 having a black pentagonal hollow graphics with the hollow game piece having a black pentagonal hollow graphics as a hollow united game piece, the hollow game piece 12 having a black pentagonal hollow graphics is moved to the intersection point VIII.

Figure 22:
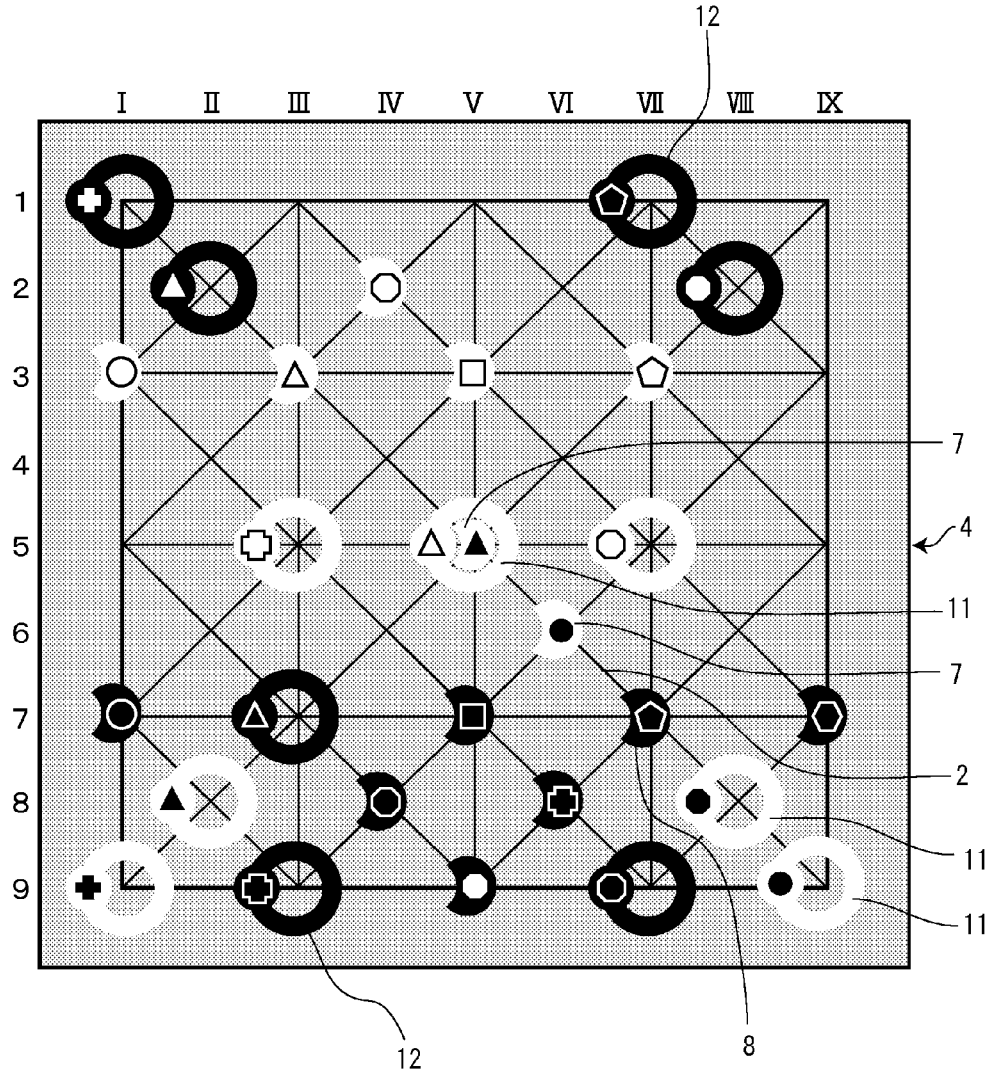
FIG. 22 is a plan view showing a state in which, in one simulation game by the electronic game machine of the embodiment of the present invention, a first mover game player has reversed a solid game piece having a white circular solid graphics and has moved the game piece to an intersection point VI6.

Next, as shown in FIG. 22, when the first mover game player performs an operation, by using the inputting device 25, of moving the solid game piece 7 (see FIG. 21) having a white circular solid graphics along the slanted ruled line 2 with a united game piece of the white solid game piece and the white solid game piece being jumped over, to the intersection point V16, the game piece movement permitting means 33 judges the propriety of the movement of the white solid game piece to the intersection point V16. In this situation , no game piece having any color is put, the game piece movement of the white solid game piece 7 to the intersection point VI6 and the white solid game piece 7 is put on the intersection point VI6.

At this point of time, the first mover, in order to hinder the solid game piece 8 having a black cross-shaped solid graphics obtained by reversing the solid game piece 8 having a black pentagonal hollow graphics put on the intersection point VII7 from being united with the hollow game piece 12 having the black cross-shaped hollow graphics put on the intersection point VII7 to form a regular doubly united game piece and in order to allow the hollow game piece 11 having a white quadrangular hollow graphics obtained by reversing the hollow game piece 11 having the white octagonal solid graphics to jump over using the left-slanted ruled line, moves the solid game piece 7 having a white circular solid graphics.

Figure 23:
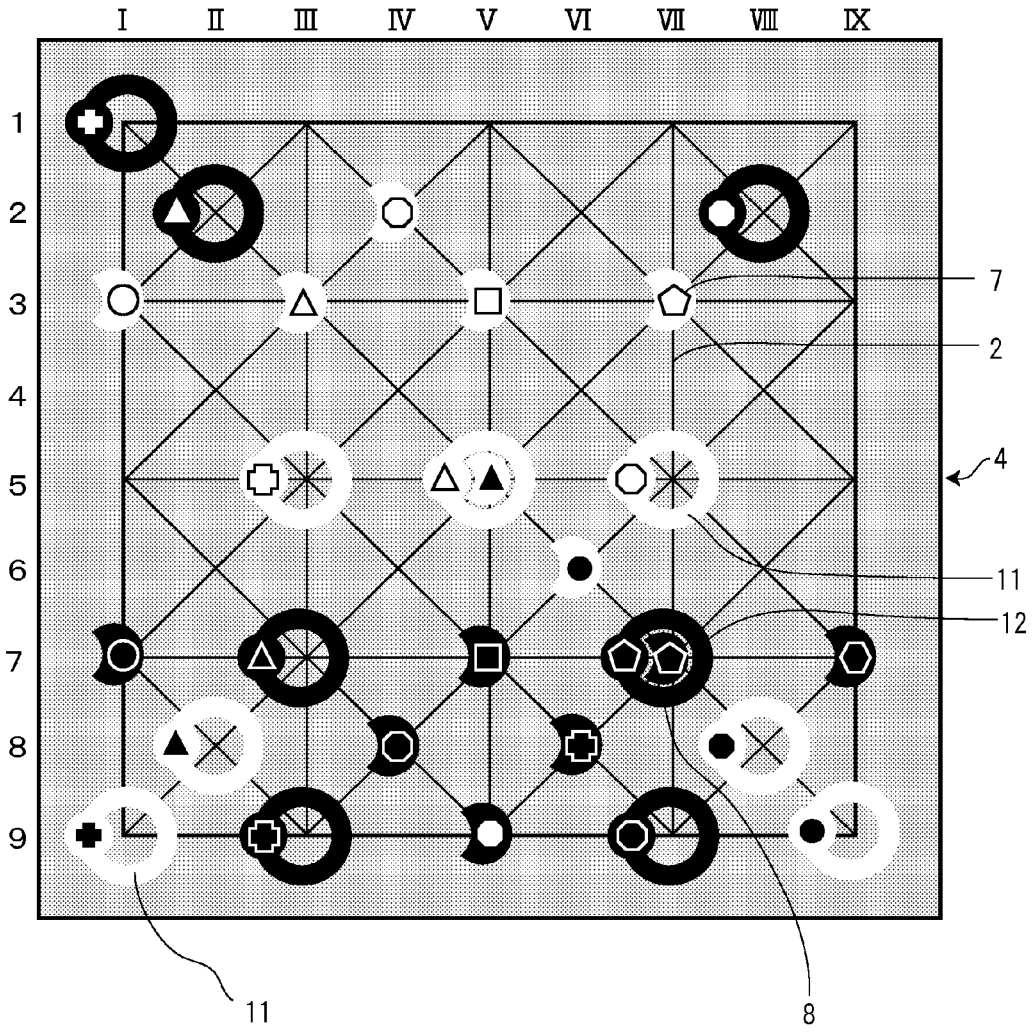
FIG. 23 is a plan view showing a state in which, in one simulation game by the electronic game machine of the embodiment of the present invention, a second mover game player has reversed a hollow game piece having a black pentagonal hollow graphics and has moved the game piece to an intersection point VII7.

Next, as shown in FIG. 23, when the second mover, as is scheduled, performs an operation of moving, by using the inputting device 25, the hollow game piece 12 (see FIG. 22) having a black pentagonal hollow graphics along the vertical ruled line 2 to the intersection point VII7 with the white solid game piece and white hollow game piece 11 being jumped over, the game piece movement permitting means 33 judges the propriety of the movement of the black hollow game piece to the intersection point VII7. In this situation, since, on the intersection point VII7, the solid game piece 8 having a black pentagonal hollow graphics with the contour being same in color and in shape as the black hollow game piece 12 is put, by the permission of the movement of the hollow game piece 12, by the game piece permitting means 33, to the intersection point VII7, and the solid game piece 8 and the hollow game piece 12 are put on the intersection point VII7 in a state where the game piece 8 and hollow piece 12 have been united and the game piece uniting judging means 35 judges that the solid game piece 8 and the hollow game piece 12 have been united. The double uniting judging means 37 judges that no uniting (doubly uniting) among graphics occurs and that the united game piece is judged as a hollow united game piece and the intersecting line number calculating means 36 calculates the number of intersected lines at an intersection point at which an united game piece is put. Then, according to the formula to be applied in the case of the hollow united game piece shown in FIG. 7 (number of intersected lines at an intersection point at which a united game piece exists +2 score points), 10 score points are given as the obtained score and a total score obtained of the black game pieces is summed up by the score summing-up means 38 and stored in the storing device 23.

Then, thereafter, the second mover game player, the hollow game piece having the black pentagonal graphics left on the intersection point VII7 providing 8 score points, moves the solid game piece 8 having the black pentagonal graphics and reverses the game piece and tries to change the above solid game piece 8 into the solid game piece 8 having a black cross-shaped graphics.

Figure 24:
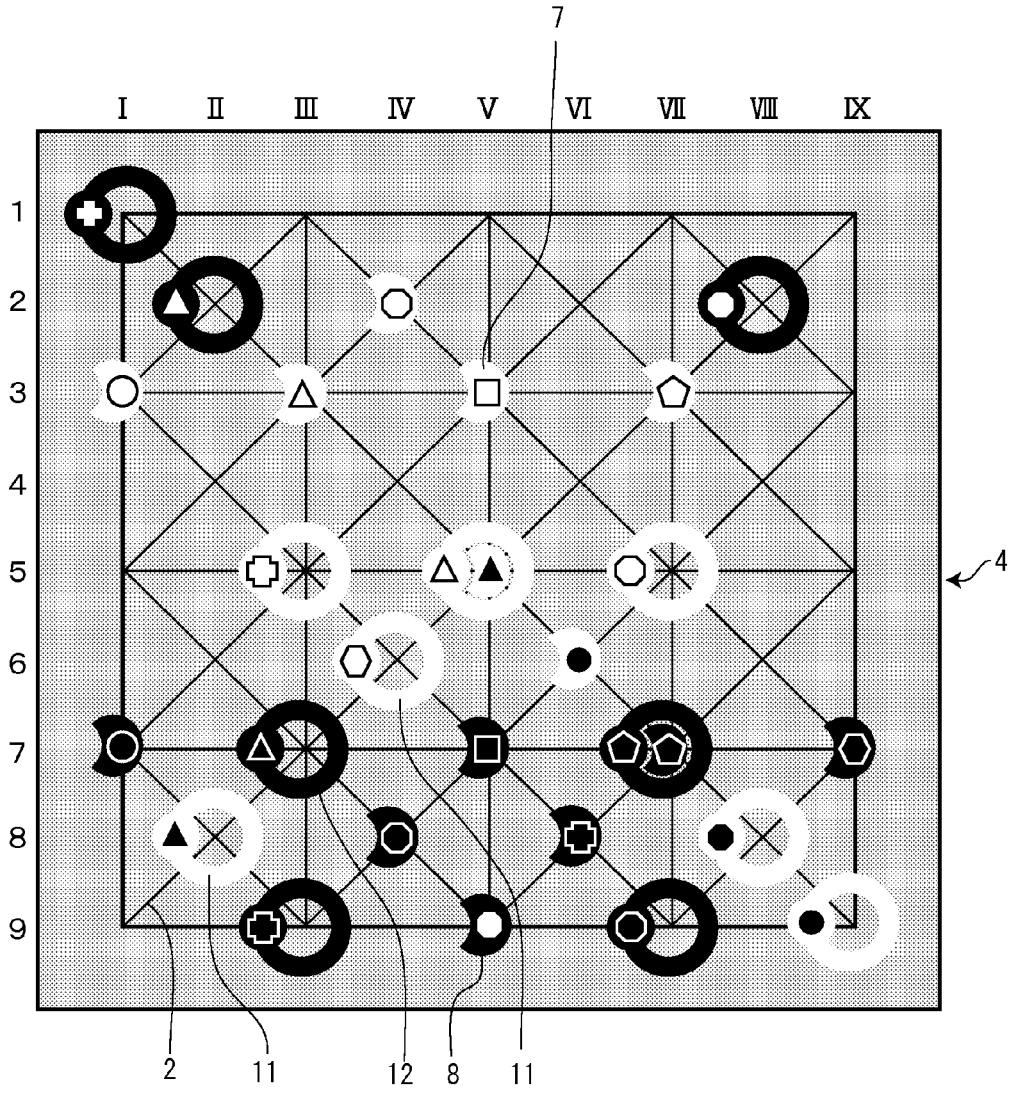
FIG. 24 is a plan view showing a state in which, in one simulation game by the electronic game machine of the embodiment of the present invention, a first mover game player has reversed a hollow game piece having a white cross-shaped solid graphics and has moved the game piece to an intersection point IV6.

Next, as shown in FIG. 24, when the first mover performs an operation of moving, by using the inputting device 25, the hollow game piece 11 (see FIG. 22) having a white cross-shaped solid graphics along the slanted ruled line 2 to the intersection point IV6 with the white hollow game piece and black hollow game piece 12 being jumped over, the game piece movement permitting means 33 judges the propriety of the movement of the white hollow game piece 11 to the intersection point VI6 and the game piece reversal permitting means 34 judges the propriety of the reversal of the white hollow game piece 11. In this situation, no game piece having any color is put on the intersection point 16, the game piece movement permitting means 33 permits the movement of the white hollow game piece 11 to the intersection point VI6 and, further, the game piece reversal permitting means 34 permits the reversal of the white hollow game piece 11 and, as a result, the white hollow game piece 11 is put on the intersection point IV6 as the hollow game piece 11 having a white hexagonal hollow game piece 11.

At this point of time, in order to unite with the solid game piece having a white hexagonal solid graphics obtained by reversing the solid game piece having a white quadrangular graphics put on the intersection point V3, the first mover game player moves the hollow game piece having a white hexagonal hollow graphics. Moreover, the first mover game player, depending on following situations, reverses the hollow game piece having a white triangular solid graphics to let the contained hollow game piece having a white circular hollow game piece be jumped over up to the intersection point VI4.

Figure 25:
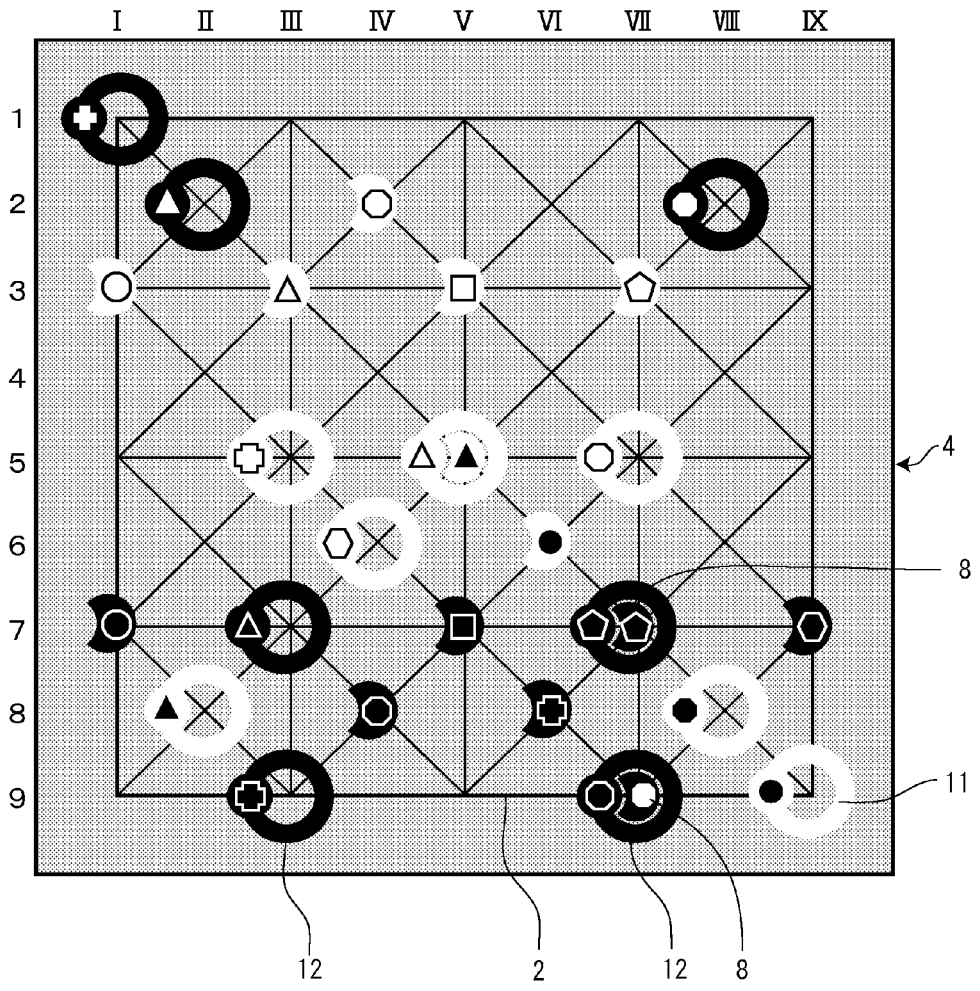
FIG. 25 is a plan view showing a state in which, in one simulation game by the electronic game machine of the embodiment of the present invention, a second mover game player has reversed a solid game piece having a black octagonal hollow graphics and has moved the game piece to an intersection point VII9.

Then, as shown in FIG. 25, when the second mover game player performs an operation of moving, by using the inputting device 25, the solid game piece 8 (see FIG.

24) having a black octagonal solid graphics along the horizontal ruled line 2 to the intersection point VII9, the game piece movement permitting means 12 judges the propriety of the movement of the black solid game piece 8. In this situation, since the hollow game piece 12 having a black octagonal graphics having a contour being the same in color and shape as the black solid game piece 8, by the permission of movement of black solid game piece 8 to the intersection point VII9, the solid game piece 8 and hollow game pieces 12 are put on the intersection point II9 in a state where the solid game piece 8 and hollow game piece 12 are united with each other and the black solid game piece 8 and black hollow game piece 12 are judged, by the game piece uniting means 35, as being united. Moreover, the double uniting judging means 37 judges that uniting (doubly uniting) among graphics occurs and that the united game piece is judged as a regular doubly united game piece and the intersecting line number calculating means 36 calculates the number of intersected lines at an intersection point at which a united game piece is put. Then, according to the formula to be applied in the case of the hollow united game piece shown in FIG. 7 (number of intersected lines at an intersection point at which a united game piece exists ×2+5 score points), 15 points are given as the obtained score and a total score obtained of the black game pieces are summed up by the score summing-up means 38 and stored in the storing device 23.

Additionally, the second mover game player, thereafter, reverses the solid game piece 8 having a black pentagonal graphics put on the intersection point VII7 and moves the game piece as the solid game piece 8 having a black cross-shaped solid graphics to the intersection point V9 and is going to unite with the hollow game piece 12 having the black cross-shaped hollow graphics put on the intersection point III9 to form a regular doubly united game piece.

Figure 26:
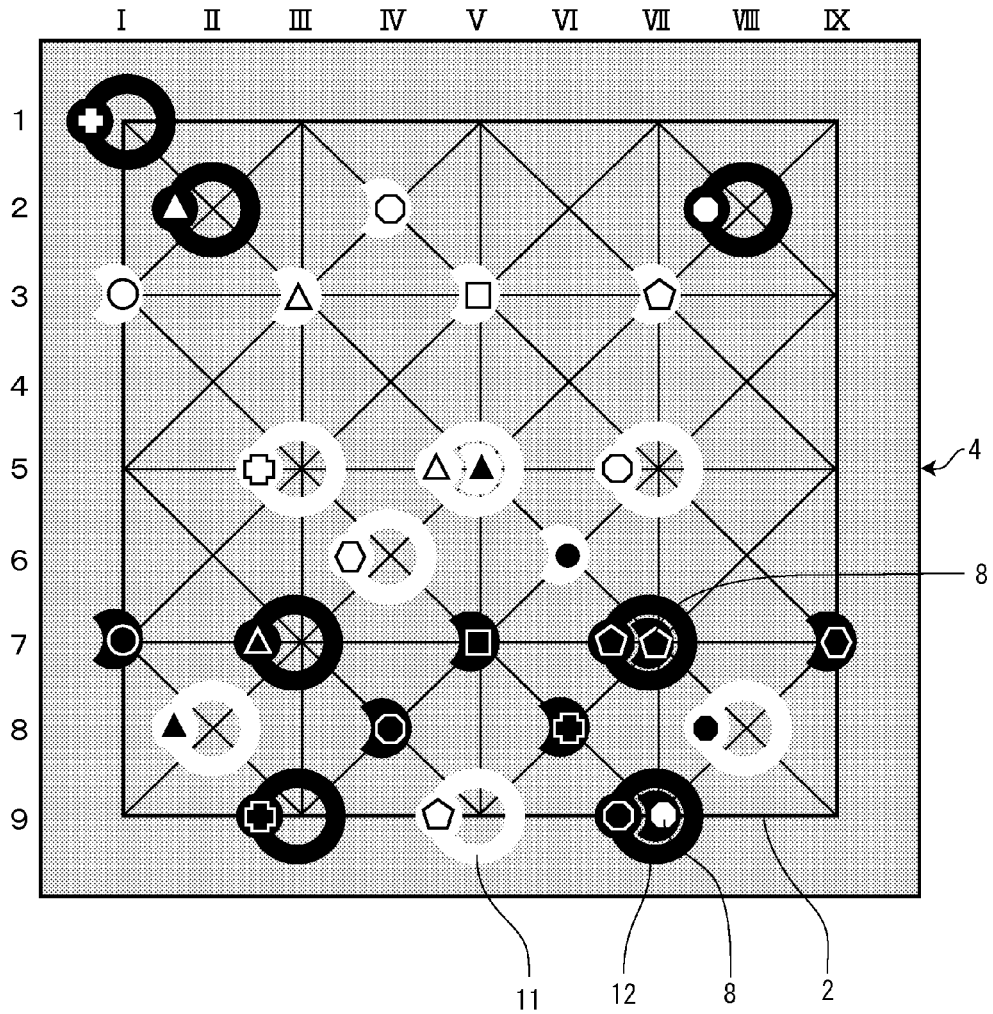
FIG. 26 is a plan view showing a state in which, in one simulation game by the electronic game machine of the embodiment of the present invention, a first mover game player has reversed a hollow game piece having a white circular solid graphics and has moved the game piece to an intersection point V9.

Next, as shown in FIG. 26, when the first mover game player hinders the second mover game player from uniting, through the intersection point V9, the solid game piece 8 having a black cross-shaped solid graphics with the hollow game piece 12 having a black cross-shaped hollow graphics to form a regular doubly united game piece and, in order to then move a hollow game piece 11 having a white pentagonal hollow graphics to the intersection point V1 to make preparation for uniting the hollow game piece 11 with the solid game piece 7 having a white pentagonal solid graphics obtained by reversing the solid game piece 7 having a white octagonal hollow graphics put on the intersection point IV2 to form a regular doubly united game piece, moves, by using the inputting device 25, the hollow game piece 11 (see FIG. 25) having a white cross-shaped solid graphics along the horizontal ruled line 2 by jumping over the regular doubly united game pieces made up of the black solid game piece 8 and black hollow game piece 12 to the intersection point V9 and reverses the hollow game piece 11, since no game piece having any color is put on the intersection point V9, the game piece movement permitting means 33 permits the movement of the white hollow game piece 11 to the intersection point V9 and further the game piece reversal permitting means 34 permits the reversal of the white hollow game piece 11 thus causing the white hollow game piece 11 to be put, as the hollow game piece 11 having the white pentagonal hollow graphics on the intersection point V9.

Figure 27:
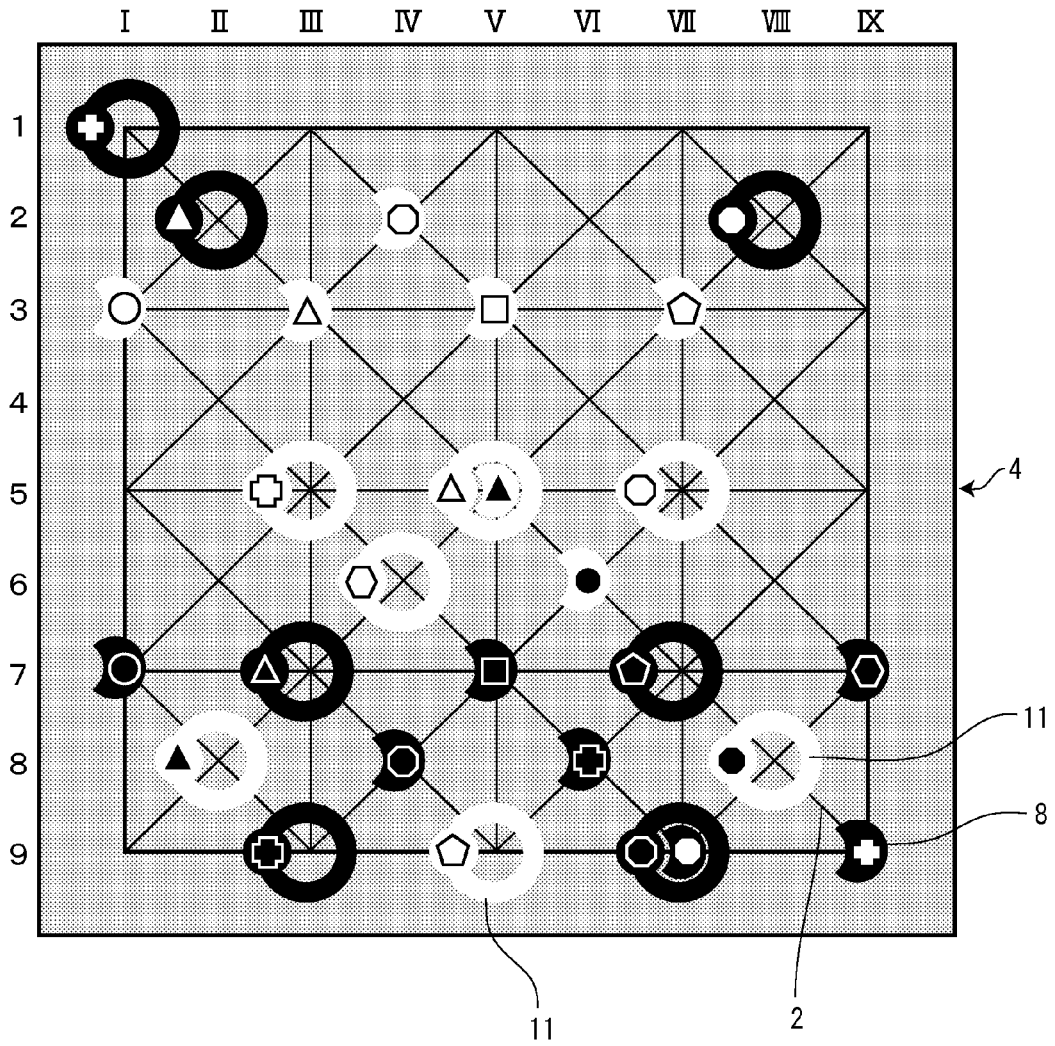
FIG. 27 is a plan view showing a state in which, in one simulation game by the electronic game machine of the embodiment of the present invention, a second mover game player has reversed a solid game piece having a black pentagonal hollow graphics and has moved the game piece to an intersection point IX9.

Then, as shown in FIG. 27, when the second mover game player, in order to thereafter unite with the hollow game piece having a black cross-shaped hollow graphics put on the intersection point III9, performs an operation of moving the solid game piece (semi-solid game piece, see FIG. 26) having a black pentagonal hollow graphics along the slanted ruled line 2 by jumping over the white hollow game piece 11 to the intersection point IX9 and of reversing the same, the game piece permitting means 33 judges the propriety of the movement of the black solid game piece 8 to the intersection point IX9. In this situation, since no game piece having any color is put on the intersection point IX9, the game piece movement permitting means 33 permits the movement of the black solid game piece to the intersection point IX9 and the game piece reversal means 34 permits the reversal of the black solid game piece 8 thus causing the black solid game piece 8 to be put, as the solid game piece 8 (regular solid game piece) having the black cross-shaped solid graphics, on the intersection point IX9. Then, by the movement of the solid game piece 8, a hollow united game piece having been put on the intersection point VII7 is judged to be separated by the game piece uniting judging means 35 and then, according to the formula to be applied in the case of the hollow united game piece shown in FIG. 7 (number of intersected lines at an intersection point at which a united game piece exists +2 points), −10 points are given as the obtained score of the black game piece and a total score obtained of the black game pieces is summed up by the score summing-up means 38 and stored in the storing device 23.

Figure 28:
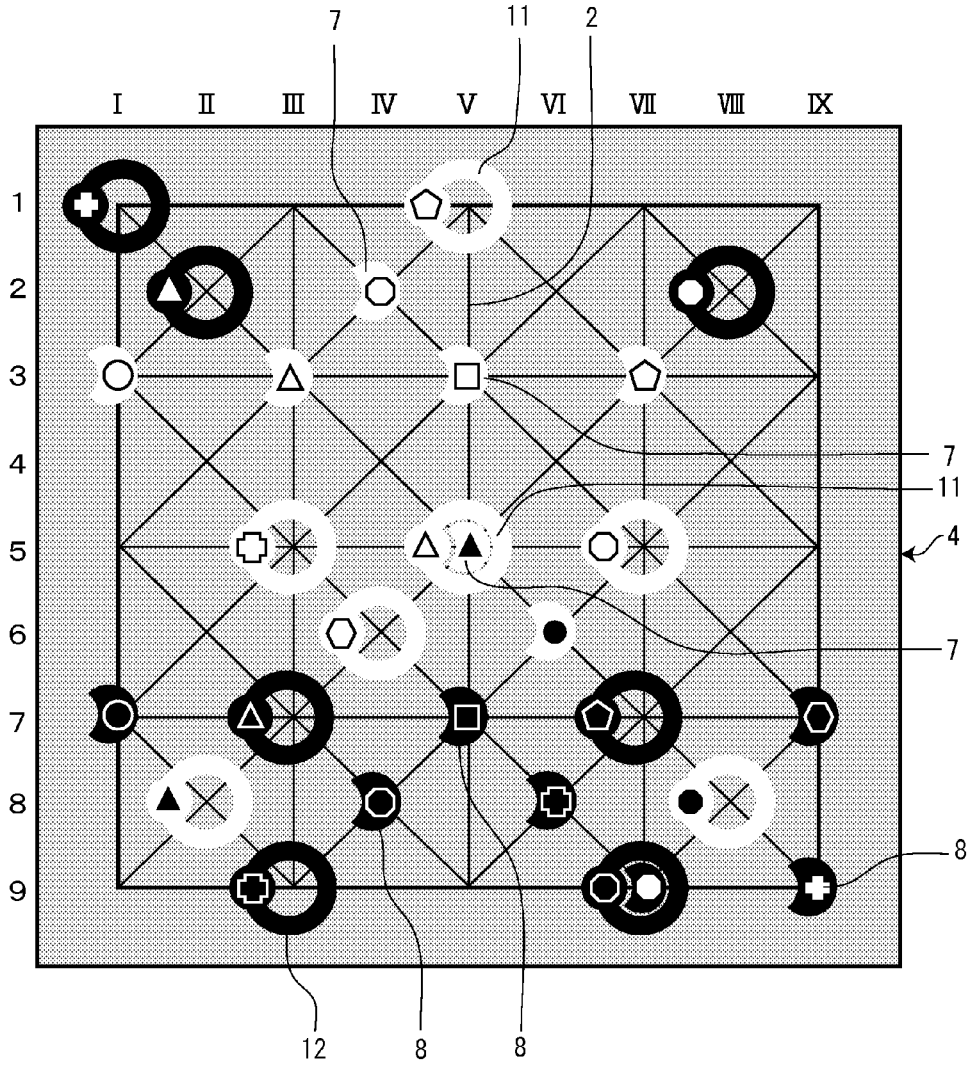
FIG. 28 is a plan view showing a state in which, in one simulation game by the electronic game machine of the embodiment of the present invention, a first mover game player has reversed a hollow game piece having a white pentagonal hollow graphics and has moved the game piece to an intersection point V1.

As shown in FIG. 28, when the first mover game player performs an operation of moving the hollow game piece 11 (see FIG. 27) having a white pentagonal hollow graphics along the vertical ruled line 2 to the intersection point VI, the game piece movement permitting means 33 judges the propriety of the movement of the white hollow game piece 11 to the intersection point VI. In this situation, since no game piece having any color is put on the intersection point VI, the game piece movement permitting means 33 permits the movement of the white hollow game piece 11 to the intersection point VI and, as a result, the white hollow game piece 11 is put on the intersection point VI.

By this movement of the game piece, the first mover game player, since the second mover game player is trying to unite the solid game piece 8 having the black cross-shaped solid graphics with the hollow game piece 12 having the black cross-shaped hollow graphics at the intersection point III9 to form a regular doubly united game piece, is also trying to increase the number of moves of the second mover game player by one move. Moreover, the first mover thereafter is trying to reverse the solid game piece 7 having a white octagonal hollow graphics put on the intersection point IV2 to move, as the solid game 7 piece having a pentagonal solid game piece, to the intersection point VI to achieve uniting therebetween for formation of the regular doubly united game piece.

Figure 29:
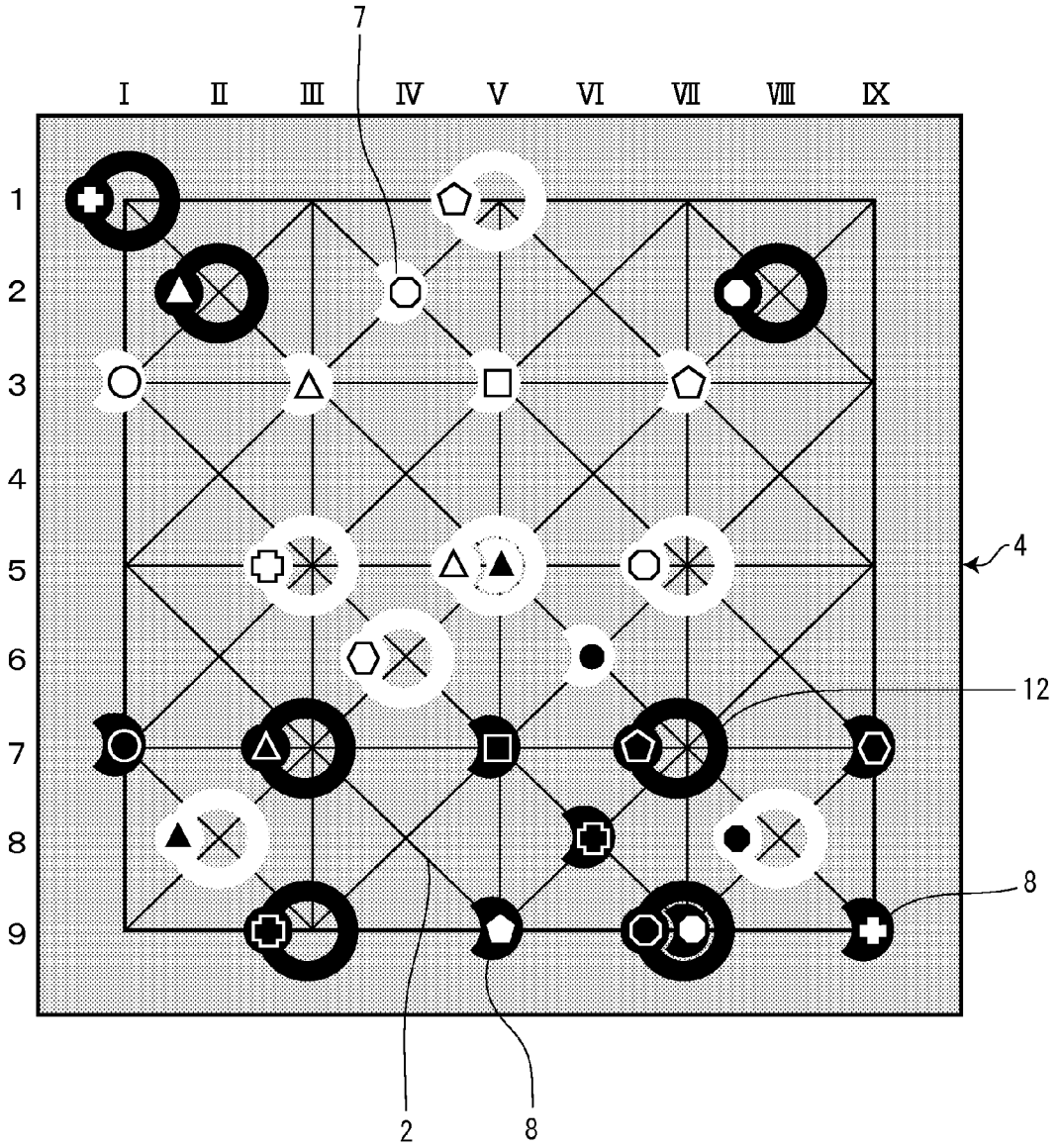
FIG. 29 is a plan view showing a state in which, in one simulation game by the electronic game machine of the embodiment of the present invention, a second mover game player has reversed a solid game piece having a black octagonal hollow graphics and has moved the game piece as a solid game piece having a black octagonal hollow graphics to an intersection point V9.

Then, as shown in FIG. 29, when the second mover game player performs an operation of, by using the inputting device 25, moving the solid game piece 8 (see FIG. 28) having a black octagonal hollow graphics along the slanted ruled line to the intersection point V9 and of reversing the above game piece, the game piece movement permitting means 33 judges the propriety of the movement of the black solid game piece 8 to the intersection point V9 and the game piece reversal permitting means 34 judges the propriety of reversal to the intersection point V9. In this situation, since no game piece having any color is put on the intersection point V9, the game piece movement permitting means 33 permits the movement of the black solid game piece and the game piece reversal permitting means 34 permits the reversal of the black solid game piece 8 thus causing the black solid game piece 8 to be put, as the solid game piece having the black pentagonal solid graphics, on the intersection point V9. By this movement of the game piece, the second mover game player, by uniting the hollow game piece 12 having a black pentagonal hollow graphics put on the intersection point VII7 and by making the solid game piece 8 having the black pentagonal hollow game piece put on the intersection point IX9 jump over up to the intersection point III9 for uniting as the regular doubly united game piece, is also trying to decrease the number of moves of the second mover game player by one move.

Figure 30:
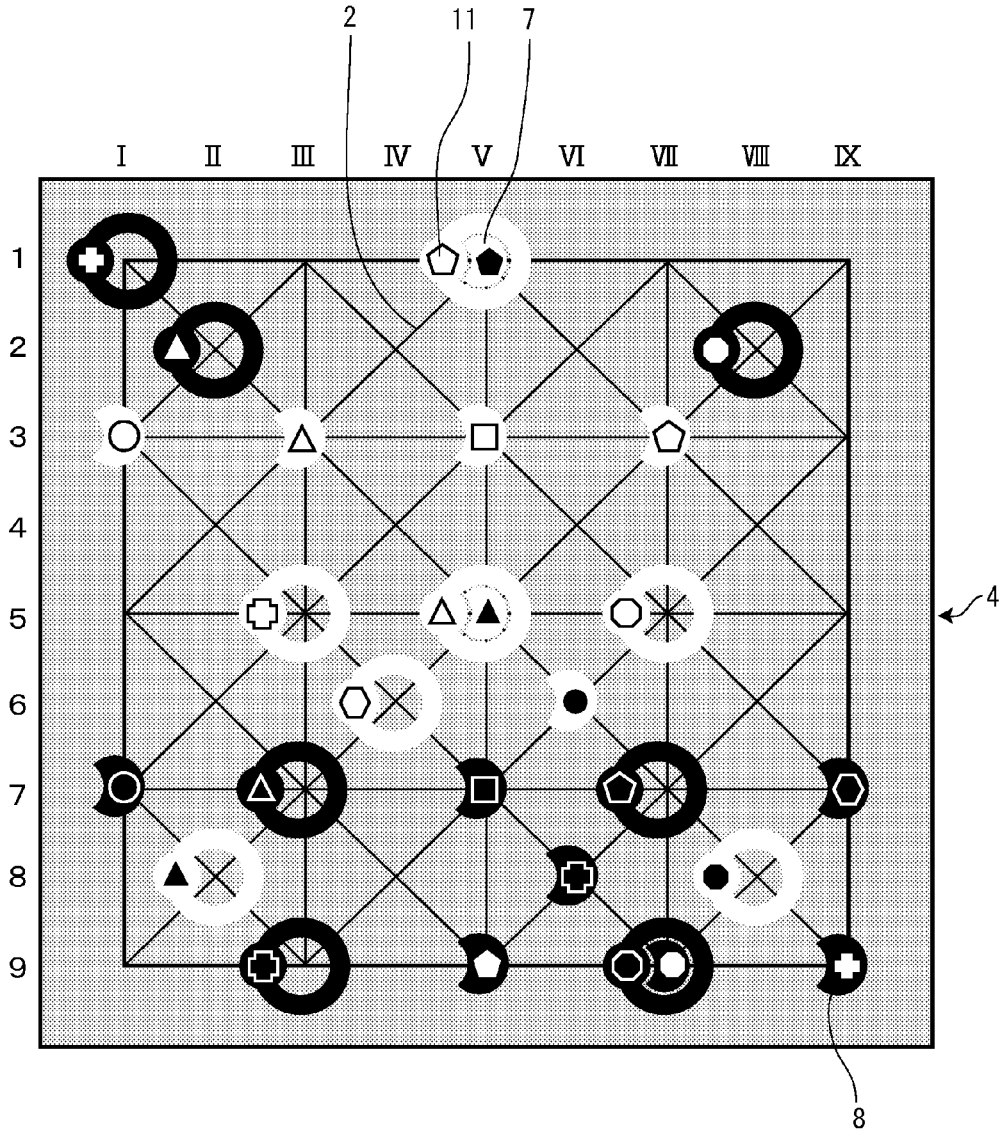
FIG. 30 is a plan view showing a state in which, in one simulation game by the electronic game machine of the embodiment of the present invention, a first mover game player has reversed a solid game piece having a white octagonal hollow graphics and has moved the game piece as a solid game piece having a white pentagonal solid graphics to an intersection point V1.

Next, as shown in FIG. 30, when the first mover game player performs an operation of moving, by using the inputting device, the solid game piece (see FIG. 29) having a white octagonal hollow graphics along the slanted ruled line 2 to the intersection point VI and of reversing the same, the game piece movement permitting means 33 judging the propriety of the movement of the solid game piece 7 to the intersection point VI and the game piece reversal permitting means 34 judges the propriety of the reversal of the white solid game piece. In this situation, since the hollow game piece 11 having a white pentagonal hollow graphics having a contour with the same color and same shape as the white solid game piece 7 at the time of reversal is put on the intersection point VI, the game piece movement permitting means 33 permits the movement of the white solid game piece 7 to the intersection point VI and, therefore, the solid game piece 7 and hollow game piece 11 are put on the intersection point VI in a state where the white solid game piece 7 and the white hollow game piece 11 are united with each other. Moreover, if the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 15 points are given as the obtained score and a total score obtained of the white game pieces is summed up by the score summing-up means 38 and stored in the storing device 23.

Figure 31:
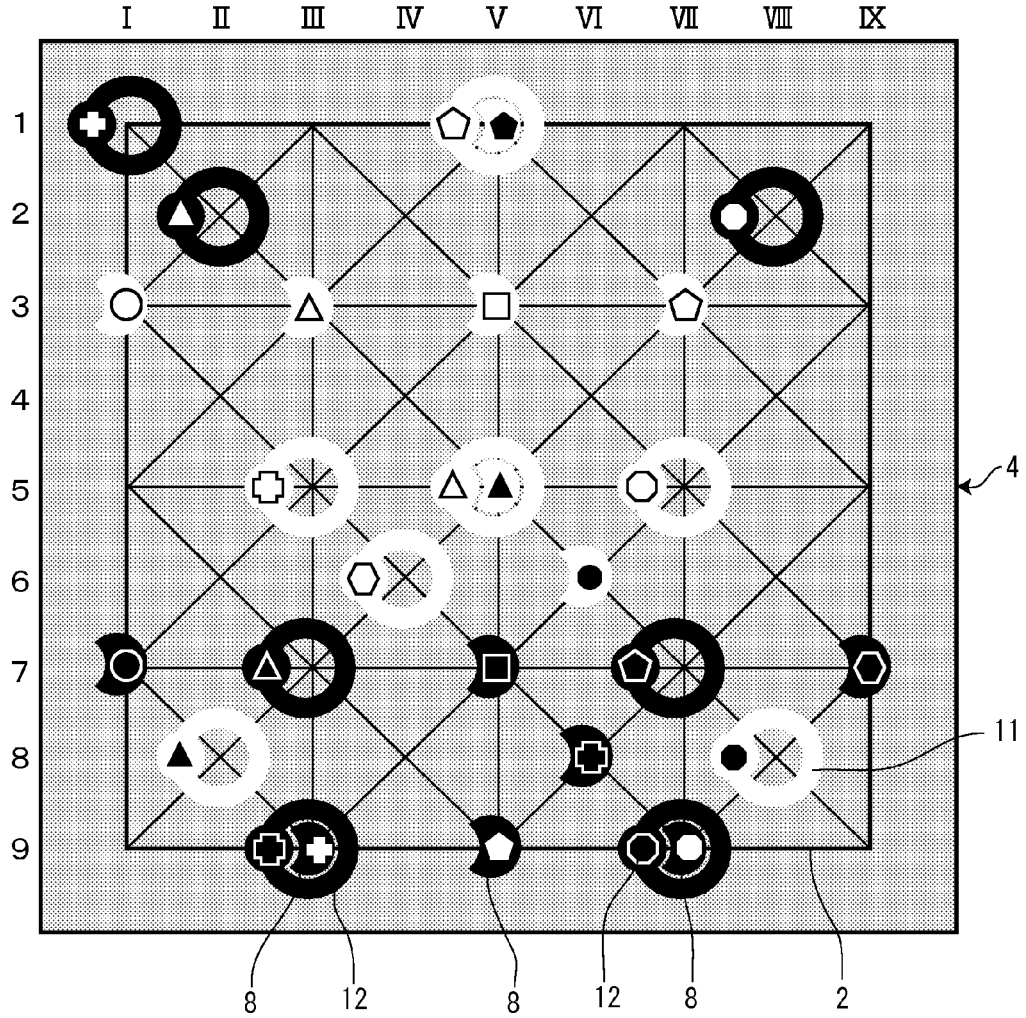
FIG. 31 is a plan view showing a state in which, in one simulation game by the electronic game machine of the embodiment of the present invention, a second mover game player has reversed a solid game piece having a black cross-shaped solid graphics and has moved the game piece to an intersection point III9.

Then, as shown in FIG. 31, when the second mover game player performs an operation of moving, by using the inputting device, the solid game piece 8 having a black octagonal cross-shaped graphics along the horizontal ruled line 2 to the intersection point III9 by jumping over the black regular doubly game pieces 8 and 12 and black solid game piece 8 the game piece movement permitting means 33 judges the propriety of the movement of the black solid game piece 7 to the intersection point III9. In this situation, since the hollow game piece 12 having a black cross-shaped graphics having a contour with the same color and same shape as the black solid game piece 8 is put on the intersection point HIV, the game piece movement permitting means 33 permits the movement of the solid game piece 8 to the intersection point III9 and, therefore, the solid game piece 8 and hollow game piece 12 are put on the intersection point III9 in a state where the solid game piece 8 and the hollow game piece 12 are united with each other. Moreover, if the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 15 points are given as the obtained score and a total score obtained of the white game pieces is summed up by the score summing-up means 38 and stored in the storing device 23.

Figure 32:
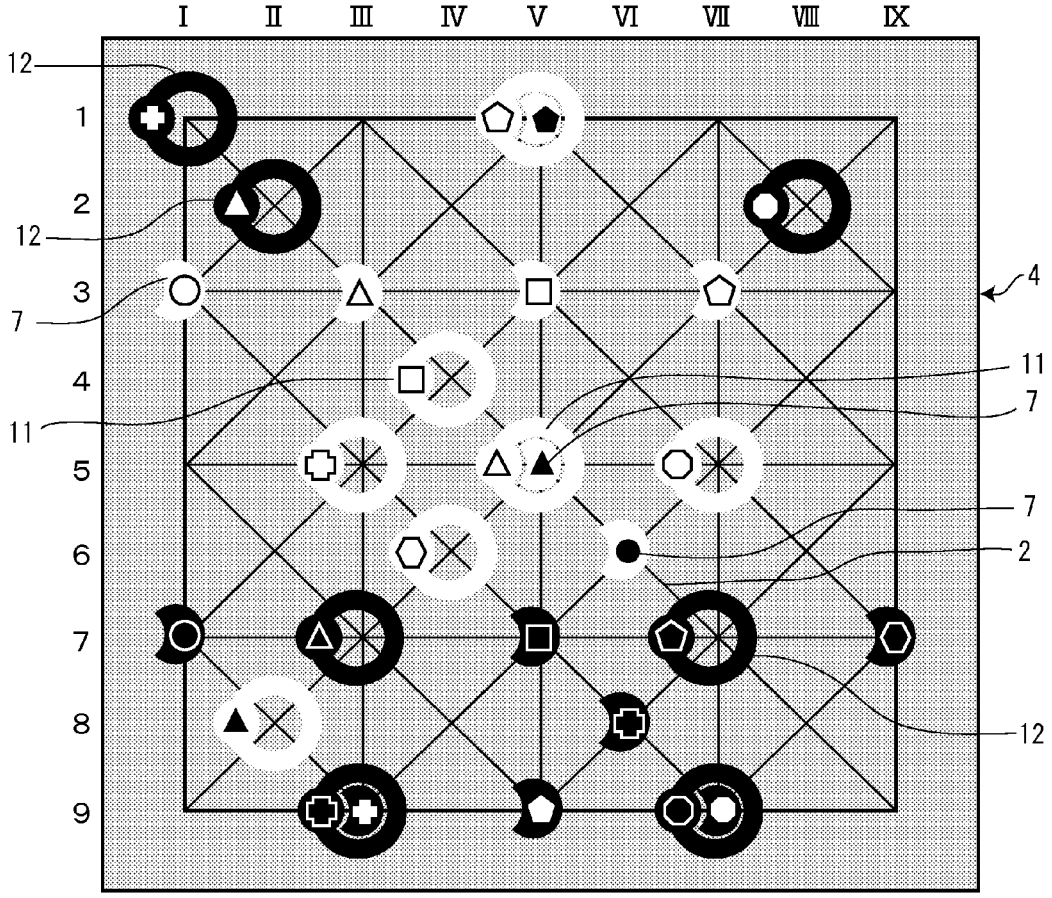
FIG. 32 is a plan view showing a state in which, in one simulation game by the electronic game machine of the embodiment of the present invention, a first mover game player has reversed a hollow game piece having a white octagonal solid graphics and has moved the game piece as a hollow game piece having a black cross-shaped solid graphics to an intersection point IV4.

Next, as shown in FIG. 32, when the first mover game player predicts that the second mover game player moves the hollow game piece 12 having a black cross-shaped solid graphics put on the intersection point I1 or the hollow game piece 12 having a black triangular solid graphics put on the intersection point I1, performs an operation, in order to unite the solid game piece 7 having a white quadrangular solid graphics obtained by reversing the solid game piece having a white circular hollow graphics put on the intersection point I3 to form a regular doubly united game piece, of moving, by using the inputting device 25, the hollow game piece 11 (see FIG. 31) having a white octagonal solid graphics along the slanted ruled line 2 by jumping over the black hollow game piece 12, white solid game piece 7, regular doubly united game piece by uniting the white solid game piece 7 and white hollow piece 11 to the intersection point IV4 and of reversing the same, the game piece movement permitting means 33 judges the propriety of the movement of the white hollow game piece 11 to the intersection point IV4 and the game piece reversal permitting means 34 judges the propriety of the reversal of the white hollow game piece. In this situation, since no game piece having any color is put on the intersection point V4, the game piece movement permitting means 33 permits the movement of the white solid game piece and the game piece reversal permitting means 34 permits the reversal of the white hollow game piece 11 and, as a result, the white hollow game piece 11 is put, as the solid game piece having the white quadrangular graphics, on the intersection point V4.

Figure 33:
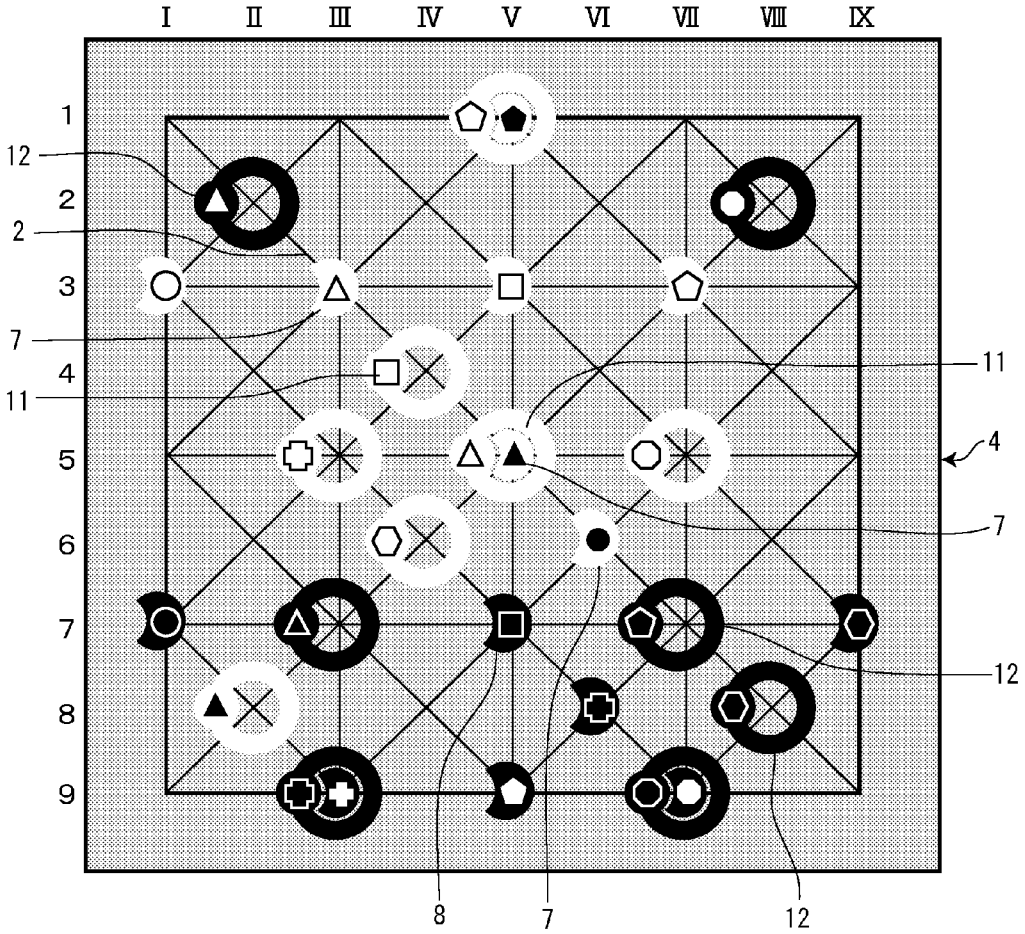
FIG. 33 is a plan view showing a state in which, in one simulation game by the electronic game machine of the embodiment of the present invention, a second mover game player has reversed a hollow game piece having a black cross-shaped solid graphics and has moved the game piece as a hollow game piece having a black hexagonal hollow graphics to an intersection point VIII8.

Then, as shown in FIG. 33, when the second mover game player performs an operation of moving, by using the inputting device, the hollow game piece 12 (see FIG. 32) having a black cross-shaped solid graphics along the horizontal ruled line 2 to the intersection point VIII8, the game piece movement permitting means 33 judges the propriety of the movement of the black hollow game piece 12 to the intersection point VIII8 and the game piece reversal permitting means 34 judges the propriety of the black hollow game piece 12 thus causing the black hollow game piece 12 to be put, as the black game piece 12 having the black hexagonal graphics, on the intersection point VIII8.

By this movement of the game piece, the second mover game player reverses the solid game piece 8 having a black quadrangular drawing and moves it as the solid game piece 8 having a black hexagonal solid graphics and, on the intersection point IX7, these game pieces are united as the regular doubly united game piece.

Figure 34:
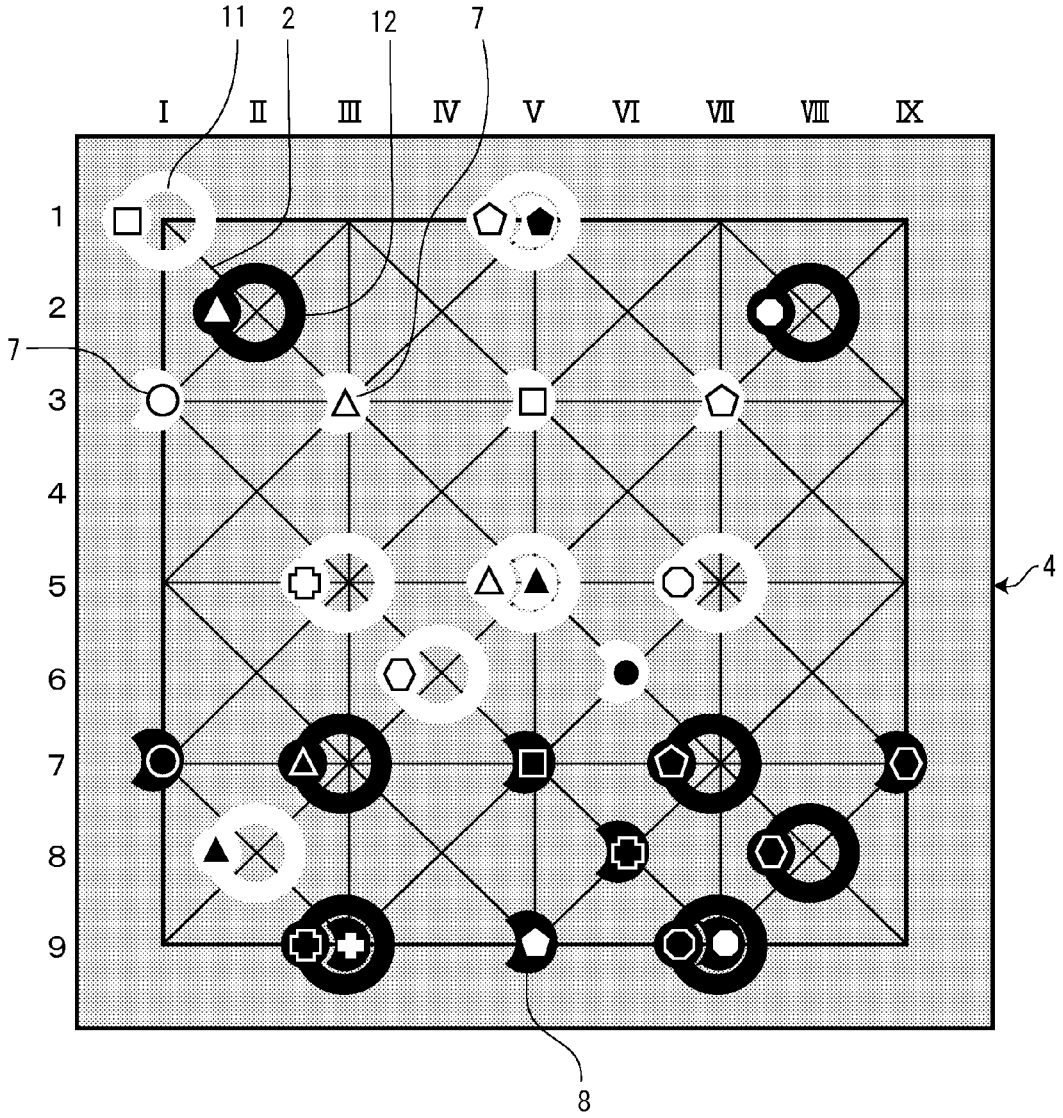
FIG. 34 is a plan view showing a state in which, in one simulation game by the electronic game machine of the embodiment of the present invention, a first mover game player has reversed a hollow game piece having a white quadrangular hollow graphics and has moved the game piece to an intersection point I1.

Then, as shown in FIG. 34, when the first mover game player performs an operation of moving, by using the inputting device, the hollow game piece 11 (see FIG. 33) having a white quadrangular hollow graphics along the slanted ruled line 2 to the intersection point I1, the game piece movement permitting means 33 judges the propriety of the movement of the white hollow game piece 11 to the intersection point 11. In this situation, the game piece movement permitting means 33 permits the movement of the white hollow game piece 11 to the intersection point I1 and, as a result, the white hollow game piece is put at the intersection point I1.

By this movement of the game piece, the first mover game player reverses the solid game piece 7 having a white circular graphics and moves it as the solid game piece 7 having a white quadrangular solid graphics and, on the intersection point I3, these game pieces are united to form the regular doubly united game piece.

Figure 35:
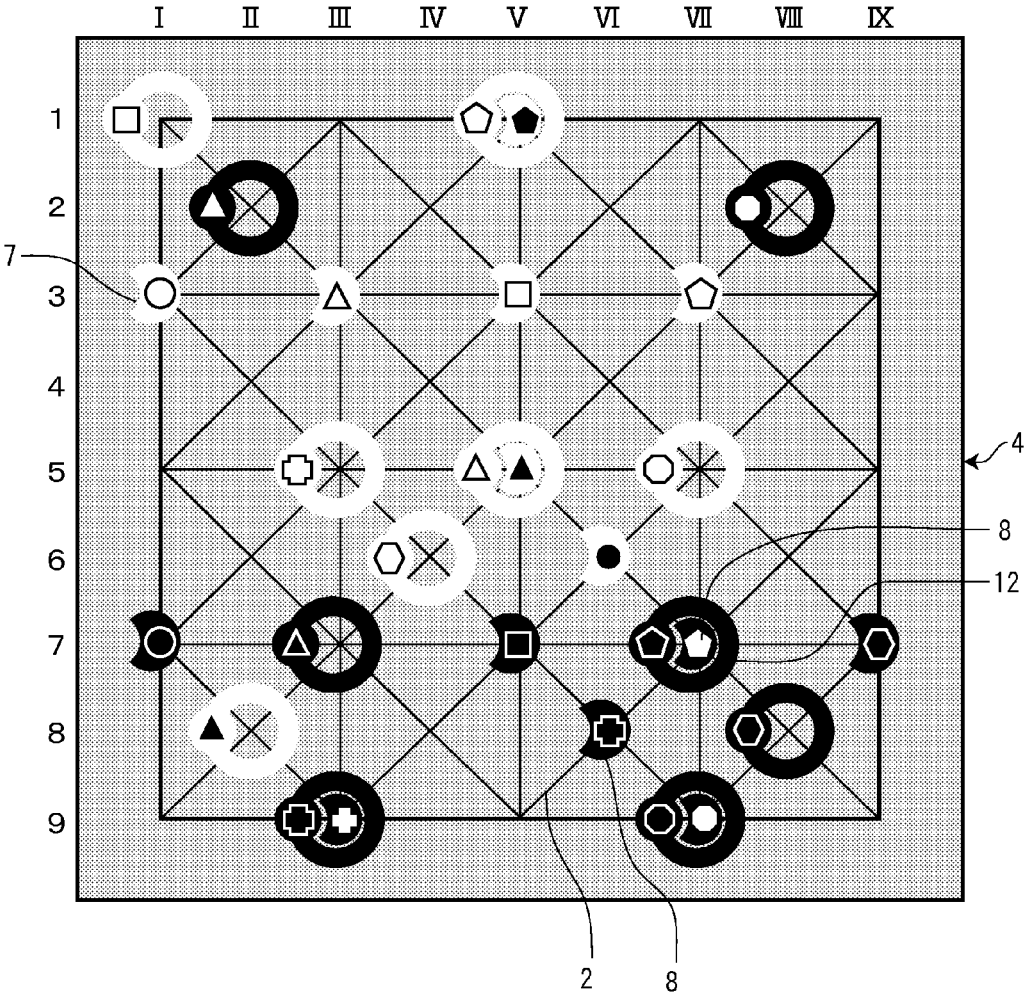
FIG. 35 is a plan view showing a state in which, in one simulation game by the electronic game machine of the embodiment of the present invention, a second mover game player has reversed a solid game piece having a black pentagonal solid graphics and has moved the game piece to an intersection point VII7.

Next, as shown in FIG. 35, when the second mover game player performs an operation of moving, by using the inputting device 25, the solid game piece 8 (see FIG. 34) having a black pentagonal solid graphics along the slanted ruled line to the intersection point VII7, the game piece movement means 33 judges the propriety of the movement of the black solid game piece 8 to the intersection point VII7. In this situation, since the hollow game piece 12 having a white pentagonal hollow graphics having a contour with the same color and same shape is put on the intersection point VII7, the game piece movement permitting means 33 permits the movement of the solid game piece 8 to the intersection point VII7 and, therefore, the solid game piece 8 and hollow game piece 12 are put on the intersection point VI in a state where the solid game piece 8 and the hollow game piece 12 are united with each other and the black solid game piece 8 and black hollow game piece 12 are judged to be united by the game piece uniting judging means 35. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 21 points are given as the obtained score and a total score obtained of the white game pieces is summed up by the score summing-up means 38 and stored in the storing device 23.

Figure 36:
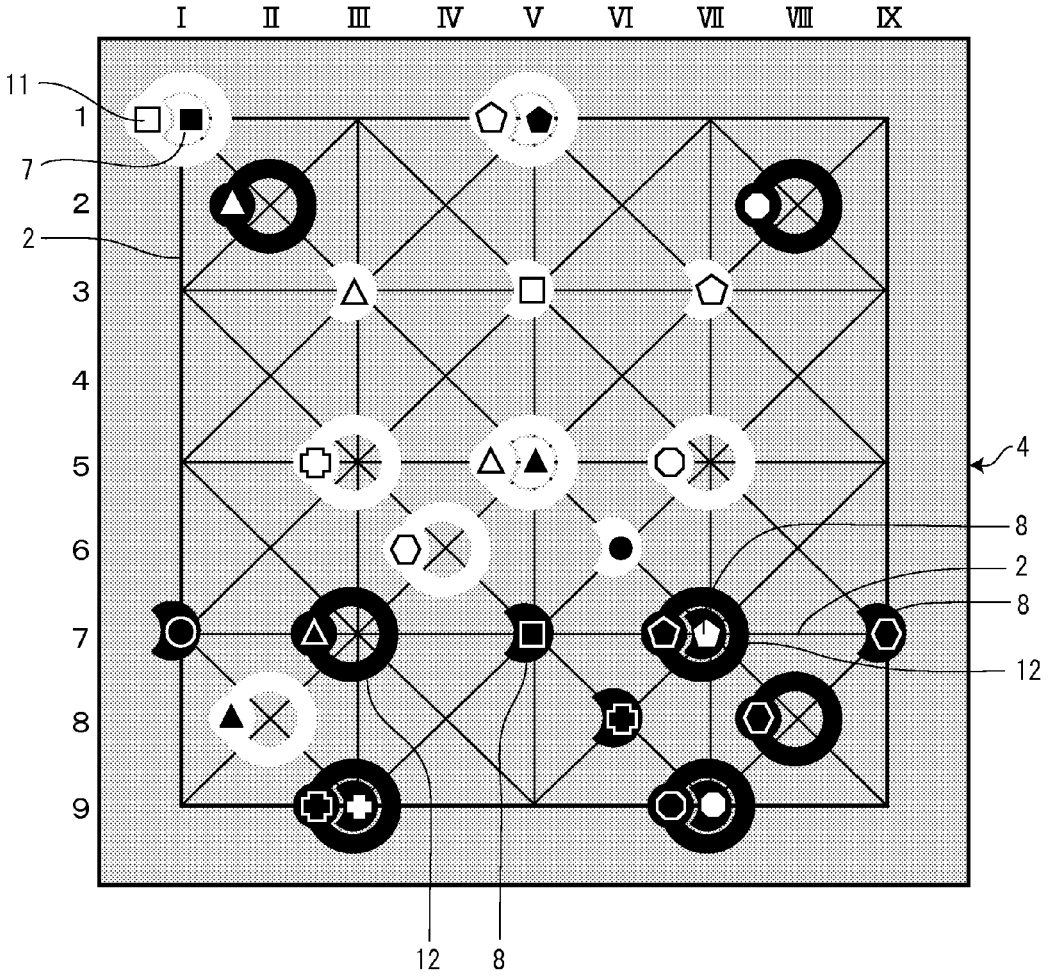
FIG. 36 is a plan view showing a state in which, in one simulation game by the electronic game machine of the embodiment of the present invention, a first mover game player has reversed a solid game piece having a white circular hollow graphics and has moved the game piece as a solid game piece having a white quadrangular hollow graphics to an intersection point I1.

Then, as shown in FIG. 36, when the first mover game player performs an operation of moving, by using the inputting device 25, the solid game piece 7 (see FIG. 35) having a white circular hollow graphics along the vertical ruled line to the intersection point I1, the game piece movement means 33 judges the propriety of the movement of the white solid game piece 7 to the intersection point I1. In this situation, since the hollow game piece 11 having a white quadrangular hollow graphics having a contour with the same color and same shape at the time of reversal is put on the intersection point I1, the game piece movement permitting means 33 permits the movement of the solid game piece 7 to the intersection point I1 and the game piece reversal permitting means 34 permits the reversal of the solid game piece, therefore, the solid game piece 7 and hollow game piece 11 are put on the intersection point I1 in a state where the solid game piece 7 and the hollow game piece 11 are united with each other and the solid game piece 7 and hollow game piece 11 are judged to be united by the game piece uniting judging means 35. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 11 points are given as the obtained score and a total score obtained of the white game pieces is summed up by the score summing-up means 38 and stored in the storing device 23.

Figure 37:
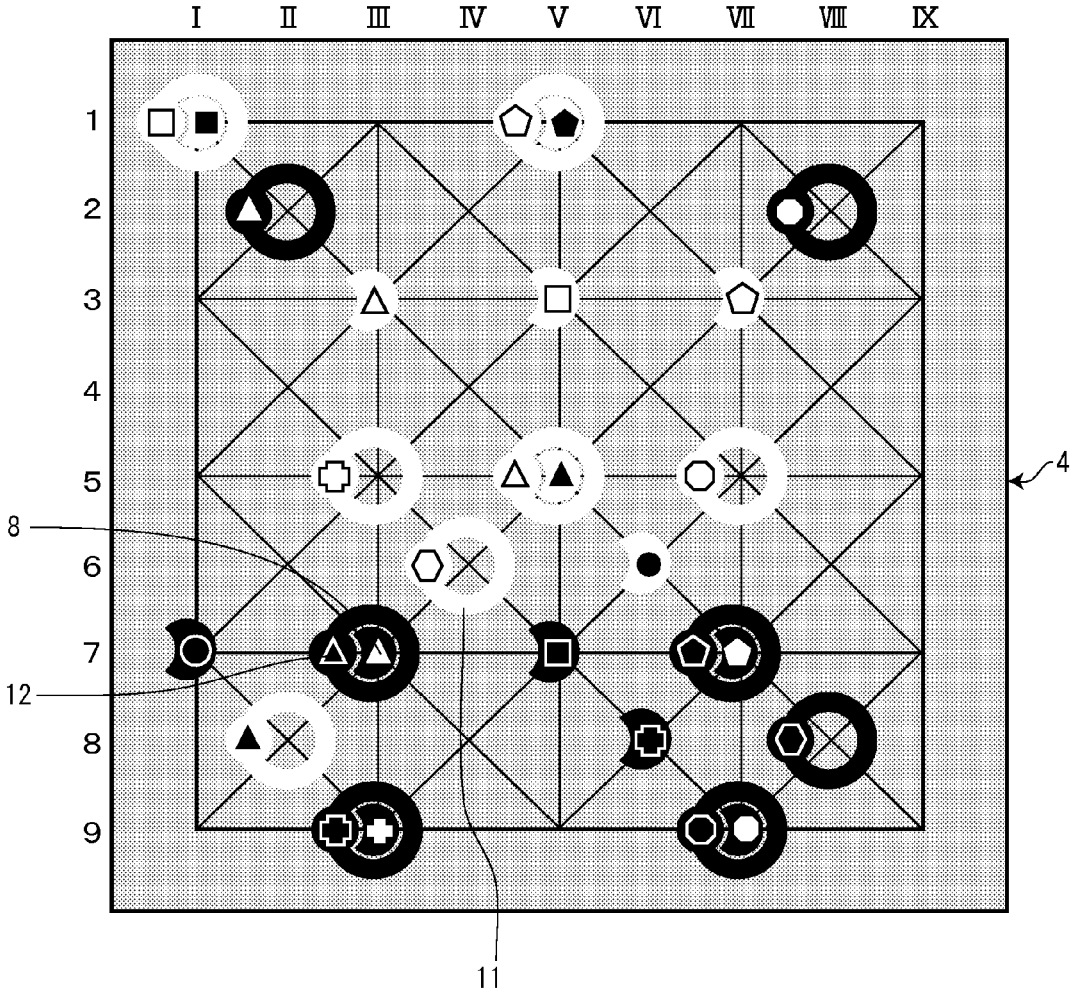
FIG. 37 is a plan view showing a state in which, in one simulation game by the electronic game machine of the embodiment of the present invention, a second mover game player has reversed a hollow game piece having a black hexagonal hollow graphics and has moved the game piece as a solid game piece having a black triangular solid graphics to an intersection point VIII7.

Then, as shown in FIG. 37, when the first mover game player performs an operation of moving, by using the inputting device 25, the solid game piece 8 (see FIG.

36) having a black hexagonal hollow graphics along the horizontal ruled line to the intersection point III7, the game piece movement means 33 judges the propriety of the movement of the black solid game piece 8 to the intersection point III7. In this situation, since the hollow game piece 12 having a black triangular hollow graphics having a contour with the same color and same shape as the solid game piece 8 having the reversed black triangular graphics is put on the intersection point III7, the game piece movement permitting means 33 permits the movement of the solid game piece 8 to the intersection point III7 and the game piece reversal permitting means 34 permits the reversal of the solid game piece 8, therefore, the solid game piece 8 and hollow game piece 12 are put on the intersection point IIIV in a state where the solid game piece 8 and the hollow game piece 12 are united with each other and the black solid game piece 8 and black hollow game piece 12 are judged to be united by the game piece uniting judging means 35. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 21 points are given as the obtained score and a total score obtained of the white game pieces is summed up by the score summing-up means 38 and stored in the storing device 23.

Figure 38:
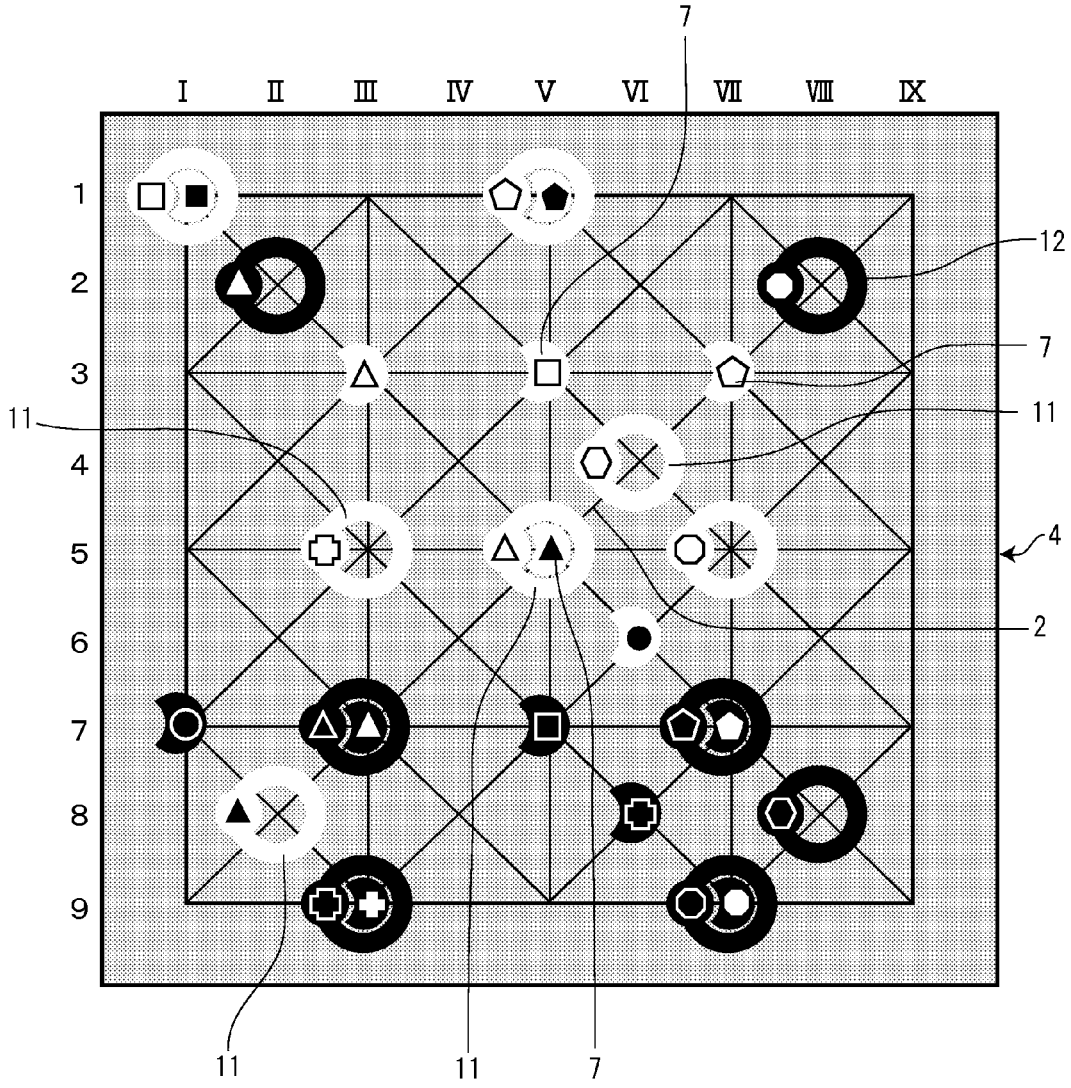
FIG. 38 is a plan view showing a state in which, in one simulation game by the electronic game machine of the embodiment of the present invention, a first mover game player has reversed a hollow game piece having a white hexagonal hollow graphics and has moved the game piece to an intersection point VI4.

Next, as shown in FIG. 38, when the first mover game player performs an operation of moving, by using the inputting device 25, the hollow game piece 11 having a white hexagonal hollow graphics along the slanted ruled line 2 to the intersection point I1, by jumping over the regular doubly united game piece made up of the white solid game piece 7 and white hollow game piece 11, the game piece movement means 33 judges the propriety of the movement of the white hollow game piece 11 to the intersection point VI4. In this situation, since no game piece having any color is put on the intersection point VI4, the game piece movement permitting means 33 permits the movement of the white hollow game piece 11 and the game piece reversal permitting means 34 permits the reversal of the white hollow game piece 11 and, as a result, the white hollow game piece 11 is put on the intersection point VI4.

Figure 39:
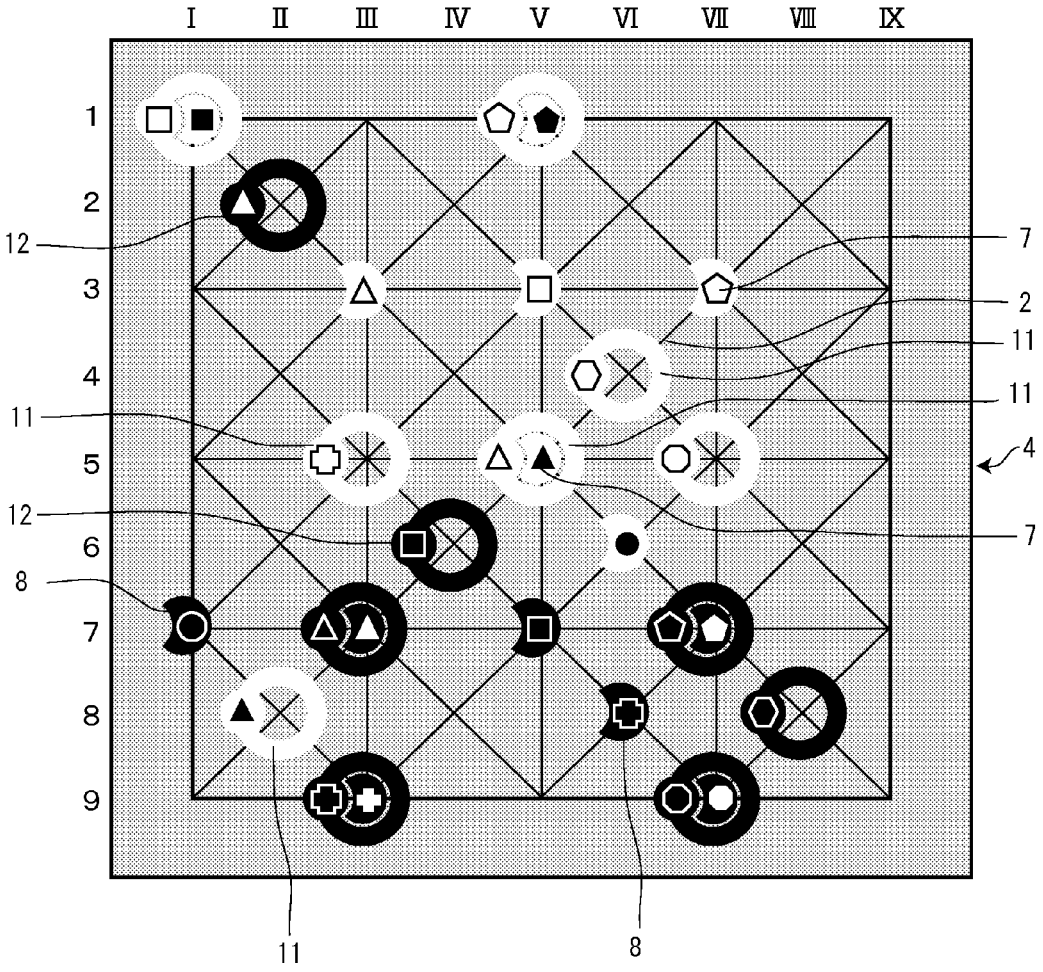
FIG. 39 is a plan view showing a state in which, in one simulation game by the electronic game machine of the embodiment of the present invention, a second mover game player has reversed a hollow game piece having a black octagonal solid graphics and has moved the game piece as a hollow game piece having a black quadrangular hollow graphics to an intersection point IV6.

By this movement, the first mover game player is trying to unite the solid game piece 7 having a white quadrangular hollow graphics put on the intersection point V3 with the solid game piece 7 having the reversed white hexagonal solid graphics to form a regular doubly united game. Moreover, at this point of time, the first mover predicts that the second mover reverses the hollow game piece 12 having a black pentagonal solid graphics to move it as the hollow game piece having the black quadrangular hollow to the intersection point IV6 and, therefore, the first mover is trying to move the hollow game piece 11 having a white triangular solid graphics put on the intersection point II8. Then, if the second mover does not move the hollow game piece 12 having a black quadrangular hollow graphics put on the intersection point VII3, the first mover is trying to reverse the solid game piece 7 having a white pentagonal hollow graphics put on the intersection point VII3 and to move the game piece as the solid game piece 7 having the white cross-shaped solid graphics to the intersection point IV6 and then to unite with the hollow game piece 11 having a white cross-shaped hollow graphics. Then, as shown in FIG. 39, when the second mover predicts that the first mover is reversing the solid game piece 7 having a white pentagonal hollow graphics to move the game piece as the solid game piece 7 having a white cross-shaped solid graphics to the intersection point IV6, in order to hinder the solid game piece 7 having a white cross-shaped solid graphics from being united with the hollow game piece 11 having a white cross-shaped hollow graphics, performs an operation of moving, by using the inputting device 25, the hollow game piece 12 (see FIG. 38) having a black octagonal solid graphics along the slanted ruled line 2 to the intersection point IV6 and reversing the same, the game piece movement permitting means 33 judges the propriety of the movement of the black hollow game piece 12 and the game piece reversal permitting means 34 judges the propriety of the reversal of the black hollow game piece 12. In this situation, no game piece having any color is put on the intersection point IV6, the game piece movement permitting means 33 permits the movement of the black hollow game piece 12 to the intersection point IV6 and further the game piece reversal permitting means 34 permits the reversal of the black hollow game piece 12 and, as a result, the black hollow game piece 12 is put, as the hollow game piece 12 having a black quadrangular hollow graphics, on the intersection point IV6.

After that, the second mover is trying to reverse the solid game piece 8 having a black cross-shaped hollow graphics and to move the reversed solid game piece 8 as the solid game 8 having the black circular solid game graphics up to the intersection point II4 to decrease the number of moves by one move and is trying to unite with the hollow game piece 12 having a black circular hollow graphics obtained by reversing the hollow game piece 12 having a black circular hollow graphics. Moreover, the second mover is making preparation for uniting the hollow game piece 12, as a regular doubly united game piece, having the moved black quadrangular hollow graphics with the solid game piece having a black quadrangular solid graphics obtained by reversing the solid game piece having the black circular hollow graphics put on the intersection point I7.

Figure 40:
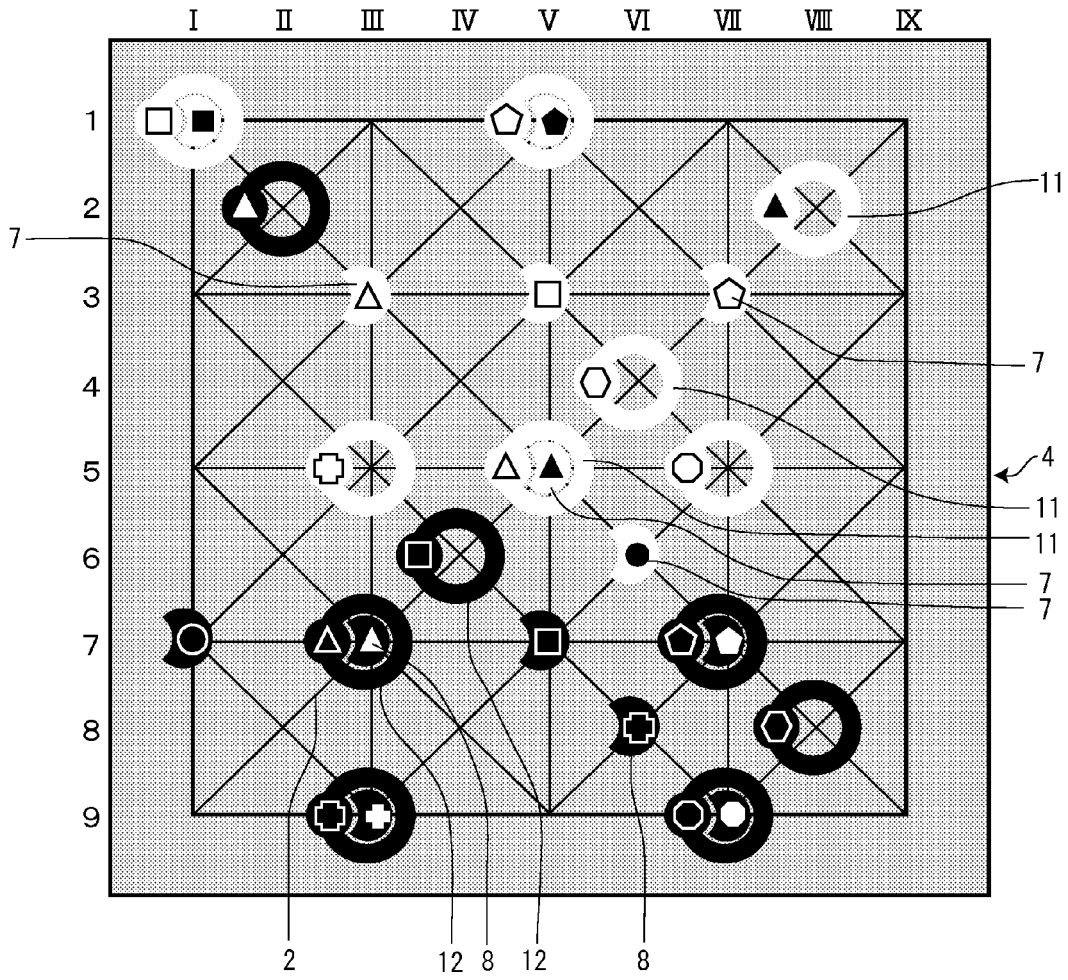
FIG. 40 is a plan view showing a state in which, in one simulation game by the electronic game machine of the embodiment of the present invention, a first mover game player has reversed a hollow game piece having a white triangular solid graphics and has moved the game piece to an intersection point VIII2.

Next, as shown in FIG. 40, when the first mover performs an operation of moving, by using the inputting device 25, the hollow game piece 11 (see FIG. 39) having a white triangular along the slanted ruled line 2 by jumping a regular doubly united game piece made up of the black solid game piece 8, black hollow game piece 12, regular doubly united game piece made up of the white solid game piece 7 and white hollow game piece 11, white hollow game piece 11, and white solid game piece 7 to the intersection point VIII2, the game piece movement permitting means 33 judges the propriety of the movement of the white hollow game piece 11 to the intersection point VIII2. In this situation, since no game piece having any color is put on the intersection point VIII2, the game piece movement permitting means 33 permits the movement of the hollow game piece to the intersection point VIII2 thus causing the white game piece 11 to be put on the intersection point VIII2.

At this point of time, the first mover was planning to unite the hollow game piece 11 having a white circular hollow graphics obtained by reversing the hollow game piece 11 having a white triangular solid graphics put on the intersection point VIII with the solid piece 7 having a white circular solid graphics put on the intersection point VI6 to form a regular doubly united game piece, however, the first mover, since the second mover leads the first mover in scoring, in order for the first mover to again rally in the game, is trying to change the schedule and to decrease the number of moves by one move.

Figure 41:
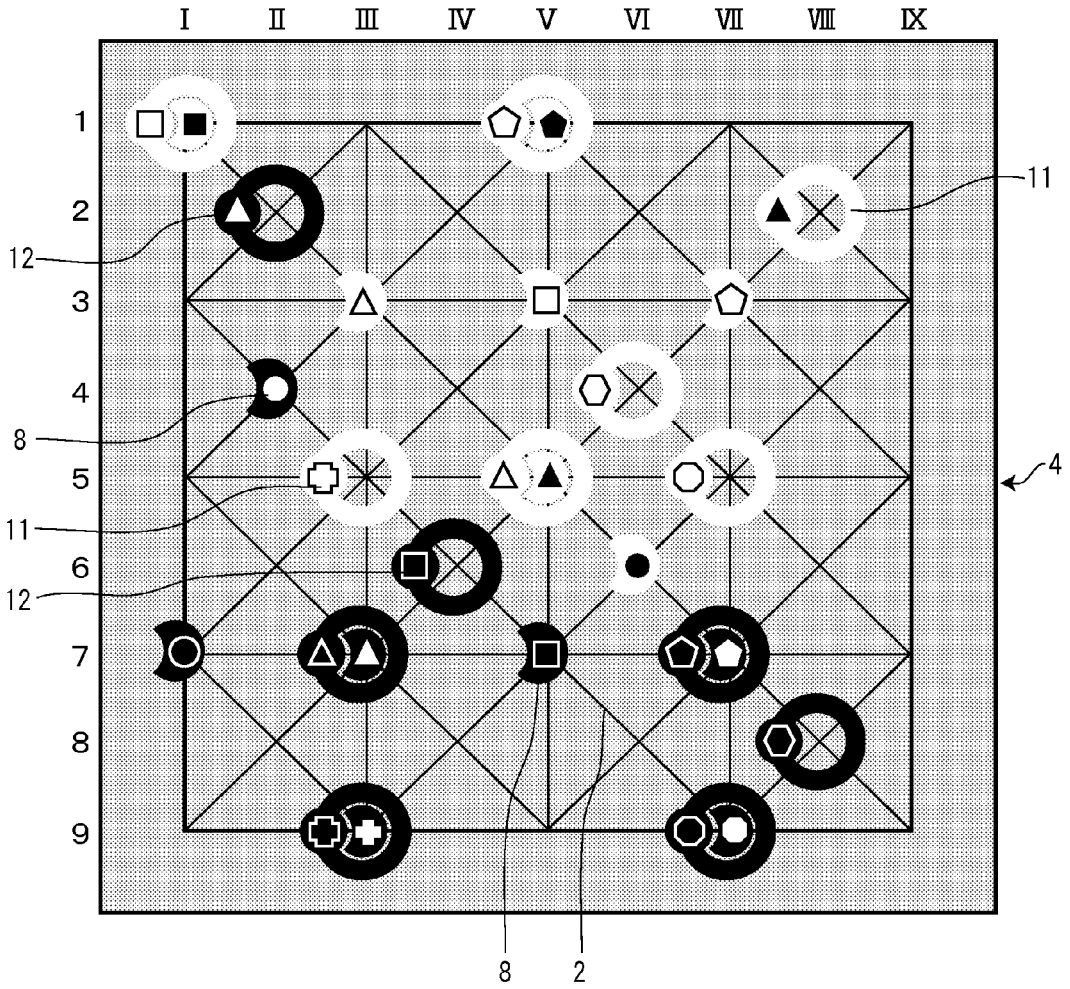
FIG. 41 is a plan view showing a state in which, in one simulation game by the electronic game machine of the embodiment of the present invention, a second mover game player has reversed a solid game piece having a black cross-shaped hollow graphics and has moved the game piece to an intersection point II4.

Then, as shown in FIG. 41, when the second mover, as scheduled, in order to unite with the hollow game piece 12 having a black circular hollow graphics obtained by reversing the hollow game piece 12 having a black triangular solid graphics on the intersection point I3 as a regular doubly united game piece, performs an operation of moving, by using the inputting device 25, the solid game piece having a black cross-shaped hollow graphics and of reversing the same, the game piece movement permitting means 33 judges the propriety of the movement of the black solid game piece 8 to the intersection point II4 and the game piece reversal permitting means 34 judges the propriety of the reversal of the black solid game piece 8. In this situation, no game piece having any color is put on the intersection point II4, the game piece movement permitting means 33 permits the movement of the black solid game piece 8 to the intersection point II4 and further the game piece reversal permitting means 34 permits the reversal of the black solid game piece 8 and, as a result, the black solid game piece 8 is put, as the solid game piece 8 having a black circular quadrangular solid graphics, on the intersection point II4.

Figure 42:
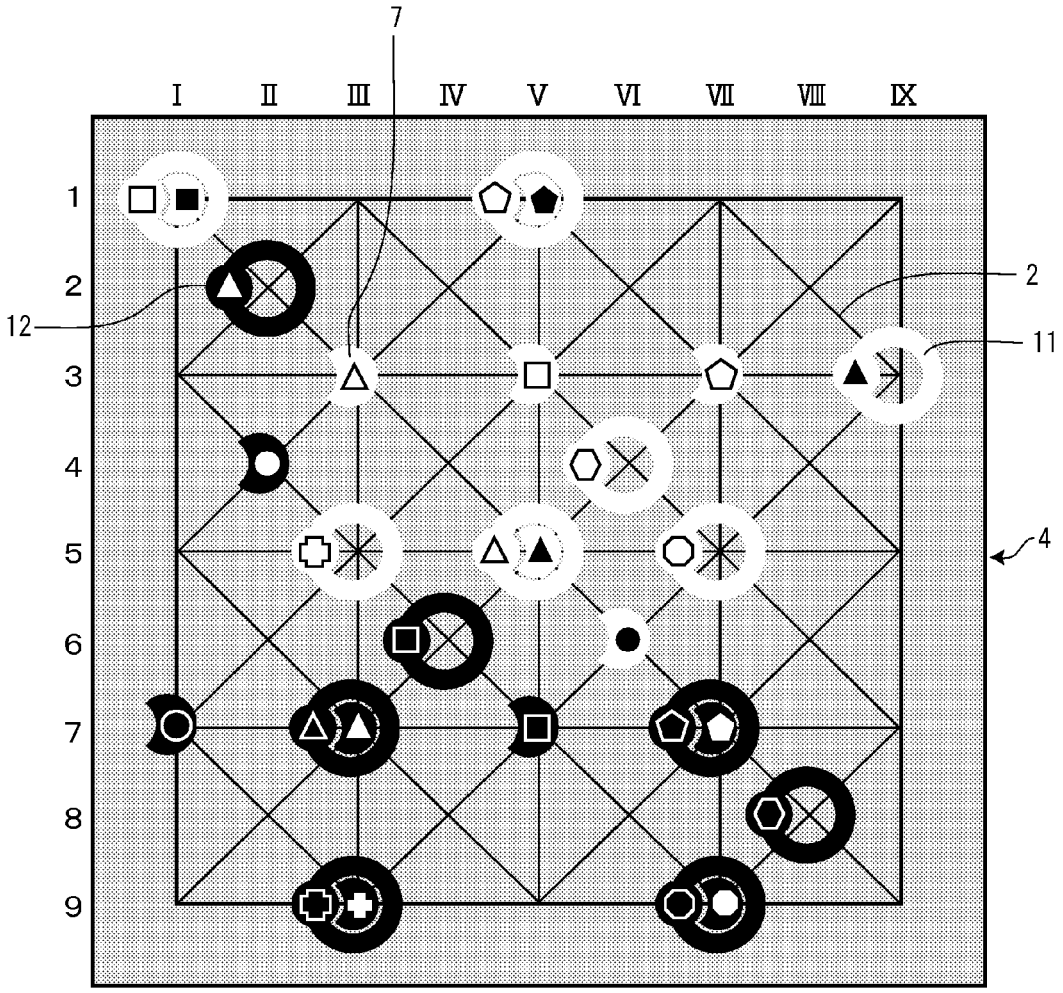
FIG. 42 is a plan view showing a state in which, in one simulation game by the electronic game machine of the embodiment of the present invention, a first mover game player has reversed a hollow game piece having a white triangular solid graphics and has moved the game piece to an intersection point IX3.

Next, as shown in FIG. 42, when the first mover game player, in order to unite with the solid game piece 7 having a white triangular hollow graphics on the intersection point III3 to form a semi-doubly united game piece, performs an operation of moving, by using the inputting device 25, the hollow game piece 11 (see FIG. 41) having a white triangular solid graphics along the slanted ruled line 2 on the intersection point IX3, the game piece movement permitting means 33 judges the propriety of the movement of the white hollow game piece 11 to the intersection point IX3. Since no game piece having any color is put on the intersection point IX3, the game piece movement permitting means 33 permits the movement of the white hollow game piece 11 to the intersection point IX3 thus causing the white hollow game piece 11 to be put on the intersection point IX3.

Figure 43:
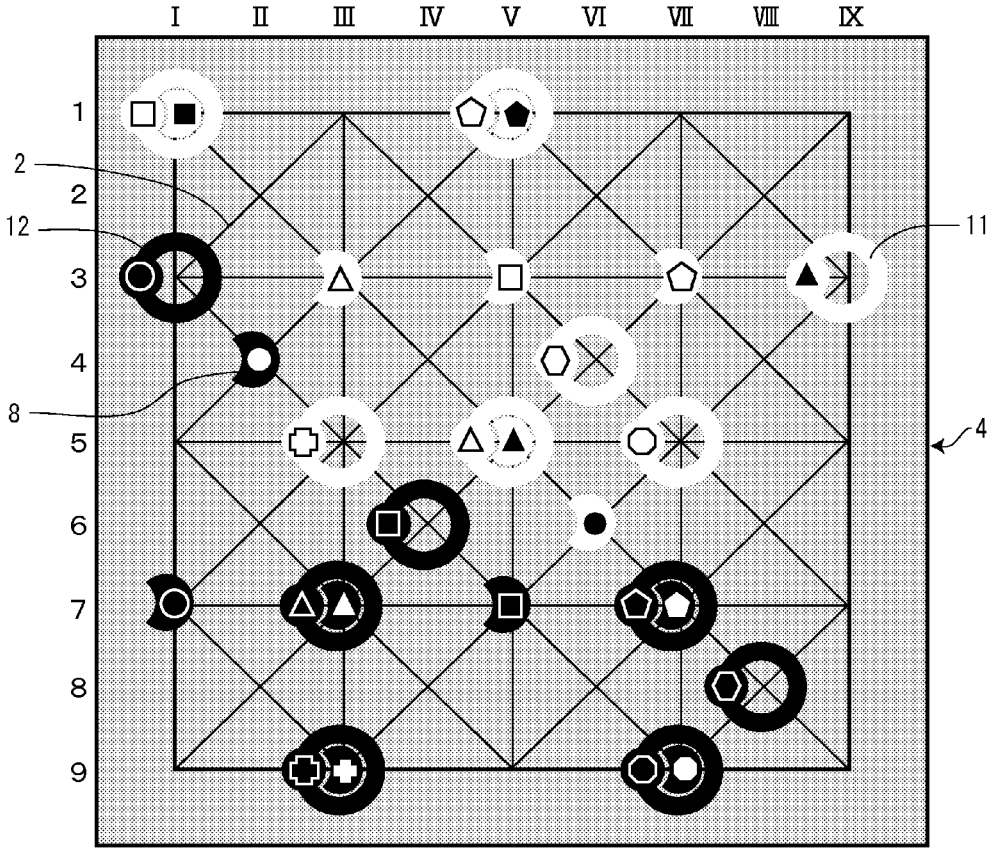
FIG. 43 is a plan view showing a state in which, in one simulation game by the electronic game machine of the embodiment of the present invention, a second mover game player has reversed a hollow game piece having a black triangular solid graphics and has moved the game piece as a hollow game piece having a black circular hollow graphics to an intersection point I3.

Then, as shown in FIG. 43, when the second mover game player, as scheduled, in order to unite with the solid game piece 8 having a black circular solid graphics on the intersection point I3 as a regular doubly united game piece, performs an operation of moving, by using the inputting device 25, the hollow game piece (see FIG. 42) having a black triangular solid graphics along the slanted ruled line 2 to the intersection point I3 and of reversing the same, the game piece movement permitting means 33 judges the propriety of the movement of the black hollow game piece 12 to the intersection point I3 and the game piece reversal permitting means 34 judges the propriety of the reversal of the black hollow game piece to the intersection point I3. In this situation, since no game piece having any color is put on the intersection point I3, the game piece movement permitting means 33 permits the movement of the black hollow game piece 12 to the intersection point I3 and the game piece reversal permitting means 34 permits the reversal of the black hollow game piece 12 thus causing the black hollow game piece 12 to be put as the hollow game piece having the black circular hollow graphics on the intersection point IX3.

Figure 44:
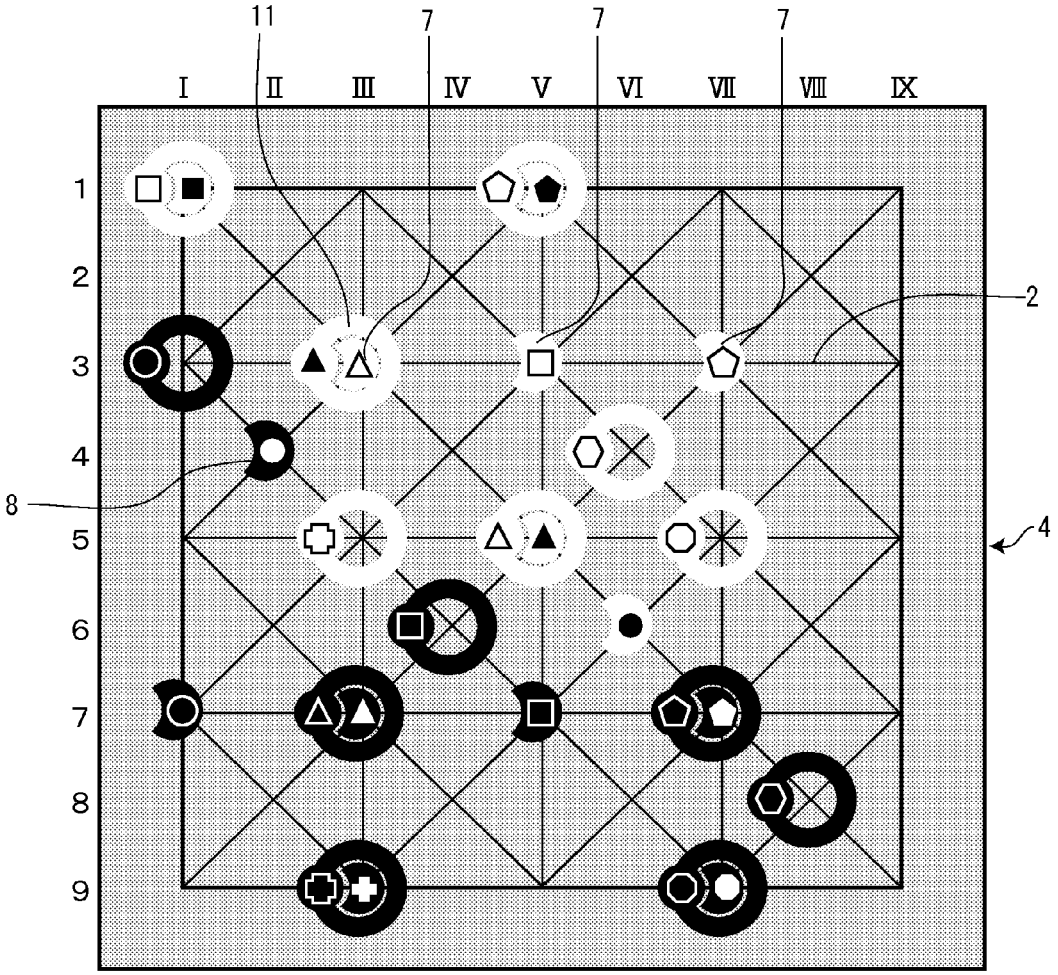
FIG. 44 is a plan view showing a state in which, in one simulation game by the electronic game machine of the embodiment of the present invention, a first mover game player has reversed a hollow game piece having a white triangular solid graphics and has moved the game piece to an intersection point III3.

As shown in FIG. 44, when the first mover game player, as scheduled, performs an operation of moving, by using the inputting device 25, the hollow game piece 11 (see FIG. 43) along the horizontal ruled line 2 to the intersection point III3, the game piece movement permitting means 33 judges the propriety of the movement of the white hollow game piece 11 to the intersection point III3. In this situation, since the solid game piece 7 having a white triangular hollow graphics having a contour with the same color and same shape as the hollow game piece 11 is put on the intersection point III3, the game piece movement permitting means 33 permits the movement of the hollow game piece 11 to the intersection point III3 and, therefore, the solid game piece 7 and hollow game piece 11 are put on the intersection point III3 in a state where the solid game piece 7 and the hollow game piece 11 are united and the solid game piece 7 and hollow game piece 11 are judged by the game piece uniting judging means 35 to be united with each other. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 16 points are given as the obtained score of the black game pieces and a total score obtained of the white game pieces is summed up by the score summing-up means 38 and stored in the storing device 23.

Figure 45:
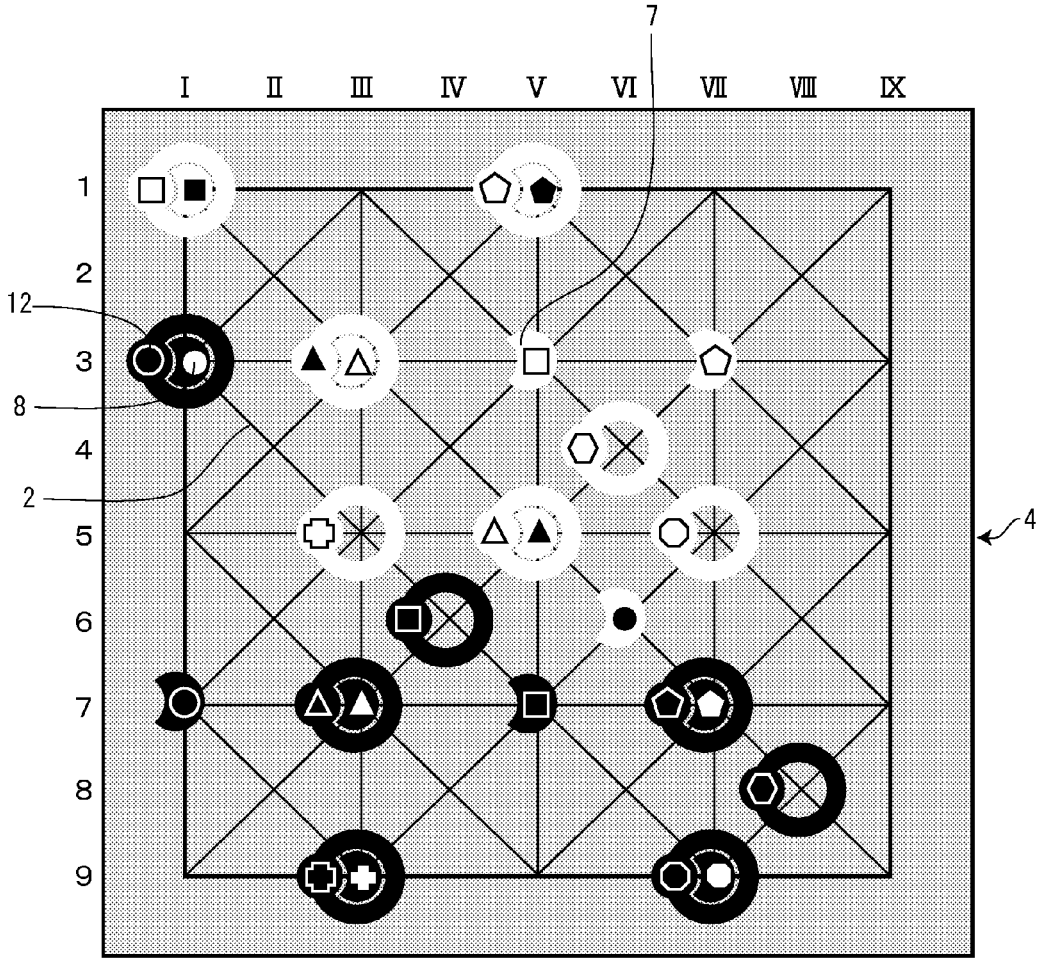
FIG. 45 is a plan view showing a state in which, in one simulation game by the electronic game machine of the embodiment of the present invention, a second mover game player has reversed a solid game piece having a black cross-shaped solid graphics and has moved the game piece to an intersection point I3.

Then, as shown in FIG. 45, when the second mover game player, as scheduled, performs an operation of moving, by using the inputting device 25, the solid game piece 8 (see FIG. 44) having a black circular graphics along the slanted ruled line 2 to the intersection point I3, the game piece movement permitting means 33 judges the propriety of the movement of the black solid game piece 8 to the intersection point I3. In this situation, since the hollow game piece 12 having a black circular hollow graphics having a contour with the same color and same shape as the black solid game piece 8 is put on the intersection point I3, the game piece movement permitting means 33 permits the movement of the solid game piece 8 to the intersection point I3 and therefore, the solid game piece 8 and hollow game piece 12 are put on the intersection point I3 in a state where the solid game piece 8 and the hollow game piece 12 are united and the black solid game piece 8 and black hollow game piece 12 are judged by the game piece uniting judging means 35 to be united with each other. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 score points), 15 points are given as the obtained score of the black game pieces and a total score obtained of the black game pieces is summed up by the score summing-up means 38 and stored in the storing device 23.

Figure 46:
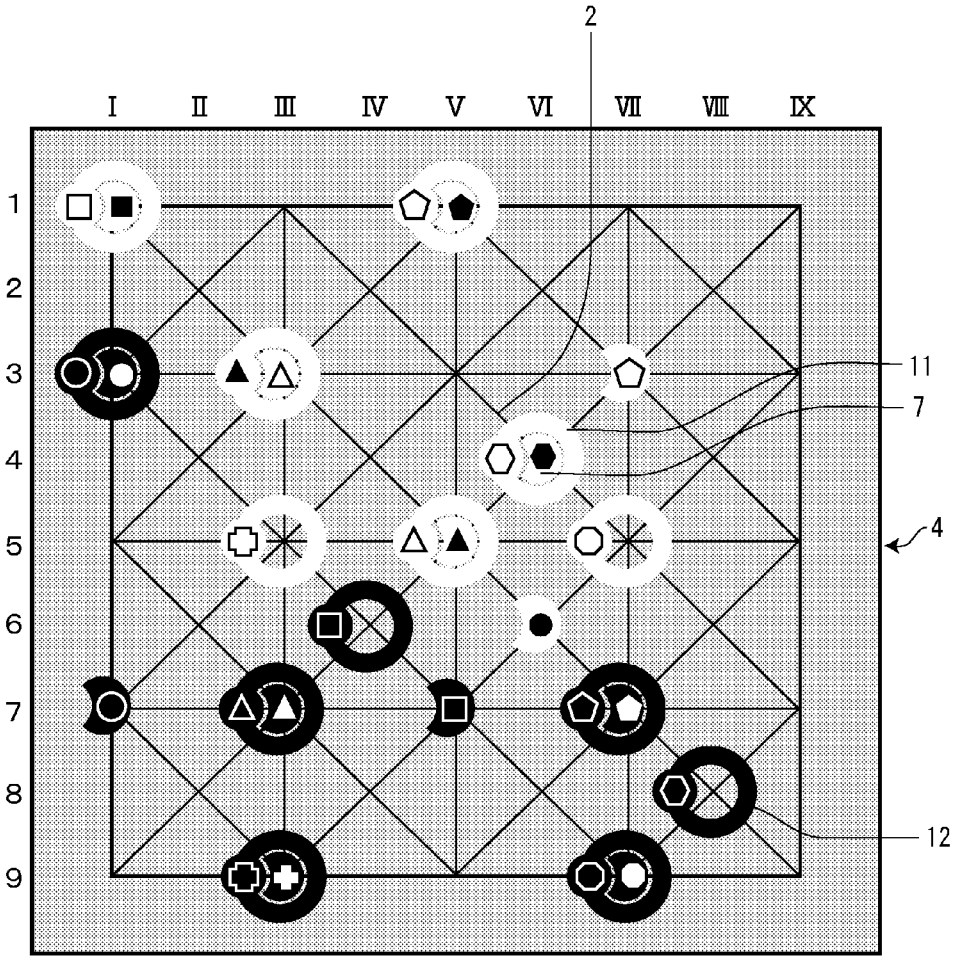
FIG. 46 is a plan view showing a state in which, in one simulation game by the electronic game machine of the embodiment of the present invention, a first mover game player has reversed a solid game piece having a white quadrangular hollow graphics and has moved the game piece as a solid game piece having a white hexagonal solid graphics to an intersection point VI4.

Then, as shown in FIG. 46, when the first mover game player, as scheduled, performs an operation of moving, by using the inputting device 25, the solid game piece 7 (see FIG. 45) having a white quadrangular graphics along the slanted ruled line 2 to the intersection point VI4 and of reversing the same, the game piece movement permitting means 33 judges the propriety of the movement of the white solid game piece 7 to the intersection point VI4. In this situation, since the hollow game piece 11 having a white hexagonal hollow graphics having a contour with the same color and same shape as the white solid game piece 7 at the time of reversal is put on the intersection point VI4, the game piece movement permitting means 33 permits the movement of the white solid game piece 7 to the intersection point VI4 and the game piece reversal permitting means 34 permits the reversal of the white solid game piece 7 and, therefore, the solid game piece 7 and hollow game piece 11 are put on the intersection point VI4 in a state where the solid game piece 7 and the hollow game piece 11 are united with each other and the black solid game piece 7 and black hollow game piece 11 are judged by the game piece uniting judging means 35 to be united with each other. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 score points), 13 points are given as the obtained score of the white game pieces and a total score obtained of the white game pieces is summed up by the score summing-up means 38 and stored in the storing device 23.

Figure 47:
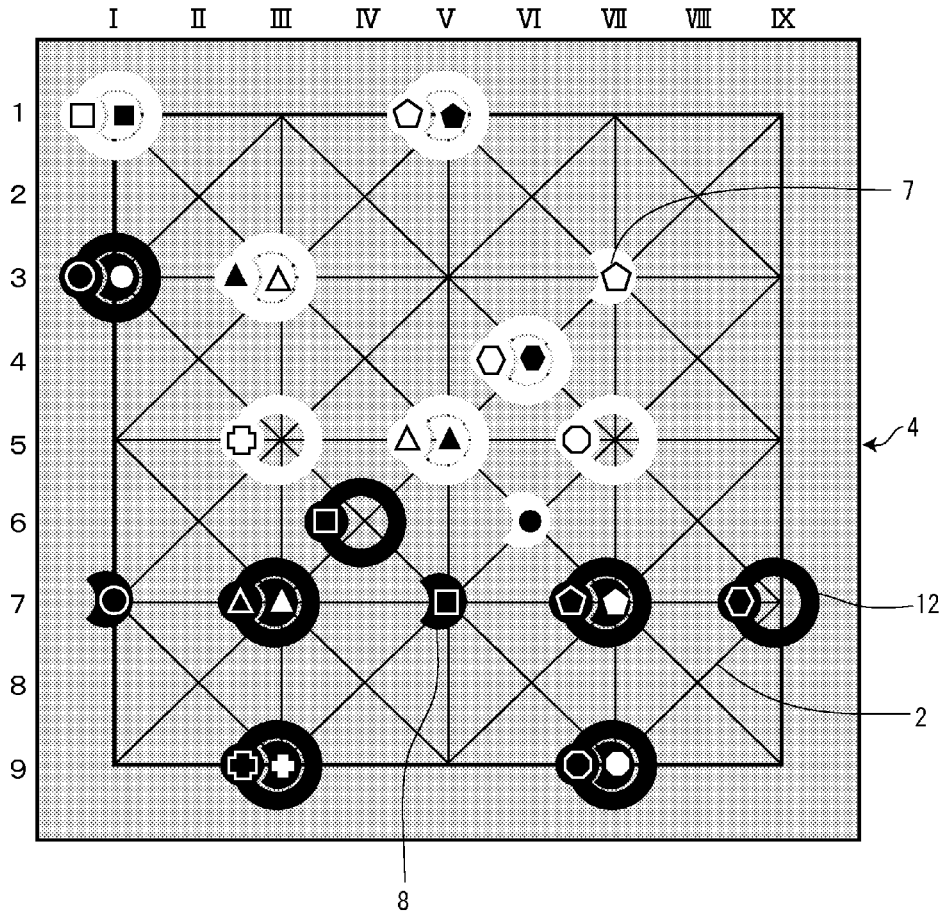
FIG. 47 is a plan view showing a state in which, in one simulation game by the electronic game machine of the embodiment of the present invention, a second mover game player has reversed a hollow game piece having a black hexagonal hollow graphics and has moved the game piece to an intersection point IX7.
Figure 48:
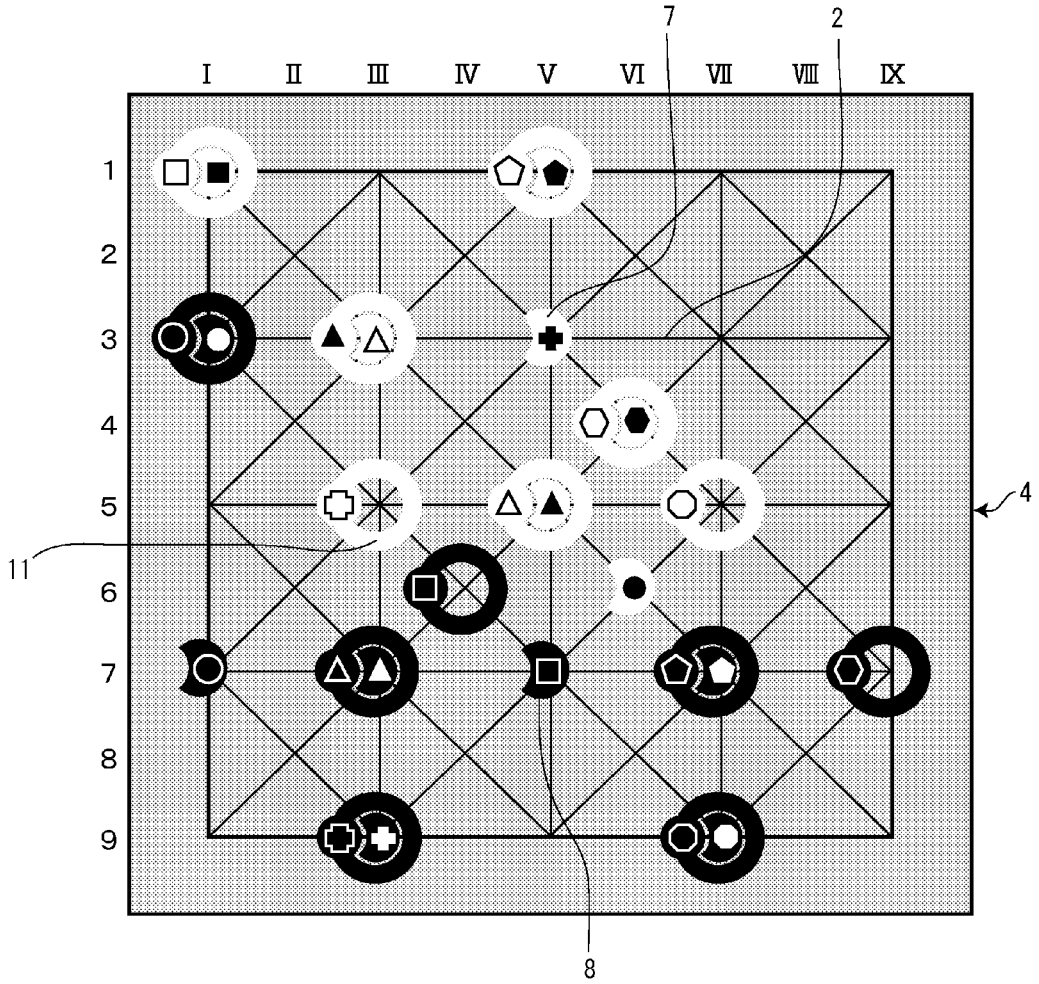
FIG. 48 is a plan view showing a state in which, in one simulation game by the electronic game machine of the embodiment of the present invention, a first mover game player has reversed a solid game piece having a white pentagonal hollow graphics and has moved the game piece as a solid game piece having a white cross-shaped solid graphics to an intersection point V3.

Next, as shown in FIG. 47, when the second mover performs an operation of reversing the solid game piece 8 having a black quadrangular hollow graphics of moving the game piece to the intersection point IX7 as the solid game piece 8 having a black hexagonal solid graphics put on the intersection point IX7 and, in order to unite the game pieces as a regular doubly united game piece, an operation of moving the hollow game piece 12 (see FIG. 46) having a black hexagonal hollow graphics, the game piece movement permitting means 33 judges the propriety of the movement of the black hollow game piece 12 to the intersection point IX7. In this situation, since no game piece having any color is put on the intersection point IX7, the game piece movement permitting means 33 permits the movement of the black hollow game piece 12 to the intersection point IX7, causing the black hollow game piece 12 to be put on the intersection point IX7. Since the second mover has now held a dominant position in the game from the opening of the game, the second mover puts forward the game thus making sure of wining Then, as shown in FIG. 48, when the first mover, by using the inputting device 25, performs an operation of moving the solid game piece 7 (see FIG. 47) having a white pentagonal hollow graphics along the horizontal ruled line 2 to the intersection point V3 and of reversing the same, the game piece movement permitting means 33 judges the propriety of the movement of the white solid game piece 7 to the intersection point V3 and the game piece reversal permitting means 34 judges the propriety of the reversal of the white solid game piece 7.

In this situation, since no game piece having any color is put on the intersection point V3, the game piece movement permitting means 33 permits the movement of the white solid game piece 7 to the intersection point V3 and the game piece reversal means 34 permits the reversal of the white solid game piece 7, thus causing the white solid game piece to be put on the intersection point V3. After that, the first mover is trying to unite the white solid game piece with the hollow game piece 11 having a white cross-shaped hollow game piece put on the intersection point III5 to form a regular doubly united game, however, the first mover is already aware of the defeat in the game and of impossibility of uniting both the game pieces.

Figure 49:
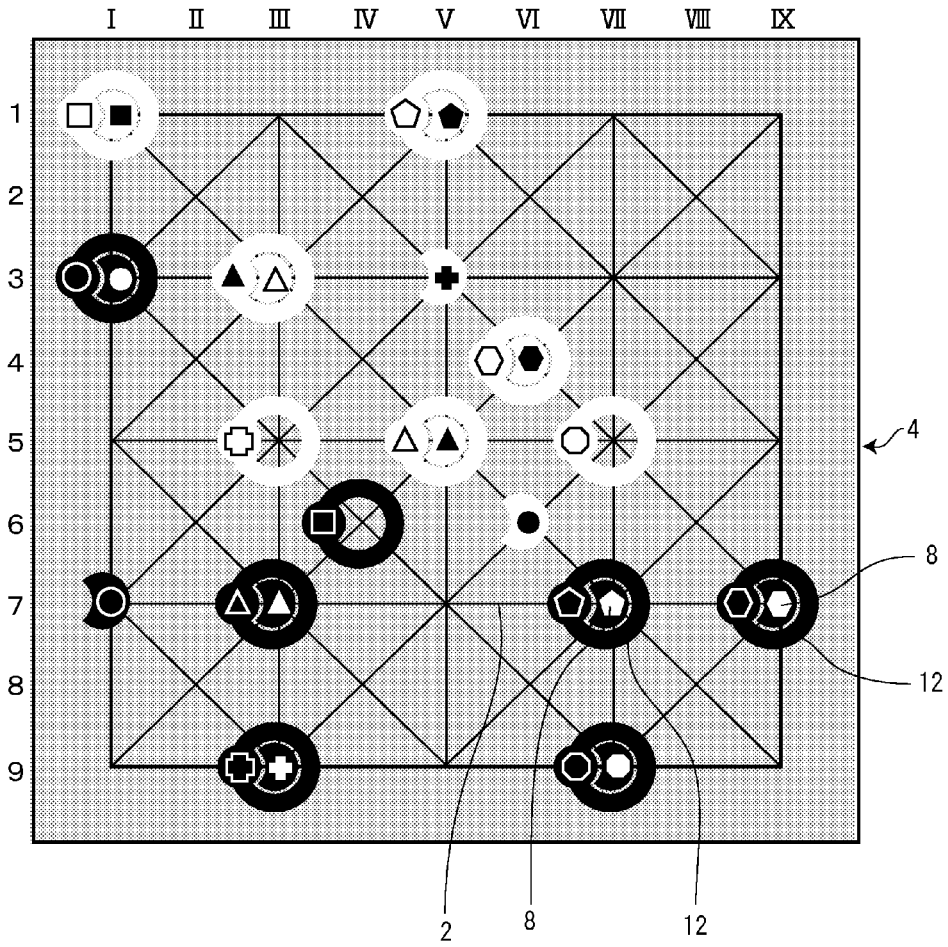
FIG. 49 is a plan view showing a state in which, in one simulation game by the electronic game machine of the embodiment of the present invention, a second mover game player has reversed a solid game piece having a black quadrangular hollow graphics and has moved the game piece as a solid game piece having a black hexagonal solid graphics to an intersection point IX7.
Figure 50:
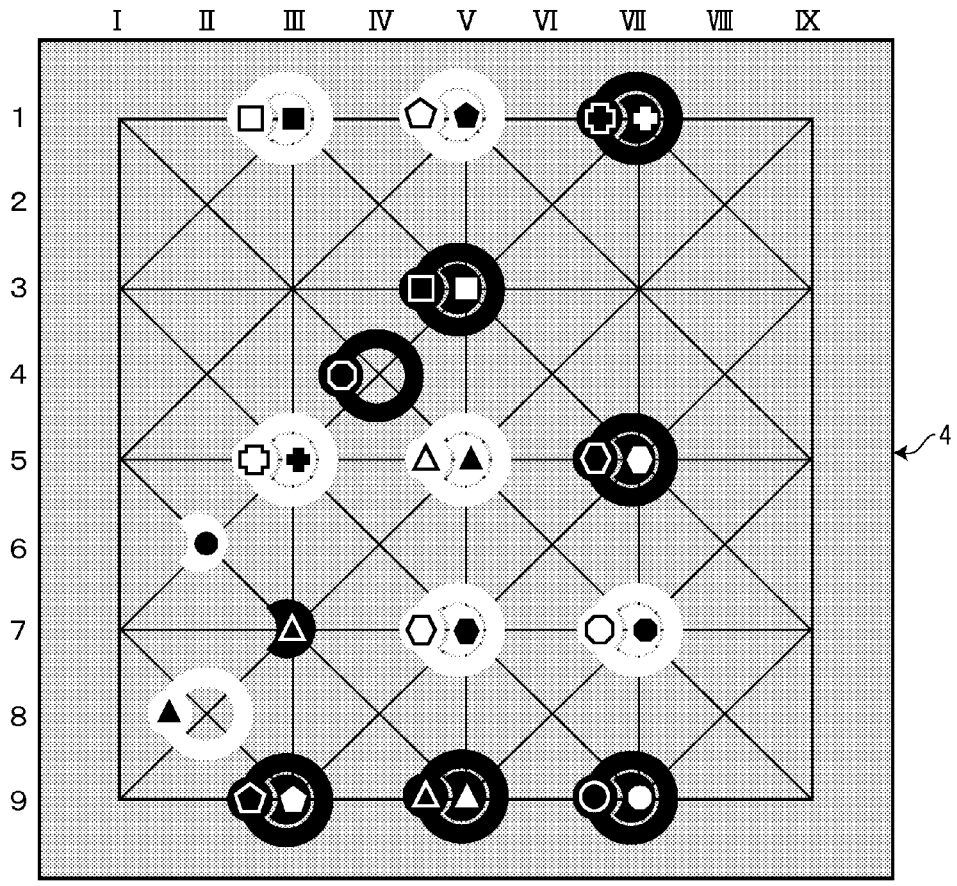
FIG. 50 is a plan view showing a state, in which, in another simulation game by the electronic game machine of the embodiment of the present invention, a game has come to an end.
Figure 51:
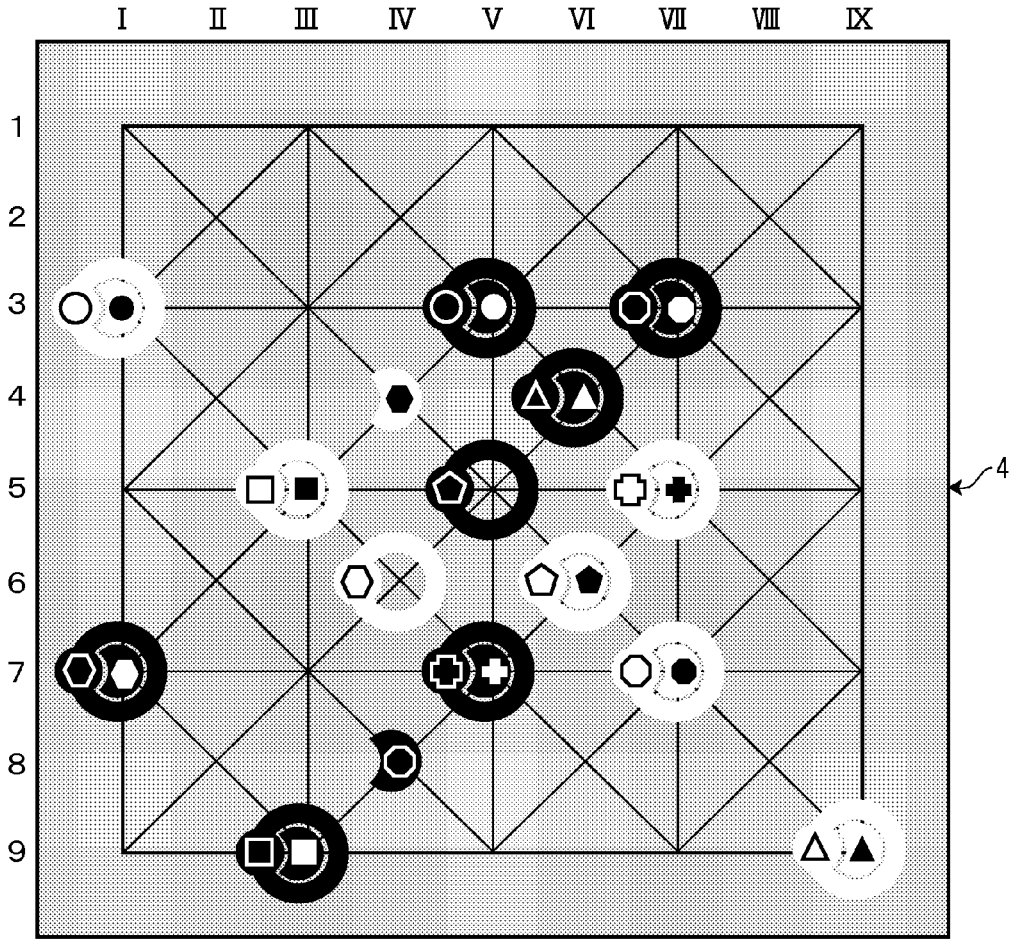
FIG. 51 is a plan view showing a state, in which, in still another simulation game by the electronic game machine of the embodiment of the present invention, a game has come to an end.
Figure 52:
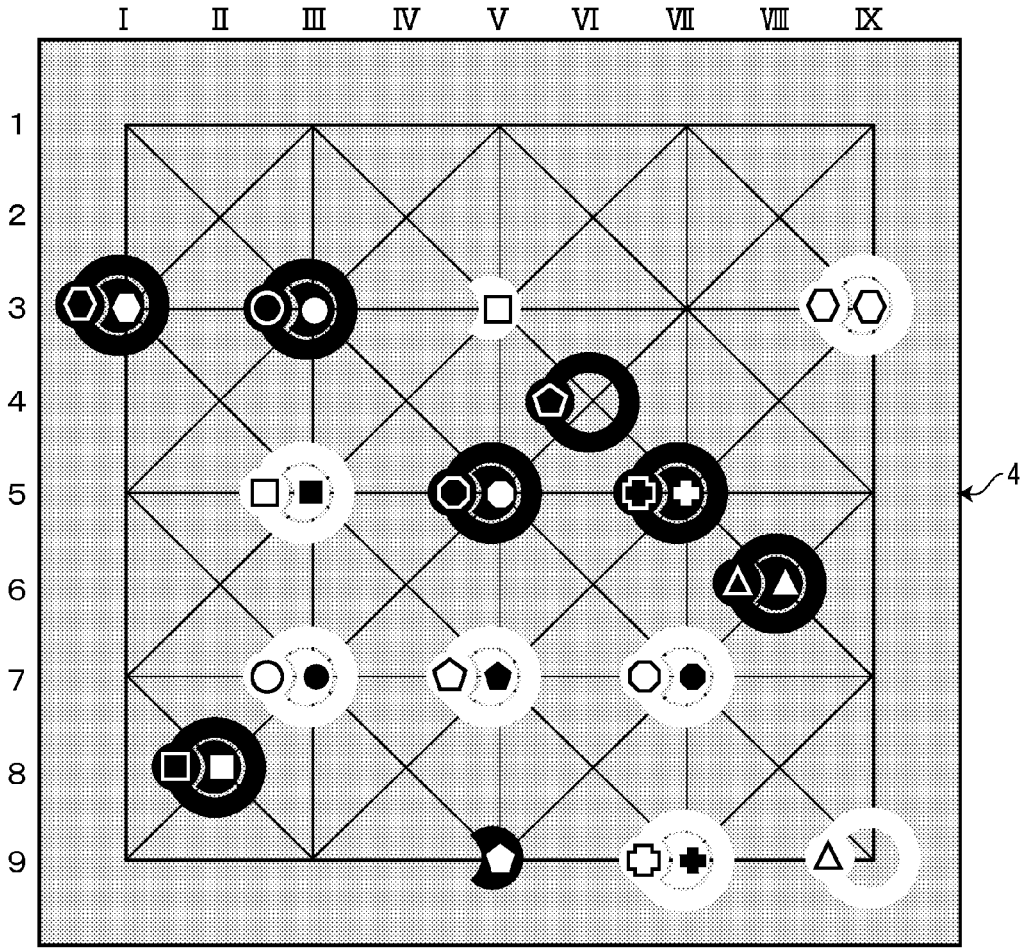
FIG. 52 is a plan view showing a state, in which, in still another simulation game by the electronic game machine of the embodiment of the present invention, a game has come to an end.
Figure 53:
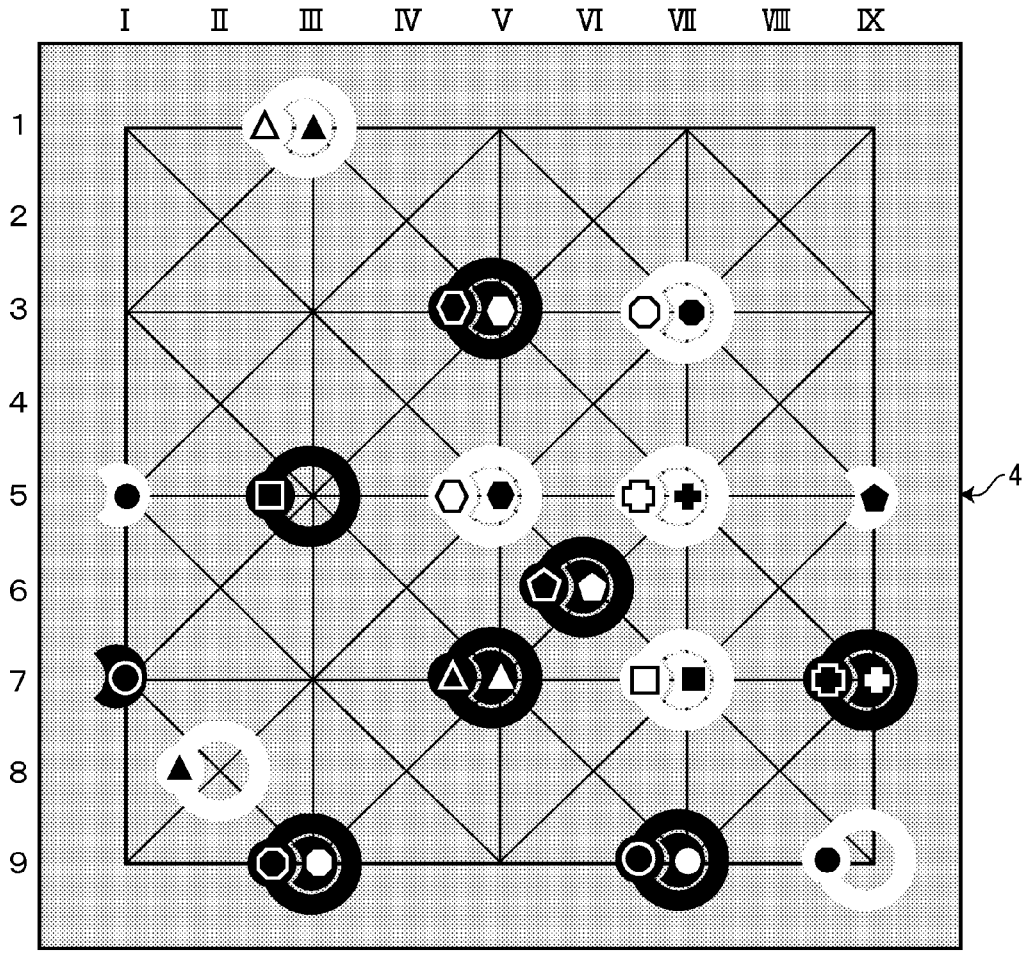
FIG. 53 is a plan view showing a state, in which, in still another simulation game by the electronic game machine of the embodiment of the present invention, a game has come to an end.

Then, as shown in FIG. 49, when the second mover, as scheduled, performs an operation of moving the solid game piece 8 (see FIG. 48) having a black quadrangular hollow graphics along the horizontal ruled line to the intersection point IX7 and reversing the same, the game piece movement means 33 judges the propriety of the movement and the game piece reversal permitting means 34 judges the propriety of the reversal of the black solid game piece 8. In this situation, since the hollow game piece 12 having a black hexagonal hollow graphics having a contour with the same color and same shape as the black solid game piece 8 at the time of reversal is put on the intersection point IX7, the game piece movement permitting means 33 permits the movement of the solid game piece 8 to the intersection point IX7 and the game piece reversal permitting means 34 permits the reversal of the solid game piece 8 and, therefore, the solid game piece 7 and hollow game piece 11 are put on the intersection point IX7 in a state where the solid game piece 8 and the hollow game piece 12 are united and the black solid game piece 8 and black hollow game piece 12 are judged by the game piece uniting judging means 35 to be united with each other. Moreover, the double uniting judging means 37 judges that uniting (doubly uniting) among graphics occurs and that the united game piece is judged as a regular doubly united game piece, the intersecting line number calculating means 36 calculates the number of intersected lines at an intersection point at which the united game piece is put. Then, according to the formula to be applied in the case of the regular doubly united game piece shown in FIG. 7 (number of intersected lines at an intersection point at which a united game piece exists ×2+5 points), 15 points are given as the obtained score of the white game pieces and a total score obtained of the white game pieces is summed up by the score summing-up means 38 and stored in the storing device 23.

Then, at this moment, the total score, which is summed up by the score summing-up means 38 of the black game pieces selected by the second mover become 102 points and the score has reached 100 points being the minimum obtained scores and, therefore, the fighting result judging means 39 certifies the second mover game player as a winner of the game and the game comes to an end.

The result is that white game piece:black game piece become 76 points:102 points. Thus, the second mover game player has become a winner with great difference. This means that the mover having occupied many intersection points each providing 8 score points does not always become a winner. It can be understood that uniting of all game pieces is not a necessary condition for winning It also can be also understood that, since there are four kinds of uniting methods, it is preferable that a game is put forward while a balance between the number of moves and obtained scores is calculated.

Moreover, in the present simulation, a case as an example is taken up in which a beginner of the present game, when selecting a white game piece as a first mover, takes the action with the highest possibility that a hollow game piece 11 (semi-hollow game) having a white hollow graphics is reversed and is moved as the hollow game piece 11 (regular hollow game piece) having a white solid graphics on an intersection point providing three high score points (8 score points) put at a center of a game board 4. At a glance, it seems that the first mover having selected the white game piece holds an overwhelmingly predominant position in the game evolution and wins the game with an overwhelming margin, however, in reality, the fact is completely opposite and, if hollow game pieces are put, at the same time, on the three intersection points providing high scores (8 score points), it is predicted that very disadvantageous conditions occur. The reasons for this, which can be thought in other various ways, are that, in the simulation of the example, the black solid game piece 8 and black hollow game piece 12 are deployed, in a concentrated manner, at the 7th column, 8th column, and 9th column, which causes easy uniting of the black solid game piece 8 and hollow game piece 12. This is due to the reason that the number of intersection points 3 of the game board 4 and initial arrangement of the game pieces 5 and 6 are set so that such conditions and states can occur. In addition to these, many tricks and contrivances are provided to the game board and the initial arrangement of the game pieces 5 and 6 and, therefore, there is a pleasure as if the game players are doing a puzzle through the game.

Thus, in the present game, game players can enjoy various game evolution in its opening phase, middle phase, and last phase of the game. For example, FIGS. 50 to 53 show the states at the time when other simulation games come to an end, which represents that profundity of the game cannot be introduced only by one simulation game.

In the actual game, game players vary in their real ability and way of thinking Therefore, the present game is supported by all game players desiring game evolution having variations.

In order to be a winner of the game, strategies as described below should be adopted.

1. A game player should start the game after imagining a game piece that can change an intersection of a moving destination of each game piece and graphics to be written on each game piece according to a "minimum obtained score" preset before the start of the game and should make an optimal move every time by flexibly changing a policy depending on a move of an opponent and game evolution.

2. A game player should occupy 9 intersection points each providing points as high as 8 score points by moving own game piece more speedily than an opponent and more intersection points. However, the game player should note that, if game pieces being able to be moved by one move are moved by one move without any consideration to 3 intersection points providing 8 score points positioned at a center of a game board, the game evolution beyond becomes disadvantageous in some cases.
3. A game player should unite more game pieces more speedily than an opponent. A game player should move a game piece more speedily to allow a game to be united and should take a measure to jump over successively arranged game pieces. In order to jump over the successively arranged game pieces, the game player should move game pieces so that game pieces arrange successively. A game player should know that, when game pieces are arranged successively, there is a possibility that the successively arranged game pieces are utilized by an opponent as well. A game player pauses the successively arranged game pieces deliberately in some cases or stop the movement of game pieces of an opponent by occupying all intersection points in a moving direction.
4. A game player should move own game pieces more speedily to the intersection points to which an opponent is going to move a game to hinder the opponent from moving game pieces. By doing so, a game player can hinder an opponent from uniting of a solid game piece and a hollow game piece of opponents or enables the movement of game pieces to a targeted intersection point by forcing a roundabout way for the game piece of an opponent.
5. When an opponent jumps over game pieces to move the opponent's game piece, a game player should move own game piece before own game piece is jumped over by the opponent's game piece to increase the number of moves of the opponent.
6. A game player should know that, if it is possible to hinder an opponent from moving a game piece and to move own game piece more speedily, the uniting of game pieces on an intersection point providing low score points (3 or 4 score points) is an advantageous way in some cases.
7. A game player should know that a moving path can be ensured by once uniting game pieces that are easily united to change a direction.
8. A game player should know that, 3 semi-solid game pieces each providing 8 score points in an initial arrangement are put on the intersection point, however, a method is available which changes 3 semi-solid game pieces into a regular solid game piece without surrendering the intersection point providing 8 score points. This method is complicated, however, by this method, game pieces able to be easily united (semi-solid game piece and regular hollow game piece) are temporarily once united as a hollow united game piece and then the regular hollow game piece is left at the intersection point providing 8 scores point and the solid game piece is moved to another intersection point in order to change the semi-solid game piece into the regular solid game piece.
9. A game player should set forward the game while making calculation as to what is the difference in number of moves between the game player and an opponent or as to what score points can be obtained as a total score point or making concrete calculation as to winning or defeat, to make an optimal move very time.

As described above, the electronic game machine 20 and electronic game program 30 have the following patentability.

1. Patentability of Game Board

The electronic game machine 20, by using the game board 4 so configured as to have a different number of intersected lines at each of the intersection points 3, is so devised as to provide a different score depending on the number of intersected lines at each intersection point. Therefore, the game machine 20 has an advantage, even in a state where the solid game piece 7 and 8 each having a solid or hollow graphics with a contour having the same color and shape at the intersection points and the united game pieces are put on the game board 4, a score that each of the game pieces can be seen. As a result, while playing the game, reading of a basic score by bringing or moving each game piece 5 and 6 is not required. Moreover, by writing a score to be provided as a basic score on each intersection point of the game board 4, a score to be provided as a basic score can be seen. Thus, an idea and/or technology to use the number of intersected lines at each intersection point as a basic score in a game have not at all existed so far.

Moreover, an idea and/or technology to write the number of intersected lines and the basic score (numeral) being the same as the number of intersected lines on each of intersected points 3 on the game board 4 have not at all existed so far. Further, a correspondence table for a solid graphics or hollow graphics written on a front side and rear side of each of the game pieces is displayed on sides of both game players on the game board 4 which enables a written graphics appearing when each of game pieces 5 and 6 is reversed during the game period to be caught at a glance.

2. Patentability of Each Game Piece

The kind of each of the game pieces 5 and 6 is only two. Instead, the solid game pieces 7 and 8 having a combination of solid graphics 7 and 8 and hollow graphics 11 and 12 being different from one another on both the front and rear sides of each of the game pieces 5 and 6 are used and the solid game pieces 7 and 8 and hollow game pieces 11 and 12 can be united with one another and the solid game pieces 7 and 8 can be fitted into the inside portion of the hollow game pieces 11 and 12 having the same in color and in shape as each of the game pieces 5 and 6. On both sides of each of the game pieces 5 and 6, solid graphics and hollow graphics are written and on the front sides of each of the solid game pieces 7 and 8, a hollow graphics is written and on the front sides of each of the hollow game pieces 11 and 12, a solid graphics is written. On the rear sides of each of the solid game pieces 7 and 8, a solid graphics is written and on the rear sides of each of the hollow game pieces 11 and 12, a hollow graphics is written. As the graphics to be written on each of game pieces 5 and 6, a combination of graphics being different between its front side and its rear side is written. The game piece is so constructed that, even when each of the game pieces 5 and 6 is reversed, the solid game pieces 7 and 8 and hollow game pieces 11 and 12 can be united and, further, in order to unite these game pieces, irrespective of the order of uniting, the solid game pieces 7 and 8 can be fitted into the hollow game pieces 11 and 12 and the hollow game pieces 11 and 12 can be fitted into the solid game pieces 7 and 8 or vice versa. As a result, each of the solid game pieces 7 and 8 and each of the hollow game pieces 11 and 12, at every time of reversal, have to select another different game pieces, which improves the elegance and tastefulness of the game.

Moreover, the four kinds of uniting of game pieces are possible. For every kind of united game piece, an obtained score of the united game pieces can be determined by using the number of intersected lines at each intersection point as a basic score. That is, a different score obtained can be set according to the difference among "solid united game piece", "hollow united game piece", "semi-doubly united game piece", and "regular doubly united game piece". By writing a solid graphics (symbol of each solid game piece) each having a different type and hollow graphics (symbol of each hollow piece) each having a different type on both the front side and rear side of "each solid game piece and each hollow game piece", at the time of uniting between each solid game piece and each hollow game piece, uniting between each solid graphics and each hollow graphics is made possible and doubly uniting between game pieces and between graphics is also made possible. By configuring as above, the number being twice the number of intersected lines at the intersection point can be used as an obtained score at the time of calculating scores of united game pieces at each of the intersection points, thereby giving a variation to the score calculation and improving game property. Depending on a combination of graphics written on a united game piece, quadruplicate kinds of scores can be obtained, that is, the obtained scores increase or decrease depending on combinations, which further improves game property.

Further, on both the front and rear of each of the hollow game pieces, space for writing graphics is provided and the idea and/or technology to write a graphics on the space for writing have not at all existed so far. The idea or technology by writing a different graphic on both the front and rear sides of each of the hollow game pieces 11 and 12 and by reversing these game pieces to achieve the uniting of other game pieces has not at all existed so far. Further, following ideas and/or technologies have not at all existed so far, that is, according to the present invention, solid and hollow graphics each being different from one another are written on the front and rear sides of the hollow game pieces 11 and 12 and the semi hollow game pieces are separated from each other and the uniting of solid or hollow graphics written on the hollow game pieces 11 and 12 with the solid or hollow graphics written on the solid game pieces 7 and 8 is made possible and, as a result, the uniting of game pieces between the solid game pieces between the solid game pieces 7 and 8 and the hollow game pieces 11 and 12 is made possible at the same time of the uniting of graphics between the solid graphics and hollow graphics and, still further, depending on the kind of the united game pieces (four kinds of solid united game piece, hollow united game piece, semi doubly game pieces and regular doubly united game pieces) or on a degree of difficulty, a different score is allowed to be obtained. Still further, an idea and/or technology have not at all existed so far, the calculation of obtained scores is made by using the number of intersected lines at the intersection point 3 on which the united game pieces are put, as a basic score point. Still further, by making the height of each of solid game pieces 7 and 8 be higher than that of each of the hollow game pieces 11 and 12, either of the game pieces can be easily confirmed by sight and be easily grasped and held.

3. Patentability of Game Specification (1) Method of Providing Scores

Scores are given to each of game pieces 5 and 6 depending on the kind of united game piece, using the number of intersected lines at the intersected point 3 until the solid game pieces 7 and 8 with a hollow graphics having a contour with the same color and shape is united with the hollow game pieces 11 and 12 at the intersected point 3. That is, in the case of the "solid united game piece" formed by the uniting of the solid game pieces 7 and 8 having the solid graphics with the hollow game pieces 11 and 12 having the solid graphics, the number of intersected lines at the intersection point 3 at which the united game piece exists is given as a score. In the case of the "hollow united game piece" formed by the uniting of the solid game piece having a hollow graphics with the hollow game pieces 11 and 12 having the hollow graphics, the number of intersected lines at the intersection point 3 at which the united game piece existed are given as a score. In the case of "semi doubly united game piece" formed by the uniting of the solid game pieces 7 and 8 having a hollow graphics with the hollow game pieces 11 and 12 having a solid graphics, the number of intersected lines at the intersection point 3 at which the united game points exist and the number ×2 score points are given as a score. In the case of the "regular doubly united game piece" formed by the uniting of the solid game pieces 7 and 8 having a solid graphics with the hollow game pieces 11 and 12 having the hollow graphics, the number of intersected lines at the intersection point 3 at which the united game piece exists and the number×2+5 score points are given as a score.

(2) Method of Ending Game and Method of Determining Winning and Defeat

When either of the game players obtains a minimum obtained score or more (which is set before the start of a game). For example, the score is set at 100 points, the game comes to an end and the game player who could first obtain the minimum obtained score becomes a winner of the game. However, if the first mover first obtains the minimum obtained score, the second mover can move own game piece once more only and, in that case, the game player having selected a game piece having a color in which a total score is bigger becomes a winner of the game.

(3) Method of Moving Each Game Piece

Each of the game pieces 5 and 6 can be moved along the ruled line 2 on the game board 4 vertically, horizontally, or slantingly on each of the intersected points 3. A game piece never fails to move along the ruled line 2 and cannot move to a direction where no ruled lines 2 exist. The movement of a game piece is allowed from one intersection point 3 to another intersection point 3 by one and, as a principle, both of game players can move alternately own game piece with a color selected by the game players (solid game pieces 7 and 8 or hollow game pieces 11 and 12) vertically, horizontally, or slantingly along any one of ruled lines 2 on the game board 4 in a manner in which a game piece moves one by one of the intersection points 3. However, when game pieces are arranged successively in a direction of a game piece (each of the solid game pieces 7 and 8 or each of the hollow game pieces 11 and 12) to be moved, irrespective of the solid game pieces 7 and 8, hollow game pieces 11 and 12, any written game piece), all the game pieces must be jumped over. The solid game pieces 7 an 8, hollow game pieces 11 and 12, both of them, and united game pieces can be jumped over. As an exception, if there is a game piece (game piece having a graphics with a contour with the same color and shape) that can be united with, in the direction where game pieces are arranged, the game pieces able can be united. However, if the uniting is not desired, these game pieces able to be united can be jumped over. Even after the uniting between the solid game pieces 7 and 8 and hollow game pieces 11 and 12, each of the game pieces can be moved individually as a separate game piece, however, a united game piece cannot be moved with these game pieces being united together. Moreover, the intersection point 3 being a destination of movement of a game piece must be empty except the case where a game piece being able to be united exists, and if the intersection point is not empty, the movement of any game piece is not allowed.

(4) Reversal of Each Game Piece (Change of Written Graphics)

Both game players can alternately move one game piece having any one of colors selected by themselves as one move in the game. At the time of the movement of a game piece, the game piece can be reversed to change a graphics written thereon. To reverse a game piece for changing a written graphics, the game piece must be moved and the written graphics cannot be changed without moving the game piece. Moreover, by reversing the game piece whose written graphics has been changed to return the game piece back to its original state of graphics, however, the changed graphics is to be moved and, without moving the game piece, any written graphics cannot be changed. Only the movement of a game piece can be possible without reversing the game piece (without changing the written graphics). On the front side of the solid game pieces 7 and 8, a hollow graphics is written and on the front side of the hollow game pieces 11 and 12, a solid game piece is written and on the rear side of the solid game pieces 7 and 8, a solid graphics is written and on the rear side of the hollow game pieces 11 and 12, a hollow graphics is written. However, all combinations of graphics written on the front side are different from those written on the rear side. At initial arrangement state, all game pieces are solid game pieces 7 and 8 (semi solid game pieces) having hollow graphics or hollow game pieces 11 and 12 having hollow graphics (semi hollow game pieces) and, when all game pieces are reversed, solid game pieces 7 and 8 (regular solid game pieces) having solid graphics or hollow game pieces 11 and 12 (regular hollow game pieces) having hollow graphics appear. When each game piece is reversed, the graphics changes from the solid graphics to the hollow graphics or from the hollow graphics to the solid graphics and also the kind of a graphics written thereon changes and, therefore, a game piece is to be united with another game piece, the game piece must be united with a game piece having graphics after being changed (irrespective of solid graphics or hollow graphics), which further increases game's property. When the minimum obtained score is set to be high (100 points or more), unless all game pieces are changed to a regular solid game piece or regular hollow piece, it is difficult to be a winner of the game, however, to change all game pieces to the regular solid game piece or the regular hollow game piece, all game pieces must be changed and, at the initial state, three white and black semi solid game pieces put on the intersection point 3 providing a high score (8 score points) must be moved to change it into the regular solid game piece. If so, at the time of the movement, a possibility increases that the intersection point providing a high score is occupied, and when and at what time a game piece of own color is changed from an intersection point providing a high score to change into the regular solid game piece becomes a factor to determine winning and defeat, which further increases game's property.

(5) Initial Arrangement of Each Game Piece and Combination of Written Graphics on Front Side and Rear Side In all uniting cases including the uniting of solid game pieces 7 and 8 (semi solid game piece) having a hollow graphics with hollow game pieces having a solid graphics 11 and 12 (semi hollow game piece), of solid game pieces 7 and 8 (regular solid game piece) having a solid graphics with hollow game pieces 11 an 12 (regular hollow piece) having a hollow graphics with hollow game pieces 11 and 12 (regular hollow game piece) having a hollow graphics, and of solid game pieces (semi solid game pieces) having a solid graphics with hollow game pieces (regular hollow game piece) having a hollow graphics, any combination between one game piece and another game piece or any combination between one graphics and another graphics are made uniquely impossible. In any game piece, combinations of all graphics in solid game pieces 7 and 8 (on a front side) having a hollow graphic and solid game pieces 7 and 8 (on a rear side) having a solid graphic and in hollow game pieces 11 and 12 (on a front side) having a solid graphic and hollow game pieces 11 and 12 (on a rear side) having a hollow graphics are made different from one another. Moreover, when a game piece is moved to an intersection point providing a high score (8 points) at one time, in order to make further uniting difficult and to make the movement of an opponent become advantageous, a combination of initial deployment for all game pieces and a combination between front side and rear side are derived and adopted, which provides a game with novelty and progressive property to further improve variations and elegance and tastefulness of the game.

Additionally, according to the electronic game machine 20 and electronic game program 30 of the embodiment of the present invention, the following various excellent effects can be obtained.

1. Owing to simplicity of rules of the game, any one, irrespective of age and sex, can play the game and enjoy immediately. Therefore, the game machine of the present invention can be spread widely and can be used as an intellectually training game for kids, as a game machine for prevention from cognitive impairment of the aged, and as a thinking game for general game players.
2. Play equipment and game machine, owing to their worldly common features, can provide places for communication, competitive sports and the like by breaking down a partition wall among the aged and the young, races, people, religions, languages, regions and the like to contribute to friendly relations with all people in the world and foreign countries and to world peace.
3. The order of playing the game does not provide advantages or disadvantages to game player and the game itself is fair, thus enabling both game players to fully enjoy the game.
4. The best move for a first mover is different from that of a second mover and even if the second mover tries to make the same move as the first mover, the same move is not allowed to be made, which does not throw a wet blanket.
5. Though the rules of the game is simple, game contents are very complicated and, therefore, various strategies are available and it is important to understand each deployment of each game piece on the game board to make the best move every time which requires game players to think to which strategy a priority is given for every move, which does not bore the game player.
6. One move may cause a change in a game stream and game players must deeply read several moves ahead and a difference of one move during a period of game may become a turning point between loss and profit, thus, in order to attract the game stream, the judgment as to which game piece is to be moved or as to how the game piece is to be moved in terms of order in a game and, by using these strategies, elegance and tastefulness can be improved.
7. It is difficult to make investigation into a sure fine way to win the game and to build up established tactics and, therefore, a game player can enjoy while thinking of one move and can enjoy the game as a thinking game with a flesh feeling.
8. One move may change the game revolution thereafter and it is difficult in many cases to judge which game player predominates in a game until end of the game, which, as a result, does not bore game players and galleries of the game.

9. Game evolution changes for every move of the game piece and, therefore, a game player must consider, every time, carefully the move of the piece made by an opponent and the best move must be made and the game evolution enabling a game player to keep a feeling of comfortable tension.

10. A game player must pay attention to an entire game board and think out one move from various points of view and by playing the game, right-brain space recognition capability, left-brain planning capability, left-brain calculating capability, planning power, deductive power, prediction capability of results and evolution, intuitive power, sixth sense, and the like can be improved and effects of activation and development of brain capability.

Finally, we hope that the game of the present invention grows, owing to the easiness of game rules, to be a kind of game in such a state where families and companies including galleries gather around a display of the game machine to join in the game We also expect that the game having a game style of 3D (three dimension) and characterized variations becomes such that a game is more approachable and spreads through the world. We further expect that the game is loved all over the world and, in such a manner in which fancies of the game become winners of the game, a game player can create many bonds among people like uniting among game pieces and graphics and think out a fruit called an "obtained score" to be increased like the number of intersected lines at each intersection point on the game board under an equally provided circumstance, depending on personal relations, information presetting capability and the like and struggle the game evolution by imposing the game or puzzle over one's life as if the game evolution showing different development every time were a reduced drawing of one's life and the game can give some inspiration serving as a hint to life and also want to keep a close watch over the sate in which the game grows to its mature level.

What is claimed is:

1. An electronic game machine comprising a CPU (Central Processing Unit), a storing device, a display, and an inputting device, wherein the CPU functions as:

a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score;

a game piece deploy controlling unit to initially deploy game pieces each having a color being different for every game player wherein game pieces each having any one of two colors, are devised so that different combinations of graphics are able to be written on a plurality of and same number of both front and rear sides of each of game pieces at an intersection point on the game board displayed on the display by the game board displaying unit based on data stored in the storing device according to operations of the inputting device, wherein the game piece comprises a combination of a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different hollow graphics is written in writing space on the front side, a solid graphics having a contour being different from the hollow graphics on the front side, out of the solid graphics having a contour with a same shape with each of the hollow graphics is written in writing space on the rear side of each solid game piece having a color and wherein, on hollow game pieces each having one of two colors, a different solid graphic is written in writing space on the front side of the hollow game piece and a hollow graphic having a contour different from a solid graphics on the front side out of hollow graphics each having a same shape as each of the solid graphics is written in writing space on the rear side of the hollow game pieces and wherein a hollow graphics being able to be united with the solid graphic written on the solid game piece is written on the hollow game pieces and a solid graphics being able to be united with a hollow graphics written on the solid game pieces is written on the hollow game pieces and wherein doubly uniting is made possible which includes uniting between game pieces, one being a game piece on which the solid graphics or the hollow graphics is written and the other being a game piece on which a hollow graphics or a solid graphics having a contour with a same color and same shape with the game piece is written, and the uniting between graphics, one being the solid graphics written on the solid game piece or hollow game piece and the other hollow graphics written on the hollow game piece or the solid game piece;

a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united which the hollow graphics or solid graphics having a contour being the same in color and shape as the solid graphics or the hollow graphics written on the solid game piece or hollow game piece to be moved is written, to permit movement of a solid game piece or a hollow game piece to an intersection point being nearest to a position where successively arranged all game pieces in the moving direction are jumped over or another intersection point on which another game piece being able to be united with existing in the successively arranged game pieces is put and to judges propriety of moving the solid game piece or the hollow game piece to an intersection point of the game board;

a game piece reversal permitting unit to permit the reversal of the solid game piece or hollow game piece to which a movement permission is given according to operations of the inputting device in the case when the movement is permitted by the game piece movement permitting unit;

a game piece uniting judging unit to judge, when the movement is permitted by the game piece movement permitting unit, whether the solid game piece or hollow game piece to which movement is permitted according to the inputting device has moved and united with other game piece;

an intersected line number calculating unit, to calculate, when the solid game piece or the hollow game piece is judged to have been united with other game piece by the game piece uniting judging unit, the number of intersected lines at an intersected point on which a united game piece is put on;

a double uniting judging unit to judge existence or non-existence of double uniting occurring at the same time of uniting between graphics including uniting of the solid graphics written on the solid game piece and hollow game piece with the hollow graphics, when the solid game piece or the hollow game piece is judged to have been united with other game piece by the game piece uniting judging unit;

a score summing-up unit to calculate obtained scores of each game piece to sum up a total score of game pieces having each color based on the number of intersected lines calculated by the intersected line number calculating unit and the existence or non-existence of double uniting judged by the double uniting judging unit in the case where double uniting is judged to exist by the double uniting judging unit in a manner in which the obtained score is made higher compared with the case where double uniting is judged as no existence by the double uniting judging unit; and a fighting result judging unit to certify, as a winner, a game player selected a game piece having a color wherein a total score of the game piece summed up by the score summing-up unit first reaches a predetermined minimum obtained score.

2. The electronic game machine according to claim 1, wherein the double uniting judging unit, when judging that the double uniting has occurred, further judges whether or not, double uniting in the solid game piece and the hollow game piece has occurred in a state where the solid game piece and hollow game pieces have reversed to their rear sides, and the score summing-up unit calculates obtained scores so that the obtained score is made higher compared with the case where double uniting in the solid game piece and hollow game piece has occurred in a state where the solid and hollow game pieces have not reversed to their rear sides and then sums up a total score of each game piece with each color.

3. The electronic game machine according to claim 1, wherein, instead of the certification of a winner of a game performed by the fighting result judging unit, when a score of a game piece having a color selected by a first mover first reaches the minimum obtained score compared with the case where a score of a game piece having a color selected by a second mover reaches, at the time when a game piece having the color selected by the second mover is moved once, the game comes to an end and the game player having bigger scores is certified as a winner and when a score of a game piece having the color selected by a second mover first reaches the minimum obtained score compared with the case where a score of a game piece having a color selected by a first mover reaches, the game comes to an end and the second mover is certified as a winner.

4. The electronic game machine according to claim 1, wherein the game board displaying unit displays the game board on which, by intersection between 5 ruled lines formed vertically and horizontally and 7 ruled lines formed in left-slanted and right-slanted directions, a total of 41 pieces of intersected points is formed which includes 3 pieces of intersected points at which 4 ruled lines intersect, 16 pieces of intersection points at which 4 ruled line intersect, 12pieces of intersection points at which 5 ruled lines intersect, and 9 pieces of ruled lines at which 8 ruled lines intersect, on a display including each 9 lines vertically and horizontally, and wherein the game piece deploy controlling unit deploys 7 pieces for each of solid game pieces and hollow game pieces each having each color being 28 game pieces in total and initially deploys game pieces on first to third columns on one game player side and on seventh to ninth columns on the other game player side.

5. An electronic game machine comprising a CPU, a storing device, a display, and an inputting device, wherein the CPU functions as:

a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score;

a game piece deploy controlling unit to initially deploy game pieces each having a color being different for every game player wherein game pieces each having any one of two colors, are devised so that different combinations of graphics are able to be written on a plurality of and same number of both front and rear sides of each of game pieces at an intersection point on the game board displayed on the display by the game board displaying unit based on data stored in the storing device according to operations of the inputting device, wherein the game piece comprises a combination of a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different solid graphics is written in writing space on the front side, a hollow graphics having a contour being different from the solid graphics on the front side, out of the hollow graphics having a contour with a same shape with each of the solid graphics is written in writing space on the rear side of each solid game piece having a color and wherein, on hollow game pieces each having one of two colors, a different hollow graphic is written in writing space on the front side of the hollow game piece and a solid graphic having a contour different from a hollow graphics on the front side out of solid graphics each having a same shape as each of the hollow graphics is written in writing space on the rear side of the hollow game pieces and wherein a hollow graphics being able to be united with the solid graphic written on the solid game piece is written on the hollow game pieces and a solid graphics being able to be united with a hollow graphics written on the solid game pieces is written on the hollow game pieces and wherein doubly uniting is made possible which includes uniting between game pieces, one being a game piece on which the hollow graphics or the solid graphics is written and the other being a game piece on which a solid graphics or a hollow graphics having a contour with a same color and same shape with the game piece is written, and the uniting between graphics, one being the solid graphics written on the solid game piece or hollow game piece and the other hollow graphics written on the hollow game piece or the solid game piece;

a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united which the hollow graphics or solid graphics having a contour being the same in color and shape as the solid graphics or the hollow graphics written on the solid game piece or hollow game piece to be moved is written, to permit movement of a solid game piece or a hollow game piece to an intersection point being nearest to a position where successively arranged all game pieces in the moving direction are jumped over or another intersection point on which another game piece being able to be united with existing in the successively arranged game pieces is put and to judges propriety of moving the solid game piece or the hollow game piece to an intersection point of the game board;

a game piece reversal permitting unit to permit the reversal of the solid game piece or hollow game piece to which a movement permission is given according to operations of the inputting device in the case when the movement is permitted by the game piece movement permitting unit;

a game piece uniting judging unit to judge, when the movement is permitted by the game piece movement permitting unit, whether the solid game piece or hollow game piece to which movement is permitted according to the inputting device has moved and united with other game piece;

an intersected line number calculating unit, to calculate, when the solid game piece or the hollow game piece is judged to have been united with other game piece by the game piece uniting judging unit, the number of intersected lines at an intersected point on which a united game piece is put on;

a double uniting judging unit to judge existence or non-existence of double uniting occurring at the same time of uniting between graphics including uniting of the solid graphics written on the solid game piece and hollow game piece with the hollow graphics, when the solid game piece or the hollow game piece is judged to have been united with other game piece by the game piece uniting judging unit;

a score summing-up unit to calculate obtained scores of each game piece to sum up a total score of game pieces having each color based on the number of intersected lines calculated by the intersected line number calculating unit and the existence or non-existence of double uniting judged by the double uniting judging unit in the case where double uniting is judged to exist by the double uniting judging unit in a manner in which the obtained score is made higher compared with the case where double uniting is judged as no existence by the double uniting judging unit; and a fighting result judging unit to certify, as a winner, a game player selected a game piece having a color wherein a total score of the game piece summed up by the score summing-up unit first reaches a predetermined minimum obtained score.

6. The electronic game machine according to claim 5, wherein the double uniting judging unit, when judging that the double uniting has occurred, further judges whether or not, double uniting in the solid game piece and the hollow game piece has occurred in a state where the solid game piece and hollow game pieces have reversed to their rear sides, and the score summing-up unit calculates obtained scores so that the obtained score is made higher compared with the case where double uniting in the solid game piece and hollow game piece has occurred in a state where the solid and hollow game pieces have not reversed to their rear sides and then sums up a total score of each game piece with each color.

7. The electronic game machine according to claim 5, wherein, instead of the certification of a winner of a game performed by the fighting result judging unit, when a score of a game piece having a color selected by a first mover first reaches the minimum obtained score compared with the case where a score of a game piece having a color selected by a second mover reaches, at the time when a game piece having the color selected by the second mover is moved once, the game comes to an end and the game player having bigger scores is certified as a winner and when a score of a game piece having the color selected by a second mover first reaches the minimum obtained score compared with the case where a score of a game piece having a color selected by a first mover reaches, the game comes to an end and the second mover is certified as a winner.

8. The electronic game machine according to claim 5, wherein the game board displaying unit displays the game board on which, by intersection between 5 ruled lines formed vertically and horizontally and 7 ruled lines formed in left-slanted and right-slanted directions, a total of 41 pieces of intersected points is formed which includes 3 pieces of intersected points at which 4 ruled lines intersect, 16 pieces of intersection points at which 4 ruled line intersect, 12 pieces of intersection points at which 5 ruled lines intersect, and 9 pieces of ruled lines at which 8 ruled lines intersect, on a display including each 9 lines vertically and horizontally, and wherein the game piece deploy controlling unit deploys 7 pieces for each of solid game pieces and hollow game pieces each having each color being 28 game pieces in total and initially deploys game pieces on first to third columns on one game player side and on seventh to ninth columns on the other game player side.

9. A program stored on a non-transitory storing device for an electronic game machine having a CPU, the storing device, a display, and an inputting device to make the CPU function as:

a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score;

a game piece deploy controlling unit to initially deploy game pieces each having a color being different for every game player wherein game pieces each having any one of two colors, are devised so that different combinations of graphics are able to be written on a plurality of and same number of both front and rear sides of each of game pieces at an intersection point on the game board displayed on the display by the game board displaying unit based on data stored in the storing device according to operations of the inputting device, wherein the game piece comprises a combination of a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different hollow graphics is written in writing space on the front side, a solid graphics having a contour being different from the hollow graphics on the front side, out of the solid graphics having a contour with a same shape with each of the hollow graphics is written in writing space on the rear side of each solid game piece having a color and wherein, on hollow game pieces each having one of two colors, a different solid graphic is written in writing space on the front side of the hollow game piece and a hollow graphic having a contour different from a solid graphics on the front side out of hollow graphics each having a same shape as each of the solid graphics is written in writing space on the rear side of the hollow game pieces and wherein a hollow graphics being able to be united with the solid graphic written on the solid game piece is written on the hollow game pieces and a solid graphics being able to be united with a hollow graphics written on the solid game pieces is written on the hollow game pieces and wherein doubly uniting is made possible which includes uniting between game pieces, one being a game piece on which the solid graphics or the hollow graphics is written and the other being a game piece on which a hollow graphics or a solid graphics having a contour with a same color and same shape with the game piece is written, and the uniting between graphics, one being the solid graphics written on the solid game piece or hollow game piece and the other hollow graphics written on the hollow game piece or the solid game piece;

a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united which the hollow graphics or solid graphics having a contour being the same in color and shape as the solid graphics or the hollow graphics written on the solid game piece or hollow game piece to be moved is written, to permit movement of a solid game piece or a hollow game piece to an intersection point being nearest to a position where successively arranged all game pieces in the moving direction are jumped over or another intersection point on which another game piece being able to be united with existing in the successively arranged game pieces is put and to judges propriety of moving the solid game piece or the hollow game piece to an intersection point of the game board;

a game piece reversal permitting unit to permit the reversal of the solid game piece or hollow game piece to which a movement permission is given according to operations of the inputting device in the case when the movement is permitted by the game piece movement permitting unit;

a game piece uniting judging unit to judge, when the movement is permitted by the game piece movement permitting unit, whether the solid game piece or hollow game piece to which movement is permitted according to the inputting device has moved and united with other game piece;

an intersected line number calculating unit, to calculate, when the solid game piece or the hollow game piece is judged to have been united with other game piece by the game piece uniting judging unit, the number of intersected lines at an intersected point on which a united game piece is put on;

a double uniting judging unit to judge existence or non-existence of double uniting occurring at the same time of uniting between graphics including uniting of the solid graphics written on the solid game piece and hollow game piece with the hollow graphics, when the solid game piece or the hollow game piece is judged to have been united with other game piece by the game piece uniting judging unit;

a score summing-up unit to calculate obtained scores of each game piece to sum up a total score of game pieces having each color based on the number of intersected lines calculated by the intersected line number calculating unit and the existence or non-existence of double uniting judged by the double uniting judging unit in the case where double uniting is judged to exist by the double uniting judging unit in a manner in which the obtained score is made higher compared with the case where double uniting is judged as no existence by the double uniting judging unit; and a fighting result judging unit to certify, as a winner, a game player selected a game piece having a color wherein a total score of the game piece summed up by the score summing-up unit first reaches a predetermined minimum obtained score.

10. A program stored on a non-transitory storing device for an electronic game machine having a CPU, the storing device, a display, and an inputting device to make the CPU function as:

a game board displaying unit to display a game board, on a display, having a plurality of intersection points at which vertical/horizontal and left-slanted and right-slanted ruled lines intersect are formed based on data stored in the storing device according to operations of the inputting device wherein, at each of the intersection points, different numbers of ruled lines intersect and so devised as to be able to provide a different score using the number of intersected lines as a basic score;

a game piece deploy controlling unit to initially deploy game pieces each having a color being different for every game player wherein game pieces each having any one of two colors, are devised so that different combinations of graphics are able to be written on a plurality of and same number of both front and rear sides of each of game pieces at an intersection point on the game board displayed on the display by the game board displaying unit based on data stored in the storing device according to operations of the inputting device, wherein the game piece comprises a combination of a plurality of solid game pieces being able to be reversed to front and rear sides having a same shape provided with writing space on both front and rear sides and a plurality of hollow game pieces being able to be reversed to front and rear sides and being able to be united with each of the solid game pieces having a same shape provided with writing space on both front and rear sides, wherein, on the solid game pieces each having one of two colors, a different solid graphics is written in writing space on the front side, a hollow graphics having a contour being different from the solid graphics on the front side, out of the hollow graphics having a contour with a same shape with each of the solid graphics is written in writing space on the rear side of each solid game piece having a color and wherein, on hollow game pieces each having one of two colors, a different hollow graphic is written in writing space on the front side of the hollow game piece and a solid graphic having a contour different from a hollow graphics on the front side out of solid graphics each having a same shape as each of the hollow graphics is written in writing space on the rear side of the hollow game pieces and wherein a hollow graphics being able to be united with the solid graphic written on the solid game piece is written on the hollow game pieces and a solid graphics being able to be united with a hollow graphics written on the solid game pieces is written on the hollow game pieces and wherein doubly uniting is made possible which includes uniting between game pieces, one being a game piece on which the hollow graphics or the solid graphics is written and the other being a game piece on which a solid graphics or a hollow graphics having a contour with a same color and same shape with the game piece is written, and the uniting between graphics, one being the solid graphics written on the solid game piece or hollow game piece and the other hollow graphics written on the hollow game piece or the solid game piece;

a game piece movement permitting unit to permit the movement of the solid game piece or the hollow game piece to the next intersection point when, according to operations, one solid game piece or hollow game piece is selected and is to be moved along the ruled line to one intersection point, if no game piece is put on the next intersection point in a moving direction, to permit the movement of the solid game piece or hollow game piece to the next intersection point and when, according to the inputting device, one solid game piece or hollow game piece is selected and is to be moved along the ruled line to one intersection point, if the solid game piece or hollow game piece is put on the next intersection point in a moving direction, only in the case where there is an intersection point on which any game piece is not put or in the case where there is another game piece able to be united which the hollow graphics or solid graphics having a contour being the same in color and shape as the solid graphics or the hollow graphics written on the solid game piece or hollow game piece to be moved is written, to permit movement of a solid game piece or a hollow game piece to an intersection point being nearest to a position where successively arranged all game pieces in the moving direction are jumped over or another intersection point on which another game piece being able to be united with existing in the successively arranged game pieces is put and to judges propriety of moving the solid game piece or the hollow game piece to an intersection point of the game board;

a game piece reversal permitting unit to permit the reversal of the solid game piece or hollow game piece to which a movement permission is given according to operations of the inputting device in the case when the movement is permitted by the game piece movement permitting unit;

a game piece uniting judging unit to judge, when the movement is permitted by the game piece movement permitting unit, whether the solid game piece or hollow game piece to which movement is permitted according to the inputting device has moved and united with other game piece;

an intersected line number calculating unit, to calculate, when the solid game piece or the hollow game piece is judged to have been united with other game piece by the game piece uniting judging unit, the number of intersected lines at an intersected point on which a united game piece is put on;

a double uniting judging unit to judge existence or non-existence of double uniting occurring at the same time of uniting between graphics including uniting of the solid graphics written on the solid game piece and hollow game piece with the hollow graphics, when the solid game piece or the hollow game piece is judged to have been united with other game piece by the game piece uniting judging unit;

a score summing-up unit to calculate obtained scores of each game piece to sum up a total score of game pieces having each color based on the number of intersected lines calculated by the intersected line number calculating unit and the existence or non-existence of double uniting judged by the double uniting judging unit in the case where double uniting is judged to exist by the double uniting judging unit in a manner in which the obtained score is made higher compared with the case where double uniting is judged as no existence by the double uniting judging unit; and a fighting result judging unit to certify, as a winner, a game player selected a game piece having a color wherein a total score of the game piece summed up by the score summing-up unit first reaches a predetermined minimum obtained score.

* * * * *